US006165086A

United States Patent [19]

Liechty, II

[11] Patent Number: 6,165,086

[45] Date of Patent: Dec. 26, 2000

[54] ARROWHEAD WITH A PIVOTAL BLADE SELECTIVELY POSITIONABLE IN A PLURALITY OF DIFFERENT CUTTING DIAMETERS

[76] Inventor: Victor Jay Liechty, II, 1250 N. 1750 W., Provo, Utah 84604

[21] Appl. No.: 09/453,958

[22] Filed: Dec. 3, 1999

[51] Int. Cl.[7] ..... F42B 6/08

[52] U.S. Cl. ..... 473/583

[58] Field of Search ..... 473/582, 583, 473/584

[56] References Cited

U.S. PATENT DOCUMENTS 5,066,021 11/1991 DeLucia ..... 473/583
5,078,407 1/1992 Carlston et al. ..... 473/583
5,090,709 2/1992 Johnson ..... 473/584
5,820,498 10/1998 Maleski ..... 473/584
5,879,252 3/1999 Johnson ..... 473/583

*Primary Examiner*—John A. Ricci

[57] ABSTRACT

An arrowhead having a pivotal blade rotatably mounted to a corresponding arrowhead body such that the pivotal blade is selectively positionable at different cutting diameters when in corresponding different penetrating configurations so as to enable the arrowhead to have differing penetration and tissue volume cutting capacities. The hinge structure rotatably mounting the pivotal blade to its arrowhead body is positionable at a plurality of different spatial locations relative to the arrowhead body. The blade stop surface, such as a sloped blade abutting surface of a blade stop washer, that the pivotal blade abuts against when penetrating an object or when rotated to an open position is positionable at a plurality of different spatial locations and/or orientations relative to the arrowhead body.

80 Claims, 28 Drawing Sheets

900
664
662
660
200a
640
638
730
642
630
600
700
780
300
740
720
742
960
400
860
699a
970
629
694
900
360
672
350
674
676
670
800
850
630

366
380
360
300
364b
362b 364b
362b
366
364b
300
360
364a
362a
366
364a
360

370
310

372
308

374
302

376
304

306
378

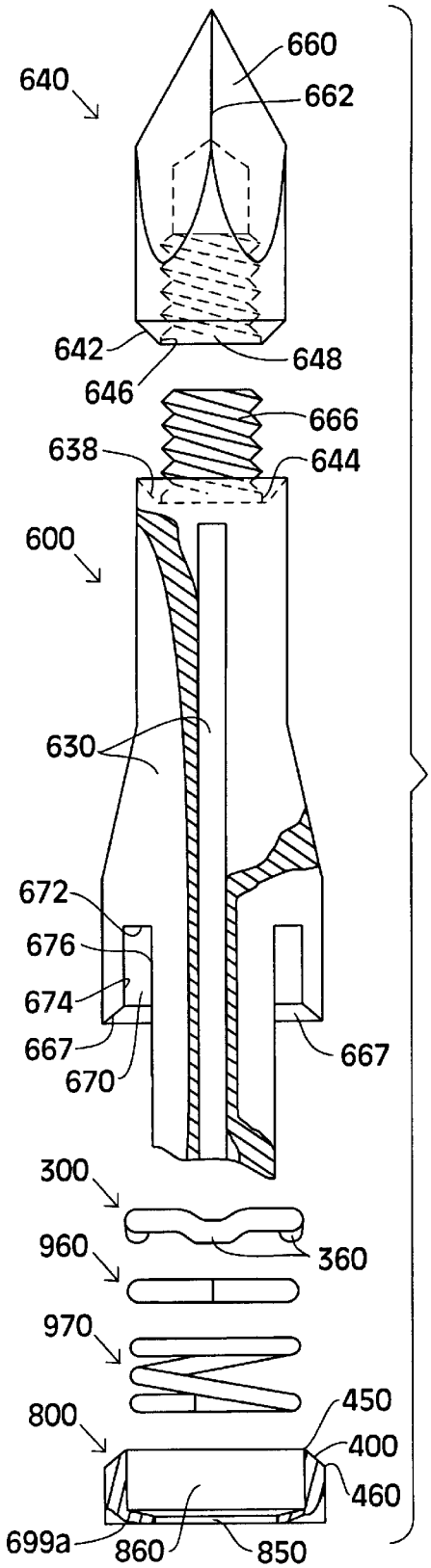
FIG. 13
FIG. 19
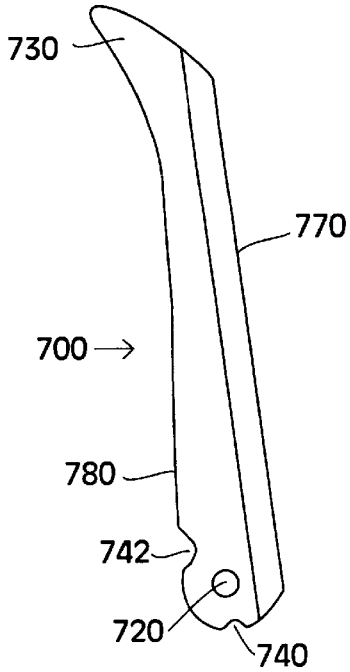
FIG. 20
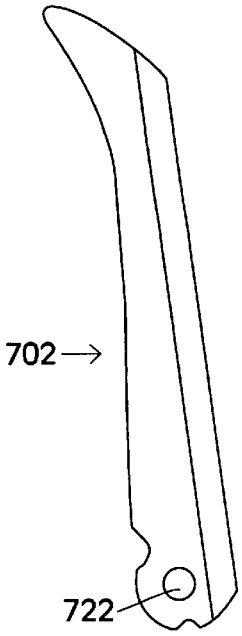
FIG. 16
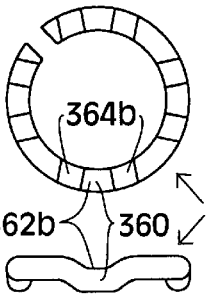
FIG. 17
FIG. 15
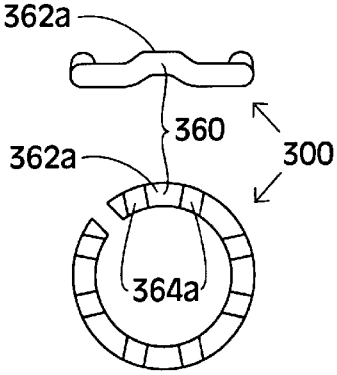
FIG. 14
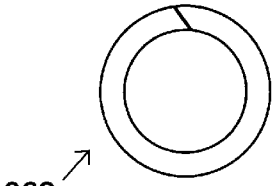
FIG. 18

FIG. 45
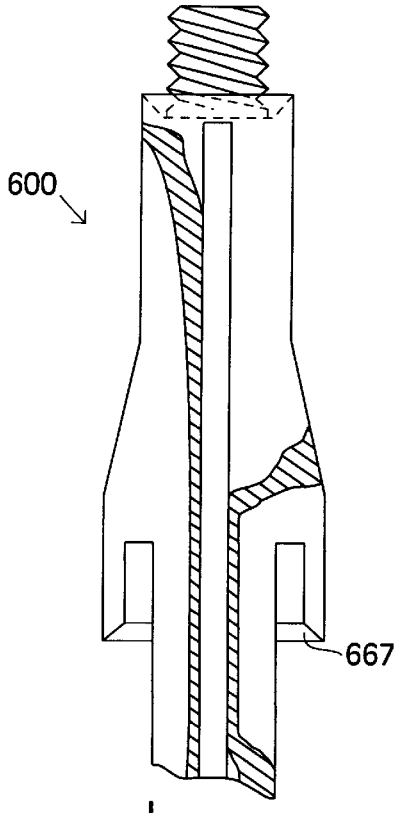
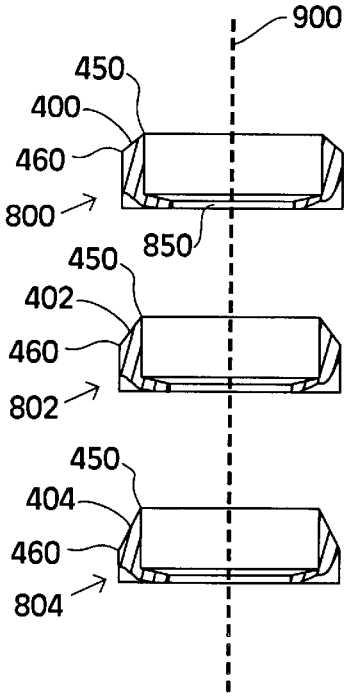
FIG. 46
FIG. 47
FIG. 48
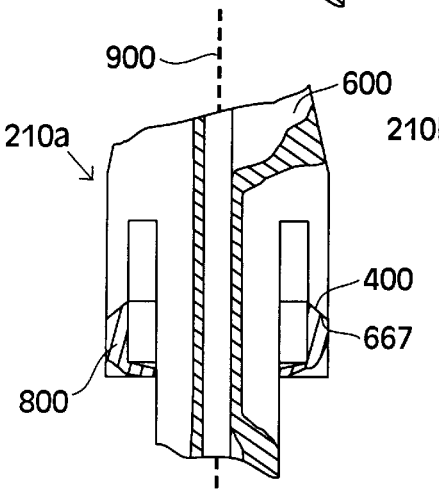
FIG. 49
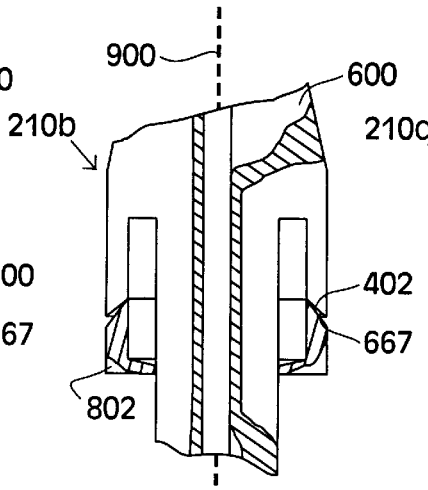
FIG. 50
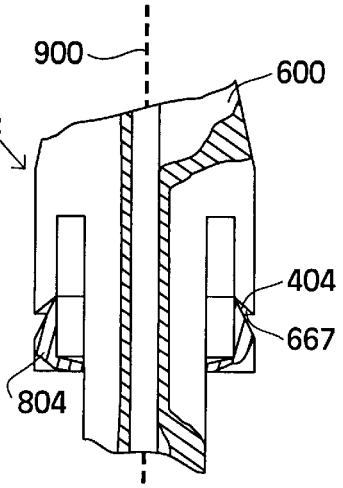
FIG. 51

500
374
302

500
374
380
302
500

502
374
302

502
302
502

374
302

374
302

502
900
604
672
500

302
374
744
671
770
214a
706
604
502
302
780
671

770
400
214b
706
604
672
302
671
770
214c
706

900
1004
1006
1008

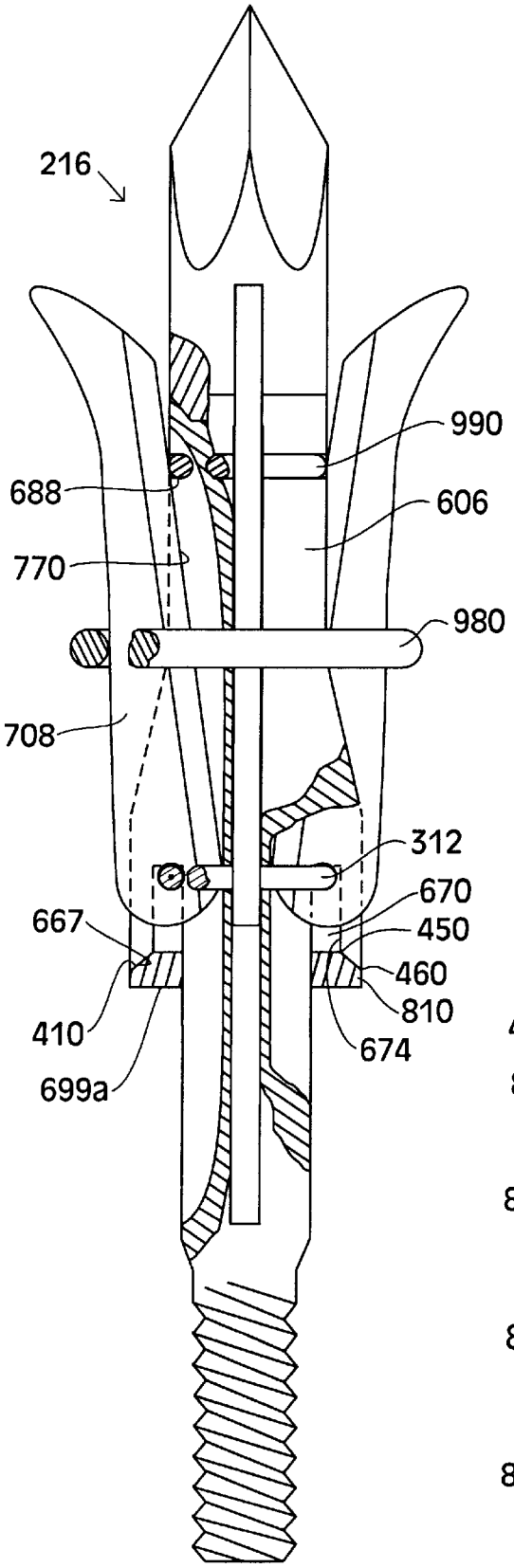
FIG. 75
FIG. 78
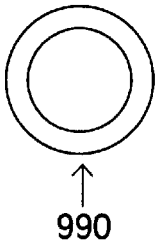
FIG. 77
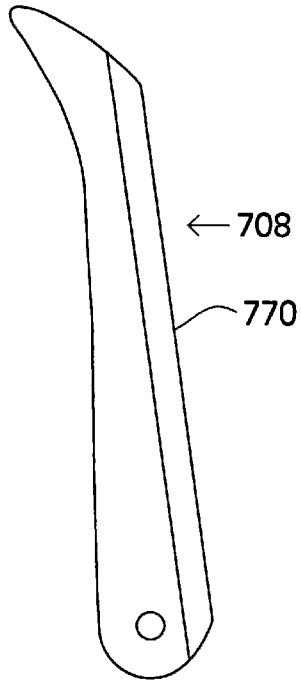
FIG. 76
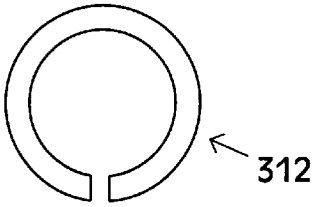
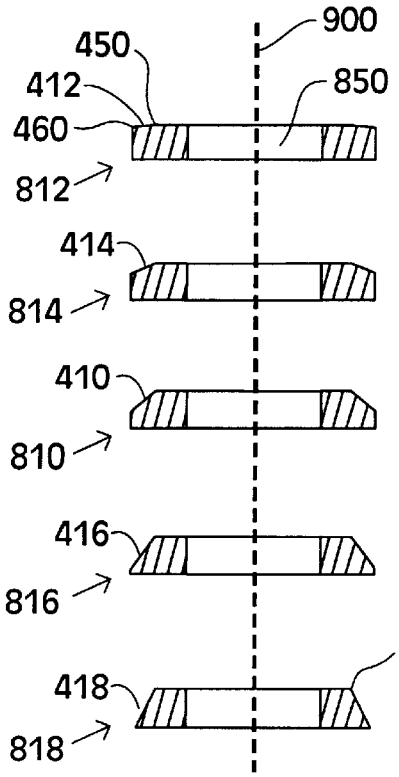
FIG. 79
FIG. 80
FIG. 81
FIG. 82
FIG. 83

FIG. 88
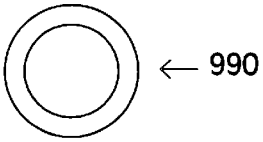
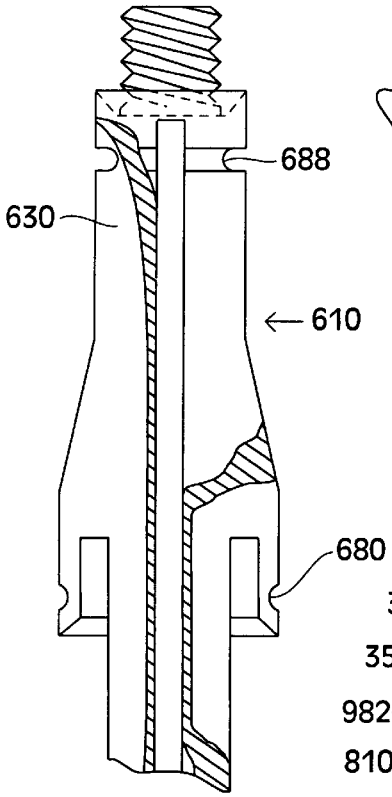
FIG. 87
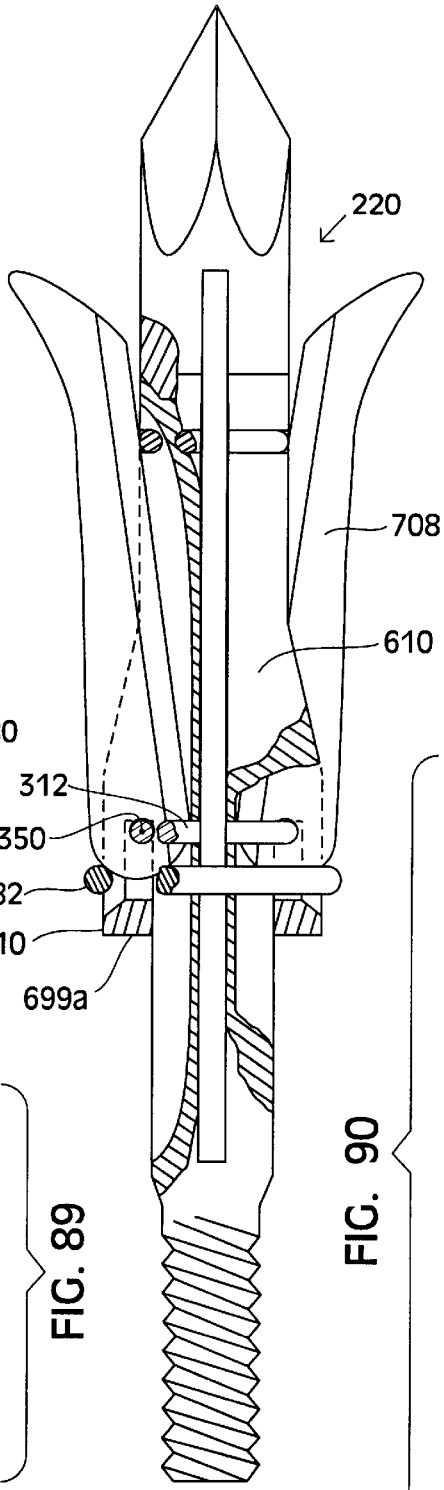
FIG. 86
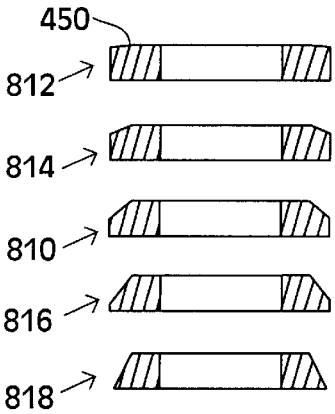
FIG. 89
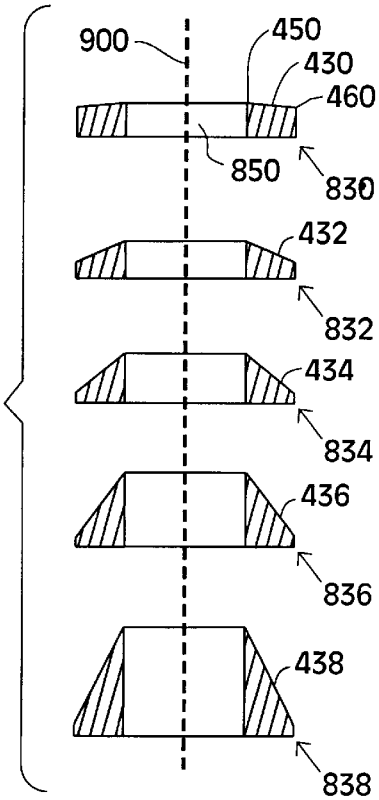
FIG. 90

708
770
720

612
632
690
680
632
222
632
612
350
690
320
720
982
699b
434
834
699a
320
322

450
812
814
810
816
818

450
830
832
834
836
838

226a
710
746
614
982
504
834

710
322

320

504
440
834
434

226b
710
614
320
504
504
834

FIG. 109
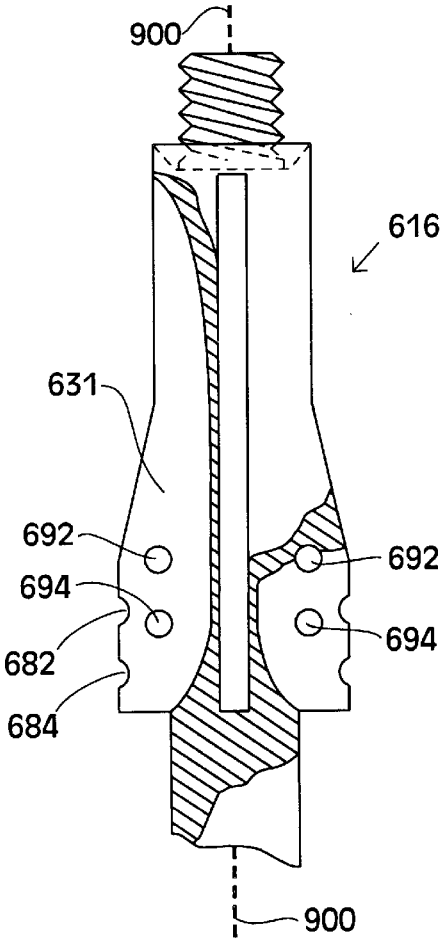
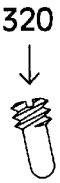
FIG. 111
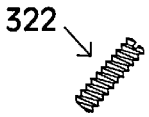
FIG. 112
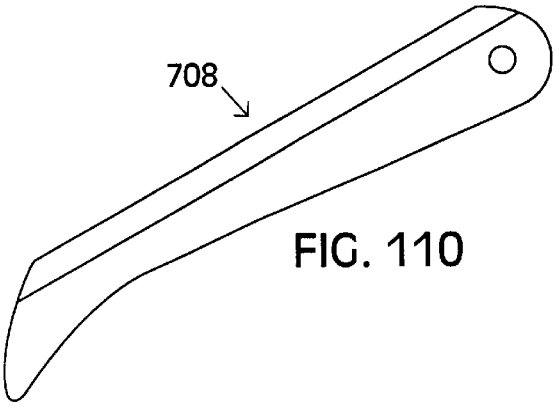
FIG. 110
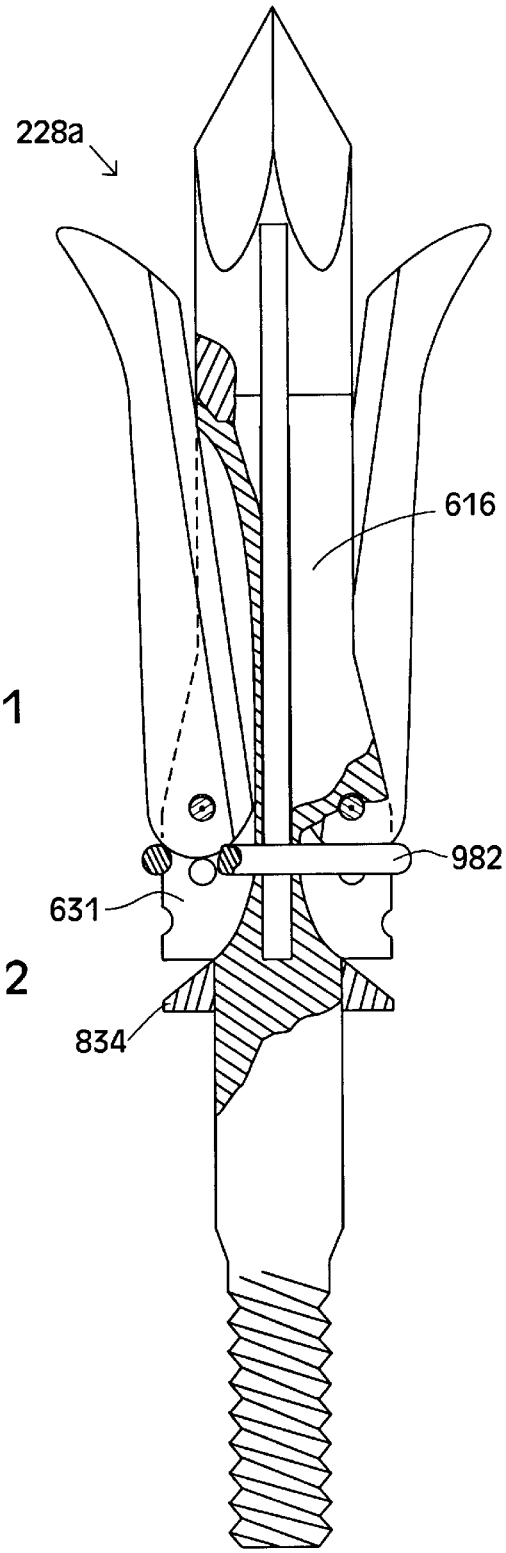
FIG. 108

504
812
814
810
816
818

631
900
228b 350
320
694
434
770
834
616
708
631
228a 350
320
692
770
460
834
616
708

830
832
834
836
838
1010
1012
900

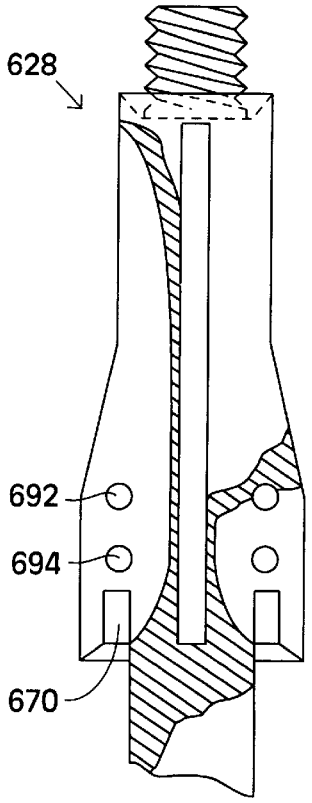
FIG. 138
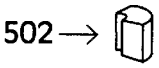
FIG. 144
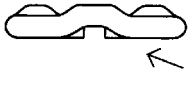
FIG. 142
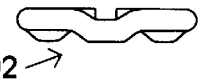
FIG. 143
302
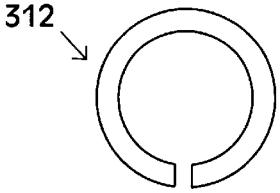
FIG. 141
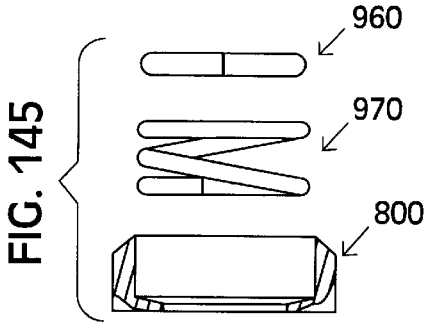
FIG. 145
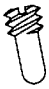
FIG. 139
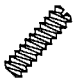
FIG. 140
FIG. 146
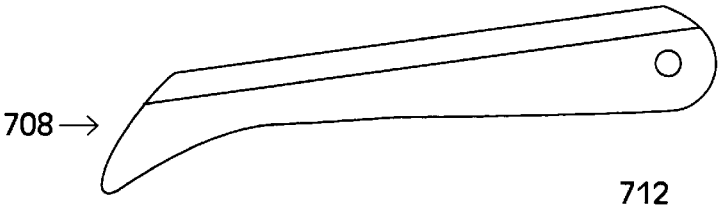
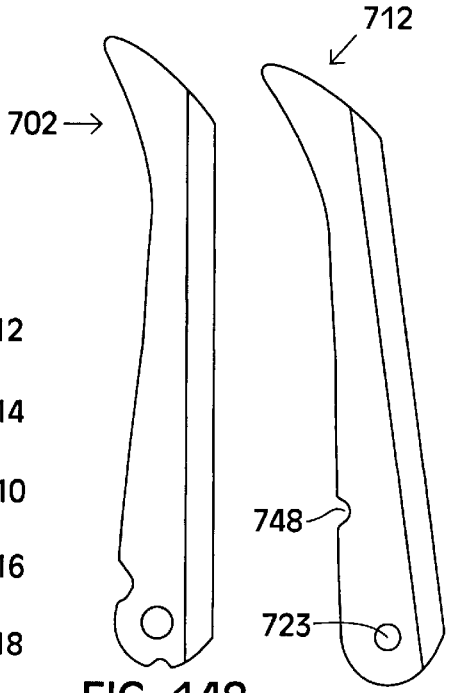
FIG. 148
FIG. 147
FIG. 150
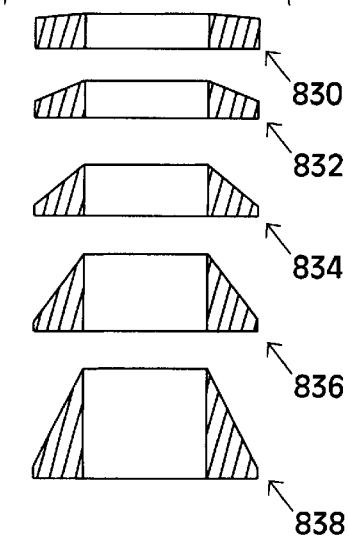
FIG. 149
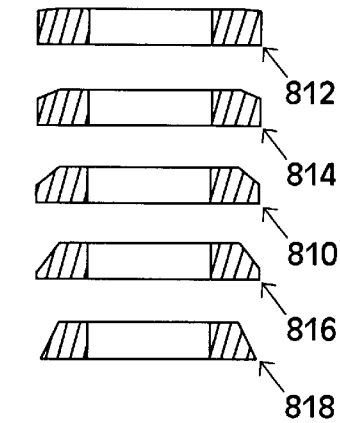

ARROWHEAD WITH A PIVOTAL BLADE SELECTIVELY POSITIONABLE IN A PLURALITY OF DIFFERENT CUTTING DIAMETERS

BACKGROUND—FIELD OF THE INVENTION

This invention relates generally to arrowheads, and more particularly to arrowheads having a pivotal blade selectively positionable in a plurality of different open penetrating configurations so as to be enabled to define a plurality of corresponding different cutting diameters thereof.

BACKGROUND—DESCRIPTION OF PRIOR ART

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight by causing it to rotate. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

Arrowheads used for hunting kill the game animal by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The cutting diameter of an arrowhead is determined by how far each cutting blade extends outward from the arrowhead body. The further the blades extend outward the larger the cutting diameter is, and therefore the more cutting potential the arrowhead has.

A common type of arrowhead used in hunting is the fixed-blade arrowhead, which has a pointed tip end used for penetrating, and generally triangular shaped fixed-blades or non-pivotal blades that each have a razor sharp edge for cutting. Conventional fixed-blade arrowheads blades are held in a fixed position on the arrowhead, and most such blades are replaceable. The replaceable blades attach to the arrowhead body in longitudinal grooves called blade slots. The tip of the arrowhead may be separably attachable to the arrowhead body or may be integral with it. Arrowheads for hunting are generally known as broadheads.

Another popular type of arrowhead for hunting is the blade-opening arrowhead. Blade-opening arrowheads are generally known as mechanical broadheads. Blade-opening arrowheads, like conventional fixed-blade arrowheads generally have an elongate arrowhead body, a tip end, and a threaded opposite end. The blades of blade-opening arrowheads have an attachment end which attaches the blades to the arrowhead body by a pivot pin, so that the blades can pivot or rotate between a closed position and an open position. Blade-opening arrowhead blades are generally an elongate substantially rectangular shape and also have a free non-attached end situated opposite the attachment end. The blades of blade-opening arrowheads are also received in blade slots, which are machined or formed into the side of the arrowhead body. The pivotal blades of blade-opening arrowheads are held in the closed position while in-flight until the arrowhead penetrates a game animal or target by various different methods including: conventional rubber O-rings, rubber bands, tight fitting plastic sleeves, tape, heat-shrinkable sleeves, and other wrap materials as well as by magnetism, various spring systems, friction detents and other frictional mechanisms. When the pivotal blades of blade-opening arrowheads are retracted or folded into the closed position, a substantial majority of each blade is generally housed within its corresponding blade slot. This feature gives blade-opening arrowheads the ability to attain significantly increased aerodynamic performance over fixed-blade arrowheads, due to the significantly decreased exposure the retracted blades have with the air when the arrow is rotating while in flight. Such increased aerodynamic performance results in the desirable features of: faster shooting arrows, flatter arrow trajectories, increased penetration energy and enhanced repeatability of accuracy, while also providing a wide diameter cut in the game animal when the razor sharp blades open at impact with the animal.

Blade-opening arrowheads come in a variety of different types and styles. The most common type of blade-opening arrowhead has blades that are pivotally connected to the arrowhead body at a location near the rear end of the arrowhead body. This makes it so that when the blades are folded into the retracted position a leading blade end of each blade positioned near the tip of the arrowhead protrudes outward from the arrowhead body. The leading blade ends of such blade-opening arrowheads rotate away from the arrowhead body in a rearward direction when penetrating an animal. Particularly, the leading blade ends catch on the animal's surface and serve to lever or rotate the blades into the fully open position, thus exposing the sharp cutting edges of the blades to a fully open cutting diameter position and cutting the animal. Another type of blade-opening arrowhead has pivotal blades that rotate in a forward direction to the fully open position when penetrating an animal. The blades of these forward blade rotating blade-opening arrowheads are rotated toward the open position by a variety of different mechanisms, but all also define a fully open cutting diameter when in the open position.

Yet another type of arrowhead used for hunting has pivotal blades that are exposed at a full cutting diameter position while the arrowhead is in-flight. Such arrowheads also generally achieve better aerodynamic performance than fixed-blade arrowheads because by design each pivotal blade only attaches to a corresponding arrowhead body at a single location so that with their substantially elongate shaped blades such arrowheads have significantly decreased blade surface area exposure with the air while in-flight.

The optimal size of cutting diameter desirable in an arrowhead can vary depending on the type of animal being hunted and on the strength of the archers bow. Generally, wider cutting diameter arrowheads generate more friction when penetrating a target than do narrower cutting diameter arrowheads, and therefore wider cutting diameter arrowheads penetrate proportionally less depth. It is desirable for an arrowhead to penetrate as deep in the game animal as possible so as to maximize the volume of animal tissue that is cut, as well as to create both an entry hole and an exit hole on both sides of the animal for blood to drain therefrom so as to leave a more followable or noticeable blood trail. Accordingly, archers shooting less powerful bows (all other factors being equal) would need to use a narrower cutting diameter arrowhead to obtain equal penetration depth as that which more powerful bows would achieve with a wider cutting diameter arrowhead. Small game animals such as wild turkeys do not present as tough of a target or as thick of a target for arrowheads to penetrate through as do big game animals-like elk or whitetail deer. Accordingly, archers shooting both big game animals and small game animals with the same cutting diameter arrowhead may have to use a stronger bow to obtain sufficient penetration when hunting big game animals. Alternatively, a narrower cutting diameter arrowhead would likely provide sufficient penetration in big game animals without requiring the archer to use a more powerful bow.

A major problem associated with conventional arrowheads such as blade-opening arrowheads and other pivotal blade arrowheads is that such arrowheads are only capable of producing one cutting diameter each when in a penetrating configuration or when in the open position. Such design prevents archers from being able to use a narrower cutting diameter or wider cutting diameter arrowhead for different appropriate hunting situations and/or bow set ups, without having to buy different arrowheads for each different cutting diameter desired.

It is apparent that there is a need for a pivotal blade arrowhead such as a blade-opening arrowhead that is capable of producing a variety of different cutting diameters so as to provide an arrowhead that has the flexibility of different penetration abilities, such as deeper penetrating narrower cutting diameters and increased tissue volume cutting wider cutting diameters, so as to better meet the needs of archers in the varying different hunting situations encountered in the field.

SUMMARY OF THE INVENTION

It is an object of the present invention to provide an arrowhead with a blade such that the arrowhead is capable of defining a plurality of different cutting diameters by the blade.

It is an object of the present invention to provide a pivotally bladed arrowhead such that the arrowhead is capable of defining a plurality of different cutting diameters by the pivotal blade wherein each different cutting diameter is defined when the pivotal blade is in a fully open position.

It is another object of the present invention to provide a blade-opening arrowhead having a pivotal blade that rotates in reward direction when rotating from a closed or retracted position toward an open penetrating position, that is capable of defining a plurality of different cutting diameters with the pivotal blade when the pivotal blade is in corresponding different fully open penetrating positions or penetrating configurations.

It is another object of the present invention to provide a blade-opening arrowhead having a pivotal blade that rotates in forward direction when rotating from a closed or retracted position toward an open penetrating position, that is capable of defining a plurality of different cutting diameters with the pivotal blade when the pivotal blade is in corresponding different fully open penetrating positions or penetrating configurations.

It is another object of the present invention to provide an arrowhead having a first pivotal blade and another three-dimensionally different shaped second pivotal blade such that both the first and second pivotal blades are capable of defining a plurality of different cutting diameters each when in fully open penetrating configurations and when attached to the same arrowhead body.

It is another object of the present invention to provide an arrowhead having a pivotal blade such that the pivotal blade is positionable at a first angle with respect to the central longitudinal axis of the arrowhead when the arrowhead is in a first penetrating configuration and at a second different angle with respect to the central longitudinal axis of the arrowhead when the arrowhead is in a second penetrating configuration.

It is still another object of the present invention to provide a plurality of different shaped blade-stop washers each having a different sloped blade abutting surface wherein each blade-stop washer is individually removably attachable to an arrowhead body having a pivotally mounted blade therewith, such that when each different sloped blade-stop washer is individually attached to the arrowhead body and the pivotal blade is in abutment thereagainst so as to be in a penetrating configuration the arrowhead defines correspondingly different cutting diameters.

It is still another object of the present invention to provide an arrowhead with a pivotal blade such that when in a first open position or first penetrating configuration the pivotal blade abuts against a first different sloped or first different shaped blade abutting surface, and when in a second open position or second penetrating configuration the pivotal blade abuts against a second different sloped or second different shaped blade abutting surface.

It is yet still another object of the present invention to provide an arrowhead with a pivotal blade such that when in an open position or first penetrating configuration the specific section of a blade abutting surface the pivotal abuts against is displaced a first distance from the cross-sectional center of the pivotal blade's hinge pin, and when the arrowhead is in an second different open position or second penetrating configuration the specific section of a blade abutting surface that the pivotal blade abuts against is displaced a second different distance from the cross-sectional center of the pivotal blade's hinge pin.

It is yet still another object of the present invention to provide an arrowhead with a pivotal blade that is pivotally hinged to an arrowhead body by an annular hinge pin, wherein the annular hinge pin has a bump configured thereon that protrudes at least in a forward direction when the annular hinge pin is mounted to the arrowhead body in a first spatial orientation and that protrudes at least in a reward direction when the annular hinge pin is mounted to the arrowhead body in a second different spatial orientation.

It is still another object of the present invention to provide an arrowhead with a pivotal blade that is pivotally hinged to an accompanying arrowhead body by a pivot pin such that the pivot pin and therefore the pivotal blade is capable of being positioned at a plurality of different spatial locations on the arrowhead body so as to enable the pivotal blade when correspondingly attached to the arrowhead body in the different locations thereof, to define a plurality of different cutting diameters when the blade is in correspondingly fully open or penetrating configurations.

It is still further another object of the present invention to provide a pivotally bladed arrowhead having a first pivot pin receiving through hole located a first distance from the forward leading end of the arrowhead and a second spaced apart pivot pin receiving through hole located a second different distance from the forward leading end of the arrowhead.

It is yet still further another object of the present invention to provide a pivotally bladed arrowhead having a first pivot pin receiving through hole located a first distance from the forward leading end of the arrowhead and a second spaced apart pivot pin receiving through hole located a second different distance from the forward leading end of the arrowhead, wherein both pivot pin through holes communicate with a single blade slot.

It is yet still further another object of the present invention to provide a pivotally bladed arrowhead having a first pivot pin receiving through hole located a first shortest distance from the central longitudinal axis of the arrowhead and a second spaced apart pivot pin receiving through hole located a second different shortest distance from the central longitudinal axis of the arrowhead.

It is even yet still further another object of the present invention to provide a pivotally bladed arrowhead having a first pivot pin receiving through hole located a first shortest distance from the central longitudinal axis of the arrowhead and a second spaced apart pivot pin receiving through hole located a second different shortest distance from the central longitudinal axis of the arrowhead, wherein both pivot pin through holes communicate with a single blade slot.

The foregoing objects and advantages and other objects and advantages of the present invention are accomplished as according to some of the preferred embodiments of this invention with arrowheads that attach to the forward end of an arrowshaft, where a plurality of same shaped blades are pivotally connected to an arrowhead body. Each three-dimensionally substantially same shaped blade is capable of defining more than one cutting diameter by being positioned in different spatial orientations relative to an accompanying arrowhead body when the arrowhead is in different corresponding penetrating configurations. The different penetrating configurations are generally determined when the blades are in corresponding fully open positions or such as they would be when the arrowhead is penetrating a target.

Such an arrowhead as according to some preferred embodiments of this invention is a blade-opening arrowhead having a plurality of same shaped blades pivotally hinged to an annular blade ring or an annular hinge pin that has a plurality of bumps formed thereon. The blade ring is slidably mounted within a recessed annular groove formed in the arrowhead body. Each blade seats on a corresponding bump when the blade ring and blades are attached to the arrowhead. When the blades are rotated to the open position such that the arrowhead is in a penetrating configuration each blade abuts against a blade abutting surface or against a blade-stop surface which positions the blade in a penetrating configuration so as to define a cutting diameter of the arrowhead. The blade ring is capable of being mounted to the arrowhead body within the annular groove in two different spatial orientations such that the bumps may all protrude in a forward direction (upward toward the forward leading end of the arrowhead) or such that the bumps may all protrude in a rearward direction (downward toward an accompanying arrowshaft). When the blade ring is mounted such to the arrowhead that the bumps protrude forwardly the arrowhead defines a different cutting diameter when in a penetrating configuration than the cutting diameter defined by the blades when the blade ring is mounted to the arrowhead such that the bumps protrude rearwardly and the arrowhead is also in a penetrating configuration. The different cutting diameters are produced in that the distance from the cross-sectional center of each hinge pin bump to the specific section of the blade abutting surface that the blade is in direct abutment with is different, when the bumps protrude forwardly versus when the bumps protrude rearwardly, and thus the blades are disposed at different angles relative to the central longitudinal axis of the arrowhead when in the respective two different penetrating configurations or two different cutting diameters of the arrowhead.

Another arrowhead preferred embodiment as according to this invention is similar to the above described arrowhead preferred embodiment except that it utilizes both a first pivotal blade and a second different three-dimensionally shaped pivotal blade. The first pivotal blade is capable of defining a plurality of at least two different cutting diameters when in corresponding penetrating configurations and the second pivotal blade is capable of defining a plurality of at least two different cutting diameters when in corresponding penetrating configurations that are different from the cutting diameters defined by the first blade.

Other arrowhead preferred embodiments as according to this invention differ from the above described preferred embodiments in that they have removably attachable tip blades mounted in corresponding arrowhead tips. The razor sharp tip blades enhance target penetration by cutting target material ahead of the pivotal blades or arrowhead main cutting blades.

Other arrowhead preferred embodiments as according to this invention utilize a first annular blade ring with a plurality of bumps formed thereon that protrude inwardly toward the central longitudinal axis of the arrowhead when defining at least a first different cutting diameter, and utilize a second annular blade ring with a plurality of bumps formed thereon that protrude outwardly away from the central longitudinal axis of the arrowhead when defining at least a second different cutting diameter. The different cutting diameters are produced in that the distance from the cross-sectional center of each hinge pin bump to the blade abutting surface is different when the bumps protrude inward versus when the bumps protrude outward and thus the same shaped blades are disposed at different angles relative to the central longitudinal axis of the arrowhead when in the respective two different penetrating configurations or two different cutting diameters of the arrowhead.

Yet other arrowhead preferred embodiments as according to this invention utilizing annular hinge pins such as a blade ring have a plurality of bumps formed thereon where each bump protrudes not only in a forward or rearward direction but also in either an inward or outward direction, so as to be enabled to define yet a variety of other cutting diameters with the same blade or a plurality of same shaped blades.

Some arrowhead preferred embodiments as according to this invention utilizing annular hinge pins such as a blade ring have corresponding blade rings and annular recessed grooves or equivalents configured such that the blade rings are compressed to a narrower diameter when mounted to corresponding arrowheads, whereas other arrowhead preferred embodiments as according to this invention utilizing annular hinge pins such as a blade ring have corresponding blade rings and annular recessed grooves or equivalents configured such that the blade rings are expanded to a wider diameter when mounted to corresponding arrowheads.

Some arrowhead preferred embodiments as according to this invention utilizing annular hinge pins such as a blade ring have corresponding blade rings and annular recessed grooves or equivalents configured such that the blade rings are neither substantially compressed nor expanded when mounted to corresponding arrowheads.

Some arrowhead preferred embodiments as according to this invention utilizing annular hinge pins such as a blade ring have substantially bumpless blade rings or blade rings having a substantially constant sloped exterior surface like a circular ring made of round metal wire.

Other arrowhead preferred embodiments as according to this invention are similar to the above described embodiments except such arrowheads utilize filler elements to displace corresponding blade rings at different distances from the forward leading end of corresponding arrowheads or for changing the spatial orientation of a blade ring relative to an accompanying arrowhead or arrowhead body. Each filler element is seated in a corresponding recessed annular groove or equivalent in front of a corresponding blade ring so as to displace the blade ring a distance rearward of the internal forward shelf of the annular groove. Contrastingly, when the filler elements are not used the blade ring will seat against the groove shelf and thus the blade ring will be displaced yet another different distance away from a reference point such as the forward leading end of the arrowhead or the blade abutting surface, and will enable the arrowhead to define a different cutting diameter with the same blade than that which is defined when using a particular size of filler element(s). As according to one such embodiment an arrowhead utilizes three pivotal blades and three same shaped filler elements such that each filler element is situated between two adjacent blades so as to allow ample space for the blades to freely rotate between the closed and open positions. Other such preferred embodiments utilize a plurality of different length or different shaped sets of filler elements so as to displace the hinge ring to yet different spatial orientations relative to the arrowhead, and accordingly to enable a single blade or a plurality of same shaped blades to define yet other cutting diameters, such as a plurality of at least three different cutting diameters.

Yet still other arrowhead preferred embodiments as according to this invention utilize substantially straight hinge pins such as set screws, like fully threaded set screws and/or partially threaded set screws to hingedly connect the pivotal cutting blades to corresponding arrowhead bodies. Such arrowhead preferred embodiments each have a hinge pin through hole formed in accompanying arrowhead bodies to receive corresponding straight hinge pins. Some such hinge pins receive only one blade whereas other such hinge pins receive more than one blade. According to some such preferred embodiments at least one hinge pin through hole is located closer to the forward leading end of an accompanying arrowhead than at least one other hinge pin through hole of the same arrowhead. According to other such preferred embodiments at least one hinge pin through hole is located closer to the central longitudinal axis of an accompanying arrowhead than at least one other hinge pin through hole of the same arrowhead. According to yet other such preferred embodiments at least one hinge pin through hole is located both a different distance from the central longitudinal axis and from the forward leading end (or an equivalent reference point) of an accompanying arrowhead than is at least one other hinge pin through hole of the same arrowhead. Some such arrowhead preferred embodiments have a hinge pin through hole configured such upon corresponding arrowhead bodies that each hinge pin through hole intersects with the central longitudinal axis of the arrowhead, whereas other such arrowhead preferred embodiments as according to this invention do not. Some such arrowhead preferred embodiments have a plurality of hinge pin through holes extending through or communicating with at least a single blade slot.

Yet still further other arrowhead preferred embodiments as according to this invention are configured such that when in a first open position or a first penetrating configuration so as to be defining a first cutting diameter a pivotal blade abuts against a first sloped blade abutting surface, and when in a second open position or second penetrating configuration so as to be defining a second different cutting diameter the same pivotal blade (or another same shaped pivotal blade) abuts against a second different sloped or different shaped blade abutting surface, thus defining a plurality of different cutting diameters so as to be an improvement over the prior art. Some such preferred embodiments utilize a plurality of different shaped removably attachable blade-stop washers that each have a different sloped blade abutting surface.

The arrowheads as according to the desired results and scope of this invention are more lethal than prior art conventional arrowheads in that they provide the ability to produce more than one cutting diameter with the use of a single blade, or with a plurality of same shaped blades. Such cutting diameter flexibility provides a single arrowhead that is capable of obtaining deeper penetration with narrower cutting diameters as well as increased tissue volume cutting with wider cutting diameters, so as to better meet the needs of archers in the varying different hunting situations encountered in the field such that both penetration and lethality are maximized as the conditions encountered merit.

As has been shown in the above discussion, the arrowheads according to this invention overcome deficiencies inherent in prior art arrowheads.

With the above objects and advantages in view, other objects and advantages of the invention will more readily appear as the nature of the invention is better understood, the invention is comprised in the novel construction, combination and assembly of parts hereinafter more fully described, illustrated, and claimed.

BRIEF DESCRIPTION OF THE DRAWINGS

FIG. 13 is an exploded partial length partial sectioned side view of the arrowhead of FIG. 1;

FIG. 14 is a bottom view of the blade ring as illustrated in FIG. 4;

FIG. 15 is a side view of the blade ring as illustrated in FIG. 14;

FIG. 16 is a top view of the blade ring as illustrated in FIG. 4;

FIG. 17 is a side view of the blade ring as illustrated in FIG. 16;

FIG. 18 is a top view of the notch ring as illustrated in FIGS. 1 & 13;

FIG. 19 is a side view of a pivotal blade of the arrowhead illustrated in FIGS. 1 & 13;

FIG. 20 is a side view of another pivotal blade as according to this invention;

FIG. 45 is a partial length partial sectioned side view of an arrowhead body of this invention;

FIGS. 46–48 are partial sectioned side views of blade-stops washers of this invention;

FIGS. 49–51 illustrate the blade-stop washers of FIGS. 46–48 individually removably attached to the arrowhead body of FIG. 45;

FIG. 75 is a partial sectioned side view of another arrowhead as according to this invention;

FIG. 76 is a top view of a blade ring as according to this invention;

FIG. 77 is a side view of another pivotal blade as according to this invention;

FIG. 78 is a top view of a spacer element as according to this invention;

FIGS. 79–83 are partial sectioned side views of blade-stops washers of this invention;

FIG. 86 is a partial sectioned side view of another arrowhead as according to this invention;

FIG. 87 is a partial length partial sectioned side view of an arrowhead body of this invention;

FIG. 88 is a top view of a spacer element as according to this invention;

FIG. 89 depicts cross-sectioned side views of blade-stops washers of this invention of FIGS. 79–83;

FIG. 90 depicts cross-sectioned side views of blade-stops washers of this invention;

FIG. 99 depicts cross-sectioned side views of blade-stops washers of this invention of FIG. 90;

FIG. 100 depicts cross-sectioned side views of blade-stops washers of this invention of FIGS. 79–83;

FIG. 108 is a partial sectioned side view of another arrowhead as according to this invention;

FIG. 109 is a partial length partial sectioned side view of an arrowhead body of this invention;

FIG. 110 is a side view of the pivotal blade of FIG. 77;

FIG. 111 is a side view of a partially threaded set screw of this invention;

FIG. 112 is a side view of a fully threaded set screw of this invention;

FIG. 137 is a side view of a slot-washer of this invention;

FIG. 138 is a partial length partial sectioned side view of an arrowhead body of this invention;

FIG. 139 is a side view of a partially threaded set screw of this invention;

FIG. 140 is a side view of a fully threaded set screw of this invention;

FIG. 141 is a top view of a blade ring as according to this invention;

FIGS. 142 & 143 are side views of the blade ring of FIGS. 4 & 5;

FIG. 144 is a perspective view of the filler element as of FIG. 71;

FIG. 145 is a side view of the notch ring, annular spring and blade-stop washer of the arrowhead as illustrated in FIG. 1;

FIG. 146 is a side view of the pivotal blade of FIGS. 77, 93 & 110;

FIG. 147 is a side view of another pivotal blade as according to this invention;

FIG. 148 is a side view of the pivotal blade of FIGS. 20 & 38;

FIG. 149 shows cross-sectioned side views of blade-stops washers of this invention as of FIGS. 79–83; and FIG. 150 depicts cross-sectioned side views of blade-stops washers of this invention as of FIG. 90.

DETAILED DESCRIPTION OF THE PREFERRED EMBODIMENTS

Figures 1, 2, 3, 4, 5, 6, 7, 8, 9, 10, 11, 12:
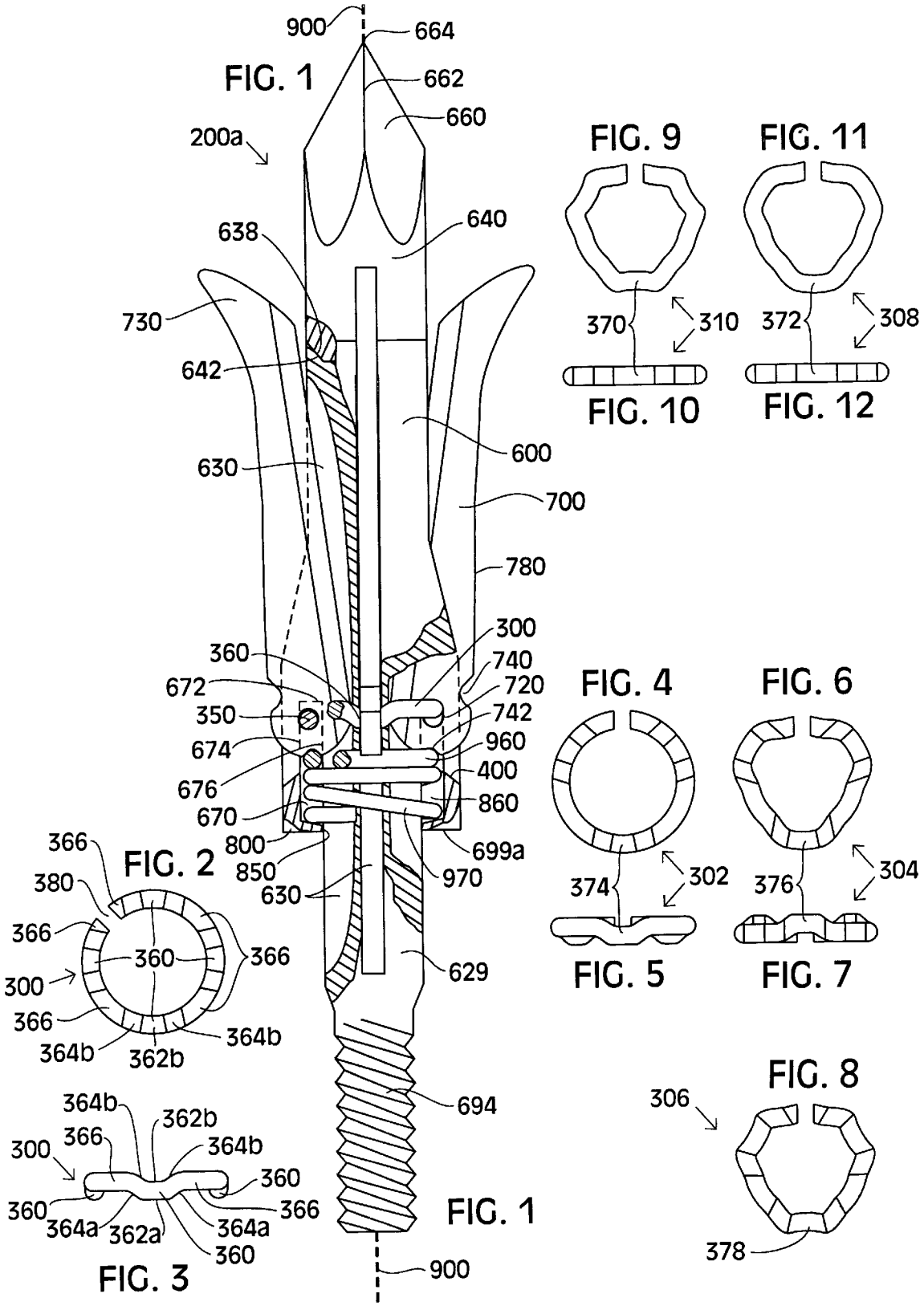
FIG. 1 is a partial sectioned side view of an arrowhead as according to this invention.
FIG. 2 is a top view of an annular blade ring as according to this invention.
FIG. 3 is a side view of the blade ring as illustrated in FIG. 2.
FIG. 4 is a top view of an annular blade ring as according to this invention.
FIG. 5 is a side view of the blade ring as illustrated in FIG. 4.
FIG. 6 is a top view of an annular blade ring as according to this invention.
FIG. 7 is a side view of the blade ring as illustrated in FIG. 6
FIG. 8 is a top view of another blade ring as according to this invention.
FIG. 9 is a top view of an annular blade ring as according to this invention.
FIG. 10 is a side view of the blade ring as illustrated in FIG. 9.
FIG. 11 is a top view of an annular blade ring as according to this invention.
FIG. 12 is a side view of the blade ring as illustrated in FIG. 11.

The term cutting diameter refers generally to the diameter of "hole" an arrowhead cuts in an object or target, such as a game animal when in a penetrating configuration. A cutting diameter is therefore twice the radial distance from the central longitudinal axis of a corresponding arrowhead to the furthest section of an arrowhead blade's cutting edge away from the central longitudinal axis of the corresponding arrowhead when in a penetrating configuration. A penetrating configuration is generally such as what an arrowhead would be in when penetrating a target like a game animal. For blade-opening arrowheads a penetrating configuration would generally refer to when the pivotal blades are rotated to a fully open position or are in a fully open position.

Cutting diameter selection means as according to this invention enables a blade to define more than one cutting diameter when attached to an arrowhead body and when in corresponding penetrating configurations. Particularly, a single blade such as a pivotal blade is enabled to be attached or positioned relative to a corresponding arrowhead body at a first spatial orientation when the arrowhead is in a first penetrating configuration such that the furthest section of the blade cutting edge away from the arrowhead central longitudinal axis is disposed at a first shortest distance therefrom so as to define a first cutting diameter, and the same blade is also enabled to be attached or positioned relative to the same arrowhead body in at least one other substantially different second spatial orientation when the arrowhead is in a second different penetrating configuration such that the furthest section of the blade cutting edge away from the arrowhead central longitudinal axis is disposed at a second different shortest distance therefrom so as to thereby define a different cutting diameter.

Cutting diameter selection means as according to this invention also has the intended meaning that an arrowhead is capable of defining more than one different cutting diameter with the same blade (or with a different substantially same shaped blade) when in accordingly different open and/or penetrating configurations; the cutting diameters being determined when the blade or a plurality of same shaped blades is in such corresponding positions.

According to some of the preferred embodiments of this invention a plurality of same shaped blades all define a plurality of different cutting diameters of an arrowhead. According to some such preferred embodiments each blade defines substantially the same cutting diameter as each other blade when the arrowhead is in at least one possible penetrating configuration the arrowhead could be configured in or arranged in. According to other preferred embodiments at least one blade defines a different cutting diameter at the same time that another same shaped blade is defining a different cutting diameter when the arrowhead is in a penetrating configuration.

Hinge means as according to this invention provide the function of pivotally connecting a pivotal blade or blades to an arrowhead body so that the pivotal blade(s) is/are enabled to rotate relative to the arrowhead body or arrowhead. Hinge means may comprise any structure such as a pivot pin or shaft, a set screw or an annular ring or the like, a ball bearing type member or a formed hump/protrusion in an accompanying arrowhead body, or the like which enables a blade to be attached to an arrowhead body so as to rotate or pivot relative thereto.

Hinge means for the blade-opening arrowheads as according to this invention allow corresponding pivotal blades to selectively rotate or pivot between a closed in-flight position and an open or penetrating configuration or position. It is apparent that when in a closed or in-flight position an arrowhead as according to this invention may or may not have a cutting edge section of a pivotal blade exposed from its corresponding arrowhead body. Hinge means for non blade-opening pivotal blade arrowheads as according to this invention allow corresponding pivotal blades to selectively rotate or pivot at least between a penetrating in-flight position and a non-barbing position. A non-barbing position is generally one in which a pivotal blade has been folded-up at least in apart adjacent to its corresponding arrowhead body such that the arrowhead will not barb when retracted from a target.

Cutting diameter selection means as according to this invention may be comprised of hinge means relocation means for enabling the hinge means to be positioned at more than one different spatial location relative to the arrowhead or arrowhead body. Different spatial locations relative to an arrowhead or an arrowhead body as with reference to the hinge means relocation means of this invention generally refer to the hinge means, or at least a section thereof, being positioned at differing shortest distances from a like reference point; such as differing shortest distances or differing perpendicular distances from the central longitudinal axis of the arrowhead body or arrowhead, and/or differing shortest distances from the forward leading end of the arrowhead. Such relocating of the hinge means enables a single pivotal blade to define a plurality of different cutting diameters when the corresponding hinge means is positioned at corresponding different locations upon the arrowhead or in different spatial orientations relative thereto, and the arrowhead with the attached blade is in corresponding penetrating configurations or open positions, as is according to this invention.

Cutting diameter selection means as according to this invention may be comprised of blade abutting surface change means for changing the spatial orientation of a blade abutting surface relative to a corresponding arrowhead or arrowhead body. Such changing of the spatial orientation or occupancy of space of the blade abutting surface(s) will enable a pivotal blade, when hingedly attached to an accompanying arrowhead body at a single spatial location, to define at least a first cutting diameter when abutting against a first spatially oriented blade abutting surface, and a second different cutting diameter when abutting against a second different spatially oriented blade abutting surface. Blade abutting surface change means for example may comprise positioning the same blade abutting surface (such as a blade-stop washer) relative to the arrowhead at differing spatial locations thereon or at different distances from a reference point. Blade abutting surface change means may also comprise individually positioning different shaped structural entities such as blade-stop washers with different sloped blade abutting surfaces on a corresponding arrowhead body or arrowhead at the same spatial locations and/or different spatial locations thereof.

It is apparent that the hinge means relocation means and the blade abutting surface change means as according to this invention may be used in various combinations together so as to enable a pivotal blade to define a variety of different cutting diameters when hingedly attached to a single arrowhead body.

Figure 21:
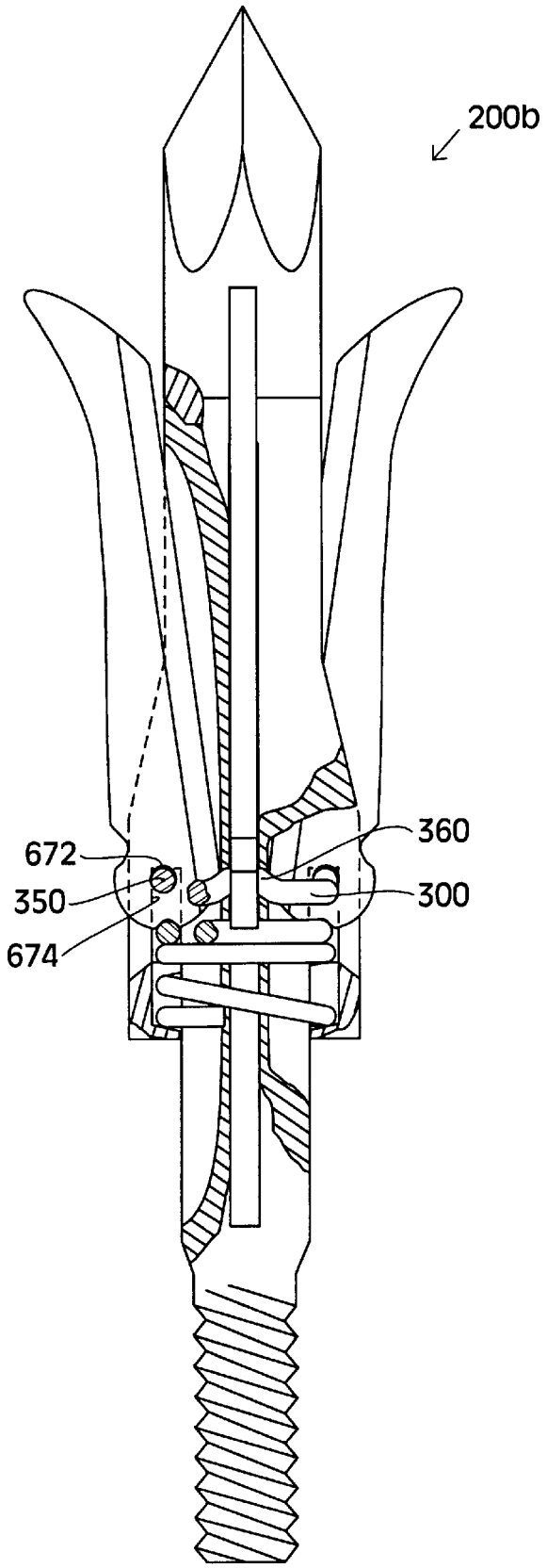
FIG. 21 is a partial sectioned side view of another arrowhead as according to this invention.
Figure 22:
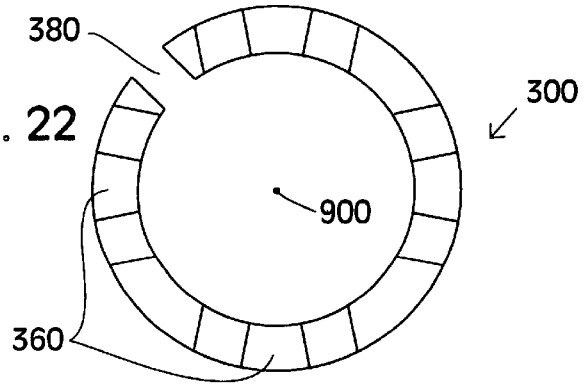
FIG. 22 is an enlarged top view of the blade ring as illustrated in FIG. 4.
Figure 23:
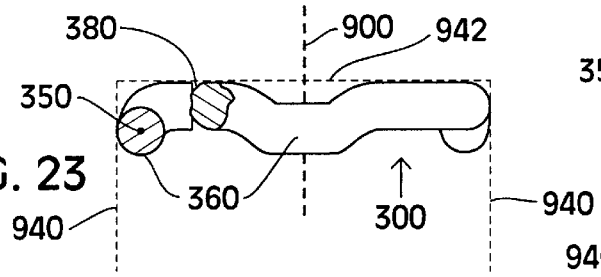
FIG. 23 is an enlarged partial sectioned side view of the blade ring as illustrated in FIG. 4.

FIGS. 1–34 illustrate examples of cutting diameter selection means and hinge means relocation means as according to this invention. A blade-opening arrowhead 200*a* as illustrated in FIG. 1 has an annular blade ring 300 which has a plurality of four axially protruding bumps 360 formed thereon and a gap 380 for removably receiving a plurality of four pivotal blades 700. Each bump 360 protrudes in the same generally axial direction as all of the other bumps 360 as is illustrated in FIGS. 2 & 3. Each bump 360 is generally distinguished or defined by a change in slope of the exterior surface of blade ring 300. As specifically illustrated in FIG. 1 blade ring 300 is mounted to an arrowhead body 600 of arrowhead 200*a* such that bumps 360 of blade ring 300 protrude downward or toward the rear end of the arrowhead. Contrastingly, as illustrated in FIG. 21 blade ring 300 is mounted to arrowhead body 600 of a blade-opening arrowhead 200*b* such that bumps 360 of blade ring 300 protrude upward or toward the forward end of the arrowhead. Blade-opening arrowheads 200*a* and 200*b* as illustrated in FIGS. 1 & 21 respectively are configured as they would be when attached to an arrowshaft (not illustrated) and in the closed or retracted in-flight position.

Although arrowheads 200*a* & 200*b* are referenced herein by different reference numerals it is to be noted that in general arrowheads 200*a* & 200*b* are substantially the same arrowhead (but not limited thereto) other than the inversion of blade ring 300 so that bumps 360 protrude in opposing axial directions, wherein specifically the different reference numerals 200*a* & 200*b* in general denote different penetration producing configurations of the same arrowhead (but not limited thereto) which produce different cutting diameters thereof as taught herebelow. Likewise other arrowheads throughout this specification differing in reference numerals only by alphabetic sub-reference letters (a,b,c . . . etc.) in general (but not limited thereto) denote different penetration producing configurations which produce different cutting diameters thereof as is according to at least some of the embodiments and at least some of the desired results of this invention.

Referring again to FIG. 1, arrowhead 200*a* has a forward leading end 664, a central longitudinal axis 900, an arrowhead tip 640, a notch ring 960, an annular compression spring 970 and a blade-stop washer 800. Blade-stop washer 800 has a blade abutting surface 400, an internal recess 860, an arrowshaft abutting surface 699*a* and a stem receiving hole 850 for receiving a stem 629 of arrowhead body 600. Arrowhead tip 640 has a plurality of three (but not limited thereto) facets 660 and a plurality of corresponding facet boundaries 662. It is apparent that facet boundaries 662 may comprise a sharp cutting edge such as for example as is taught in my U.S. patent application Ser. No. 09/082,636 filed May 21, 1998 which is incorporated herein by specific reference. It is also apparent that facets 660 may be configured in varying different shapes. Arrowhead tip 640 has a beveled locking flank 642 which abuts against a beveled locking flank 638 of arrowhead body 600 when arrowhead tip 640 is attached thereto.

As is clearly illustrated in FIG. 13 recessed annular groove 670 of arrowhead body 600 has an annular shelf 672 an inner wall 676, an outer wall 674 and a beveled annular skirt 667. Beveled skirt 667 fits flush with blade abutting surface 400 of blade-stop washer 800 when arrowhead 200*a*/200*b* is assembled and attached to an arrowshaft (not illustrated). Annular recess 670 therefore has differing widths throughout its axial or elongate length, as is particularly noted in the perpendicular distance between inner wall 676 and beveled skirt 667, when contrasted with the perpendicular distance between inner wall 676 and outer wall 674 (the perpendicular distances being referenced in planes perpendicular to central longitudinal axis 900 respectively). Blade abutting surface 400 of blade-stop washer 800 has a forward terminus 450 and a rearward terminus 460. Each blade slot 630 is fabricated such so as to communicate with blade abutting surface 400 when blade-stop washer 800 is attached to arrowhead body 600. FIG. 13 yet illustrates a threaded forward stud 666 of arrowhead body 600 that matably threads into a threaded female cavity 648 of arrowhead tip 640. Stud 666 has a non-threaded rear section 644 that communicates directly with the main portion of arrowhead body 600 situated therebelow and with beveled locking flank 638. Arrowhead tip 640 has a corresponding internal non-threaded rear section 646 that is seated adjacent non-threaded section 644 of arrowhead body 600 when tip 640 is attached to arrowhead body 600.

FIGS. 2 & 3, and FIGS. 14–17 illustrate blade ring 300 in detail. Side views and top views of blade ring 300 are depicted in FIGS. 2 & 3 and FIGS. 16 & 17 respectively, whereas FIGS. 14 & 15 depict a side view and a bottom view thereof. As illustrated in FIG. 3 each bump 360 has a lower apex 362*a* and an upper apex 362*b*, a pair of lower inclined slants 364*a*–364*a* and a pair of upper inclined slants 364*b*–364*b*. A plurality of substantially horizontal sections 366 are dispersed between adjacent bumps 360 substantially circumferentially about blade ring 300. Horizontal sections 366 are generally (but not limited to) the remnants of a substantially planar/flat or non-bumped circular blade ring, such as a typical single coil blade ring without the bumps or equivalents would appear as is according to some of the preferred embodiments of this invention taught forthcoming herein. It is apparent that the gaps of the blade rings as according to this invention such as gap 380 of blade ring 300 for example, may be compressed to a narrower gap or to substantially no gap when the corresponding blade ring is attached to an arrowhead. Each slant 364*a* & 364*b* represents a departure or change in the slope of the blade ring exterior surface from the slope of the blade ring exterior surface of horizontal sections 366 (as for example as is at least determined with reference from a two-dimensional side view [but not limited to]—such as depicted substantially in FIG. 3). Each apex 362*a* & 362*b* represents a change in slope of corresponding opposing slants 364*a* & 364*b* on either side of a corresponding bump 360. As illustrated in FIG. 3 when bumps 360 protrude axially rearward, both slants 364*a* & 364*b* on the left side of corresponding apexes have a negative slope, whereas both slants 364*a* & 364*b* on the right side of corresponding apexes have a positive slope and apexes 362*a* & 362*b* have substantially zero slope.

It is apparent that the slope of a blade ring or the slope of a section of a blade ring as according to this invention may be determined in various different manners and two-dimensional and/or three-dimensional views or orientations, so as to distinguish a blade ring bump or equivalent thereof that substantially deviates from the slope of a substantially planar or non-bumped annular ring or equivalent.

Although apexes 362*a* & 362*b* of blade ring 300 are depicted as being substantially horizontal (in relation to the axial or vertical direction that bumps 360 protrude as illustrated for example in FIG. 3) and each having a width that is larger than the thickness of a corresponding pivotal blade such as a blade 700 so that a blade 700 can effortlessly be seated thereon with ample room as is illustrated for example in FIGS. 1 & 21, it is apparent that the bump apexes and equivalents and the bumps of blade rings as according to this invention may have a variety of differing shapes or configurations while enabling corresponding arrowheads to achieve the desired results of this invention. For example, a blade ring as according to this invention could have a substantially sharp or pointed triangulated apex section or sections.

As specifically illustrated in FIG. 19 each blade 700 has a wing 730, an aperture 720, a cutting edge 770, an abutting edge 780 (which is a section of the blade edge extending peripherally about blade 700), a first notch 740 and a second notch 742. Spring 970 produces a bias force or an urging force as taught in my U.S. patent application Ser. No. 08/834,478 filed Apr. 11, 1997 which is incorporated herein by specific reference, such that notch ring 960 is urged into engagement with first notches 740 of blades 700 so that blades 700 are selectively retained or held in the closed position or in-flight configuration when the arrowhead is attached to an accompanying arrowshaft. Arrowhead body 600 has a threaded rear stud 694 as illustrated in FIG. 1 for removable attachment to an arrowshaft. Arrowhead body 600 has a plurality of four blade slots 630 for housing blades 700 at least in part therein. During arrowhead assembly each blade 700 is attached to blade ring 300 so as to be seated on a bump 360 whereupon blade ring 300 and attached blades 700 are respectively slid forwardly within corresponding slots 630 and within annular recess 670 such that a section of blade ring 300 seats substantially against annular shelf 672 of arrowhead body 600 as is illustrated in FIGS. 1 & 21. FIG. 20 illustrates a blade 702 which is similar to blade 700 except blade 702 has an aperture 722 that is slightly larger in diameter than aperture 720 of blade 700. Therefore, blade 702 has a different three dimensional shape than blade 700. It is apparent that an arrowhead identical to arrowhead 200*a* as illustrated in FIGS. 1 & 29 except having blades 702 attached therewith instead of blades 700 will define a slightly larger cutting diameter than the cutting diameter defined by blades 700, due to larger diameter apertures 720 allowing corresponding cutting edges 770 to extend further from central longitudinal axis 900 thereof.

Blade apertures 720 & 722 and the other hinge pin blade apertures or equivalents of the pivotal blades as according to this invention are preferably configured such so as to enable corresponding pivotal blades to be easily and readily attached to corresponding hinge means, such for example when blades 700 are being seated on bumps 360 of blade ring 300.

Figure 29:
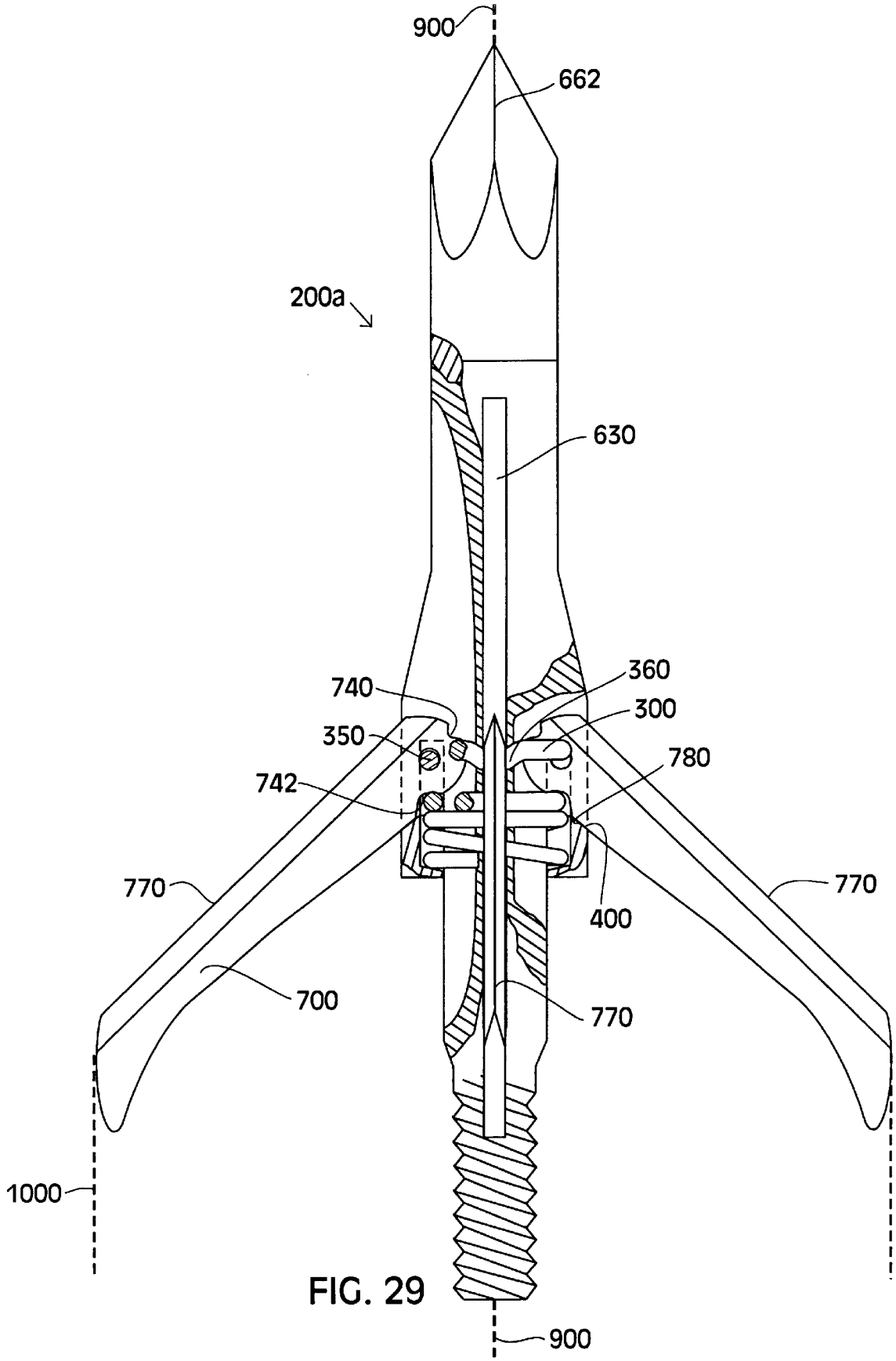
FIG. 29 is a partial sectioned side view of the arrowhead of FIG. 1 in a penetrating configuration.
Figure 30:
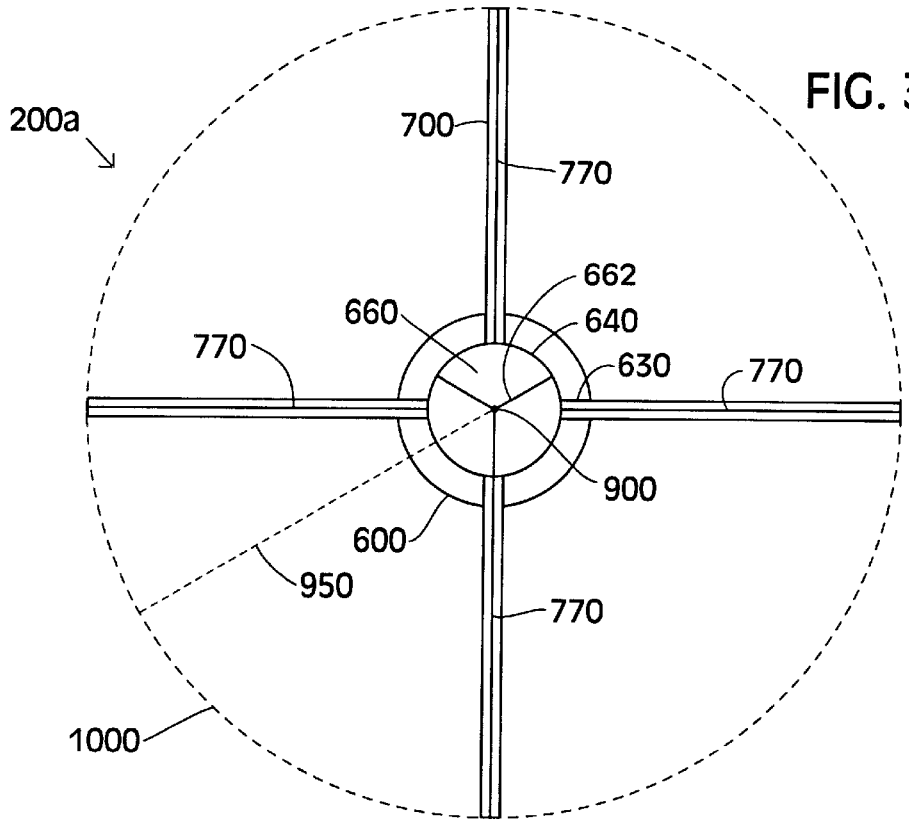
FIG. 30 is top view of the arrowhead of FIG. 29 illustrating the cutting diameter thereof.
Figure 32:
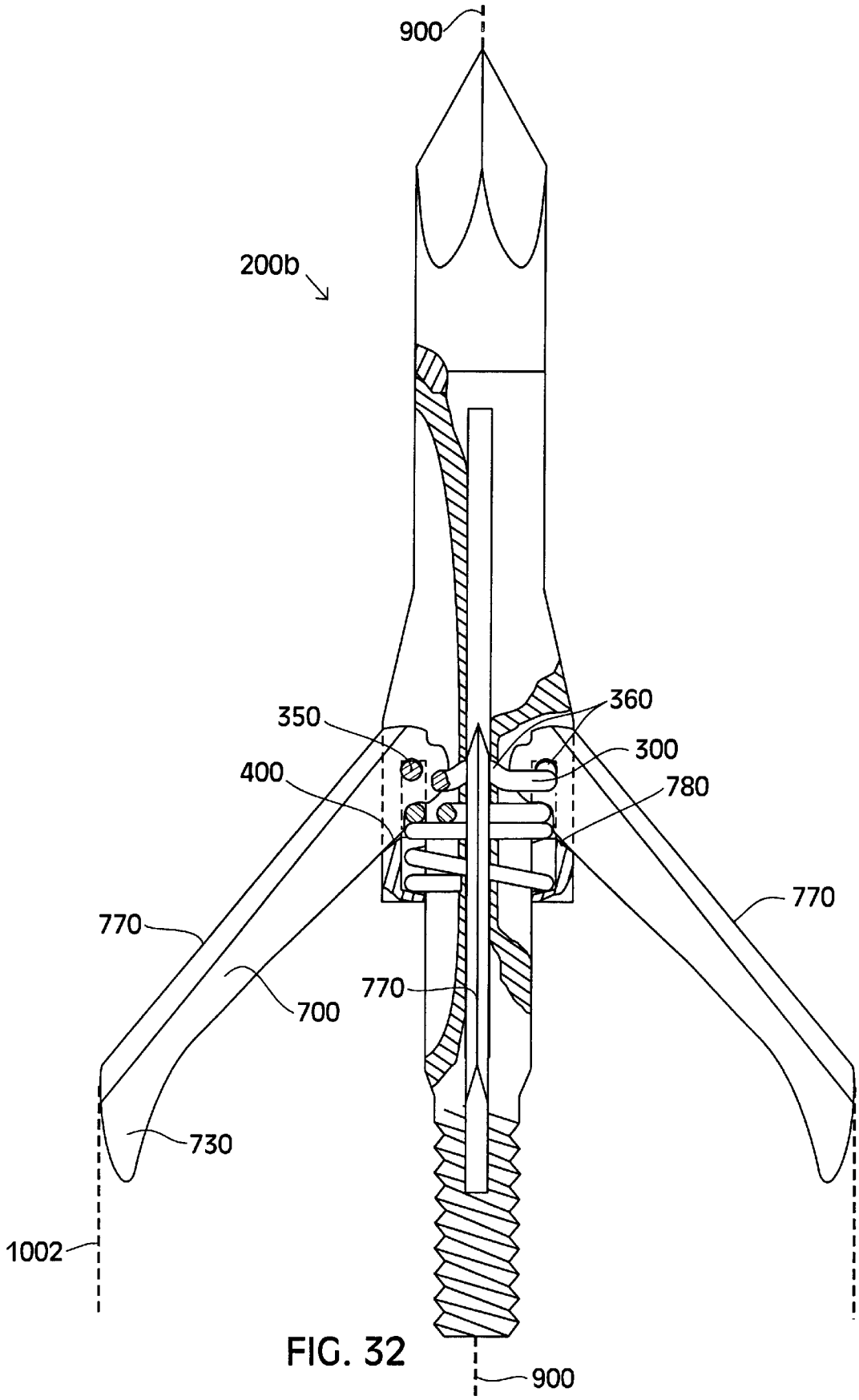
FIG. 32 is a partial sectioned side view of the arrowhead of FIG. 21 in a penetrating configuration.
Figure 33:
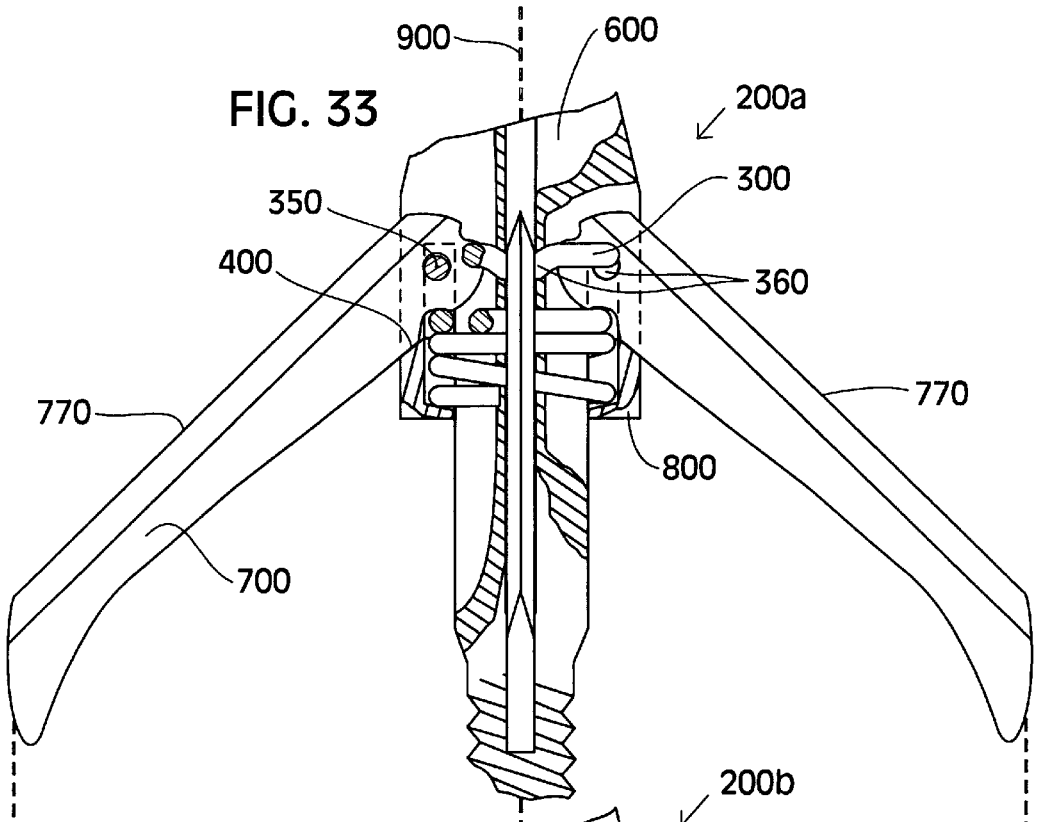
FIG. 33 is a partial length partial sectioned side view of the arrowhead of FIG. 29.
Figure 34:
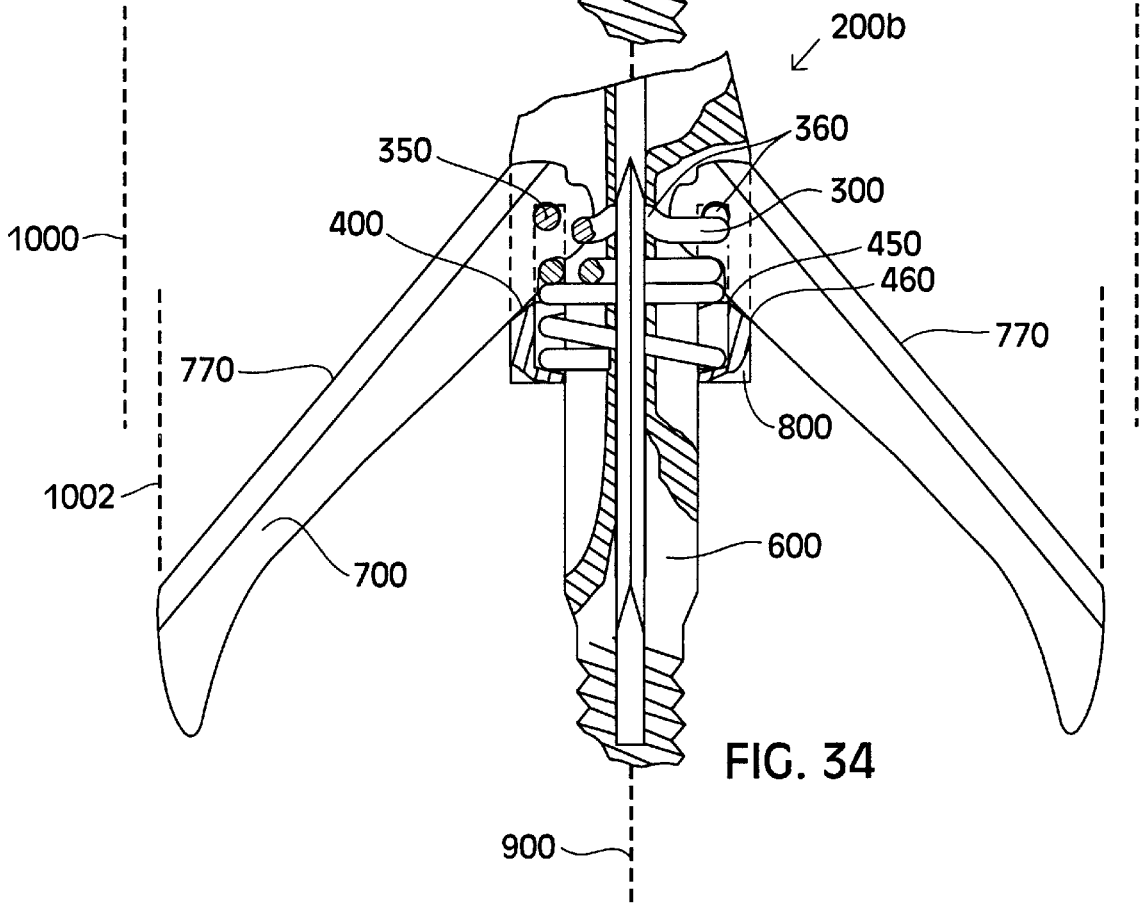
FIG. 34 is a partial length partial sectioned side view of the arrowhead of FIG. 32.

As illustrated in FIGS. 29, 30 & 33 arrowhead 200*a* when in a penetrating or open configuration defines a cutting diameter 1000 whereas arrowhead 200*b* as illustrated in FIGS. 32 & 34 when in a penetrating or open configuration defines a different cutting diameter 1002. Different cutting diameters 1000 & 1002 of the two differing penetrating configurations 200*a*/200*b* are due to the inversion of blade ring 300 or the spatial relocation of the hinge means relative to arrowhead body 600 so that bumps 360 protrude in opposing upward and downward directions or orientations, which illustrates examples of cutting diameter selection means and hinge means relocation means as according to this invention. As is particularly illustrated in FIG. 30 cutting diameter 1000 of arrowhead 200*a* is determined by a radial line 950 extending from central longitudinal axis 900 of the arrowhead outward to a distance the furthest section that blade cutting edges 770 are displaced away from central longitudinal axis 900 when the arrowhead is in penetrating configuration 200*a*. Cutting diameter 1000 is therefore twice the length of radial line 950.

As illustrated in FIGS. 29 & 32 abutting edge 780 of the peripheral edge of each blade 700 abuts or contacts abutting surface 400 of blade-stop washer 800 when the arrowheads are in a penetrating or open configuration. Blade abutting surface 400 of blade-stop washer 800 serves to limit the rotation of blades 700 when expanded to corresponding open positions so as to define the respective cutting diameters thereof. The furthest section of cutting edge 770 of each blade 700 away from central longitudinal axis 900 when defining cutting diameters 1000 & 1002 are displaced different perpendicular distances away from central longitudinal axis 900 of corresponding arrowheads 200*a*/200*b* as is clearly illustrated in FIGS. 33 & 34. This provides an arrowhead or arrowhead body, utilizing the same blade or a plurality of same shaped blades, that is capable of defining a plurality of different cutting diameters by changing the spatial orientation of the hinge means so as to be positionable at a plurality of different locations relative to the arrowhead as is according to at least some of the desired results of this invention. Such an embodiment is an example of hinge means relocation means as according to this invention.

Figure 24:
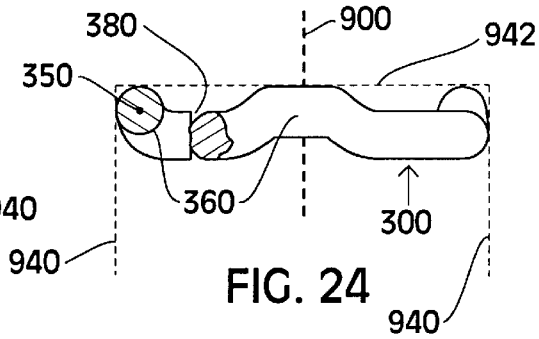
FIG. 24 is another enlarged partial sectioned side view of the blade ring as illustrated in FIG. 4.
Figure 25:
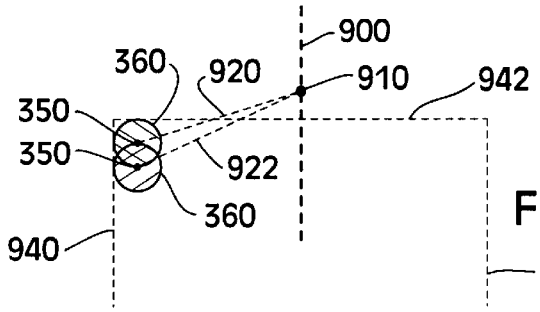
FIG. 25 is an enlarged view illustrating the different spatial orientation of cross-sectional centers of the blade ring bumps of the blade ring as illustrated in FIGS. 23 & 24 relative to reference points.

As illustrated in FIGS. 22–25, where dotted lines 942 represent annular shelf 672 of recessed annular groove 670 of arrowhead body 600 and dotted lines 940 represent outer wall 674 of recessed groove 670 of arrowhead body 600, when blade ring 300 is positioned so that bumps 360 protrude rearwardly (FIG. 23) the hinge means (blade ring 300) is positioned at a different spatial location relative to arrowhead body 600 than the spatial location the hinge means (blade ring 300) is positioned relative to arrowhead body 600 when blade ring 300 is inverted so that bumps 360 protrude forwardly (FIG. 24). As illustrated specifically in FIG. 25, a cross-sectional center 350 of each blade ring bump 360 is located a different distance from a reference point 910 that intersects central longitudinal axis 900 when blade ring 300 is positioned in its two different spatial arrowhead attaching orientations (bumps up & bumps down). Particularly, cross-sectional center 350 of bumps 360, when blade ring 300 is mounted to an arrowhead body such as arrowhead body 600 so that bumps 360 protrude forwardly, is located a shortest distance 920 from reference point 910, and cross-sectional center 350 of bumps 360, when blade ring 300 is mounted to arrowhead body 600 so that bumps 360 protrude rearwardly, is located a different shortest distance 922 from reference point 910. As is also evident from FIGS. 23–25 cross-sectional center 350 of each bump 360 is located at differing distances from forward leading end 664 of an accompanying arrowhead when blade ring 300 is positioned in the two different spatial arrowhead attaching orientations or positions.

As has been previously discussed different cutting diameters 1000 & 1002 are created or defined simply by inverting or flipping-over blade ring 300 so as to change the position blade ring bumps 360 are located relative to the arrowhead or arrowhead body. Particularly, by changing the spatial orientation of blade ring 300 such as has been disclosed, each blade 700 and accompanying cutting edge 770 is oriented at different angles with respect to central longitudinal axis 900 when blades 700 are in a fully open position or in a penetrating configuration. This enables the arrowhead to define a plurality of different cutting diameters with the same blade or a plurality of same shaped blades.

Figure 31:
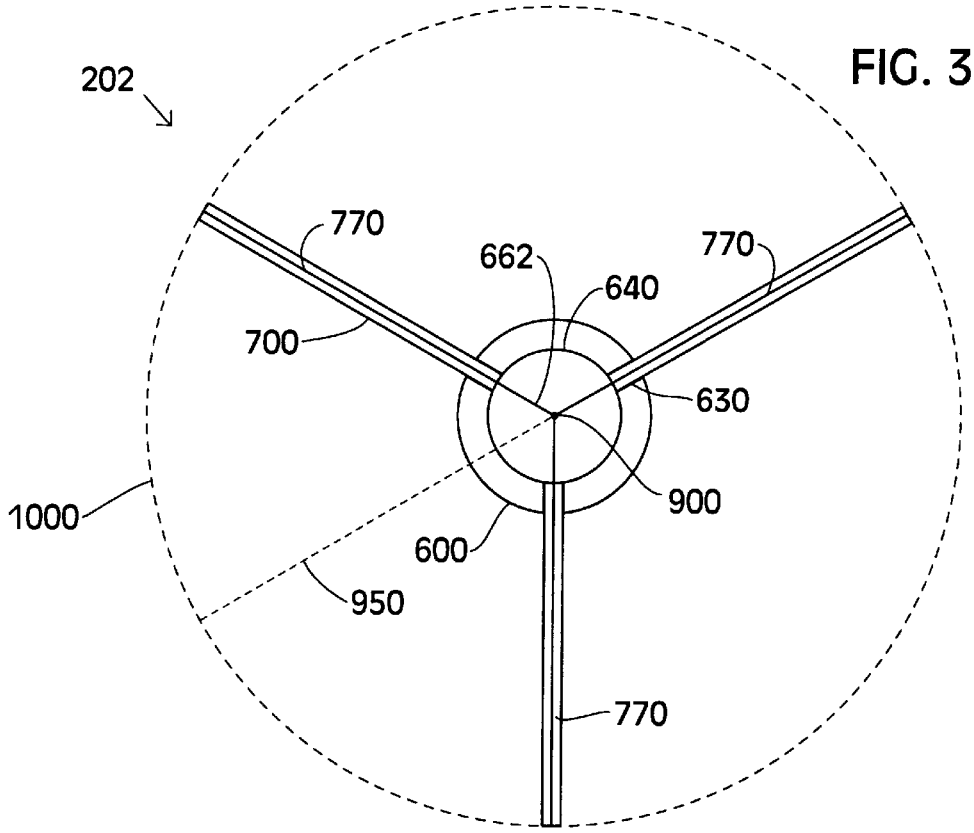
FIG. 31 is top view of another arrowhead of this invention illustrating the cutting diameter thereof.

FIG. 31 illustrates an arrowhead 202 which is similar to arrowhead 200*a* except arrowhead 202 has a plurality of three blades 700 and utilizes a blade ring 302 as is illustrated in FIGS. 4 & 5 with a like number of axial protruding bumps 374. The term axial refers to a direction generally or substantially parallel at least in part to the central longitudinal axis of an arrowhead, so for example bumps 374 protrude at least in part forwardly and rearwardly relative to a forward leading arrowhead end and opposing arrowshaft attachment end (or the rearward arrowhead end) when blade ring 302 is positioned in its two alternative spatial orientations therewith.

FIGS. 9 & 10 illustrate a blade ring 310 having a plurality of three inwardly protruding bumps 370. FIGS. 11 & 12 illustrate a blade ring 308 having a plurality of three outwardly protruding bumps 372. Blade bump rings 308 & 310 illustrate another example of cutting diameter selection means and hinge means relocation means as according to this invention.

Figure 26:
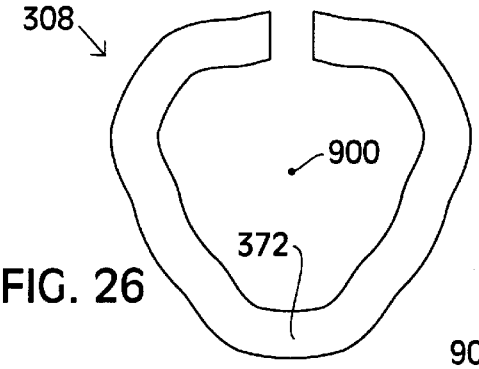
FIG. 26 is an enlarged top view of the blade ring as illustrated in FIG. 11.
Figure 27:
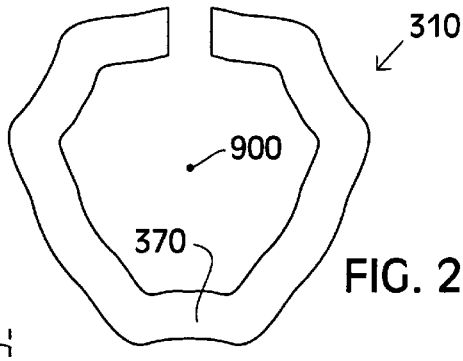
FIG. 27 is an enlarged top view of the blade ring as illustrated in FIG. 9.
Figure 28:
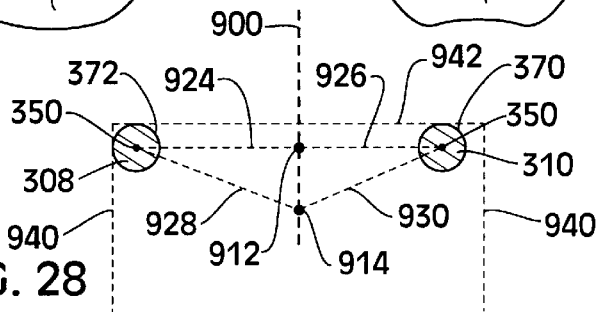
FIG. 28 is an enlarged view illustrating the different spatial orientation of cross-sectional centers of the blade ring bumps of the blade rings as illustrated in FIGS. 26 & 27 relative to reference points.

As is illustrated in FIGS. 26–28 when blade ring 308 (hinge means) is individually mounted to an arrowhead within a recessed annular groove or equivalent such as annular recess 670 of arrowhead body 600, bumps 372 are positioned at a different spatial location relative to the arrowhead body than would bumps 370 of blade ring 310 (hinge means) be positioned when ring 310 is individually mounted to the same arrowhead body 600 or to a same shaped different arrowhead body 600. Particularly, as illustrated in FIG. 28 cross-sectional center 350 of each bump 372 when blade ring 308 is mounted to arrowhead body 600 is located a perpendicular distance 924 from a reference point 912, and cross-sectional center 350 of each bump 370 when blade ring 310 is mounted to the same arrowhead body is located a second different perpendicular distance 926 from reference point 912. Distance 926 is notably less than distance 924. Also, as illustrated in FIG. 28 cross-sectional centers 350 of each bump 370 are located a shortest distance 930 away from a reference point 914 whereas cross-sectional centers 350 of each bump 372 are located a different shortest distance 928 away from reference point 914. Thus, a blade 700 when attached to blade ring 310 and arrowhead body 600 would define a different cutting diameter when in a penetrating configuration, than the cutting diameter defined by the blade 700 when attached to blade ring 308 and arrowhead body 600 when in a penetrating configuration as is according to at least some of the desired results of this invention.

It is apparent that the blade rings or equivalents such as other hinge means as according to this invention having bumps or equivalents formed thereon may have various different arrangements and combinations of different spatially oriented protruding bumps or equivalents.

FIGS. 6 & 7 illustrate a blade ring 304 having a plurality of three outwardly and axially protruding bumps 376. FIG. 8 illustrates a blade ring 306 having a plurality of three inwardly and axially protruding bumps 378. Blade bump rings 304 & 306 when individually removably attached to the same arrowhead body will enable a pivotal blade such as a blade 700 to define a plurality of different cutting diameters as is according to this invention by enabling the hinge means (as for example referenced from cross-sectional centers 350 of bumps 376 & 378) to be positioned at a plurality of different locations or different spatial orientations relative to the same arrowhead body.

It is apparent that arrowhead 200*a* and/or other arrowheads as according to this invention could be shot from an archery bow or equivalent with the blades in an open position such as is depicted in FIG. 29 so as to be substantially a non-blade opening pivotally bladed arrowhead as is known to those skilled in the art, which will have an in-flight penetrating cutting diameter while being enabled to achieve the cutting diameter selection objectives of this invention. It is apparent that the desired results and scope of this invention are applicable to the various other types of non blade-opening, pivotally bladed arrowheads as know to those skilled in the art, and to other arrowheads having a pivotal blade, which are not of necessity disclosed herein.

Although not specifically illustrated in this specification, it is apparent that the various elements, designs and functional objective results of the arrowheads as according to this invention and of those arrowheads incorporated herein by specific reference are applicable to blade-opening arrowheads whose blades rotate in a forward direction (toward the forward leading end of the arrowhead) when rotating to an open position or a penetrating configuration upon impact of a target or application of an opening force. For example, such arrowheads as that which have plunger shafts, wedging cams and/or other components that have movement in an axial or elongate direction relative to an accompanying arrowshaft or equivalent or to other arrowhead components, whether such components are attached directly to a cutting blade or not, are within the scope of the arrowheads as according to this invention. As a specific example, a blade-opening arrowhead with forward rotating blades having a wedge cam with a tip end exposed from an accompanying arrowhead body when in a penetrating configuration could be configured or designed such so as to enable a pivotal blade thereof to define a plurality of different cutting diameters as is according to the desired results of this invention while simultaneously having a cutting blade or at least one sharp cutting edge thereon (as taught in my U.S. patent application Ser. No. 09/082,636 filed May 21, 1998 and Ser. No. 09/322,278 filed May 28, 1999 respectively, which are incorporated herein by specific reference) so as to cut target material in front of an arrowhead main cutting blade.

Figure 35:
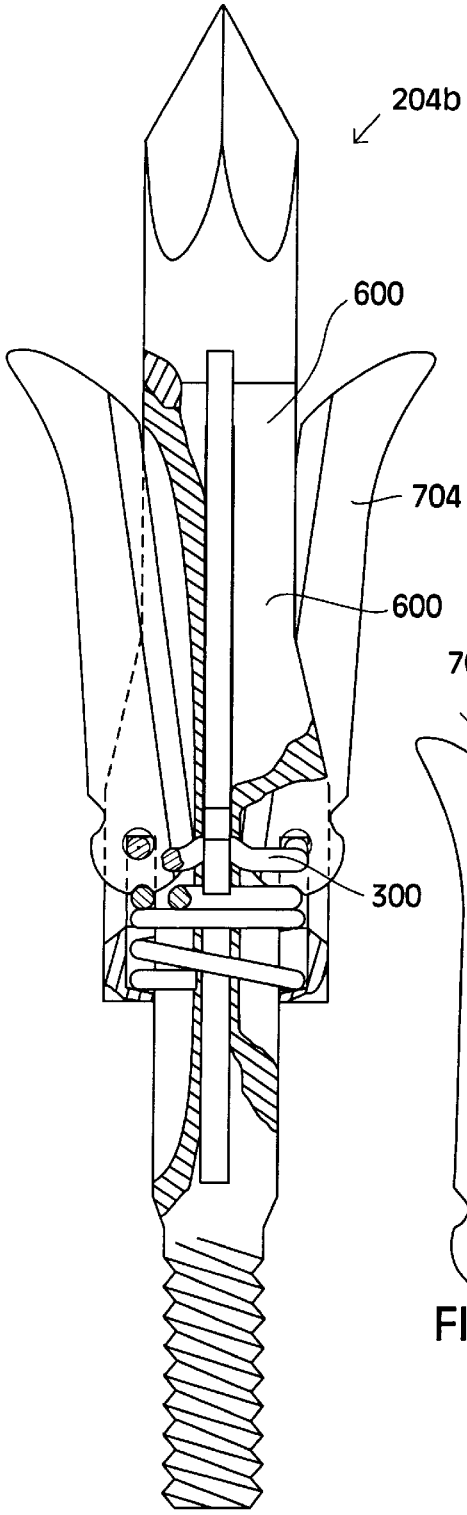
FIG. 35 is a partial sectioned side view of another arrowhead as according to this invention.
Figure 37:
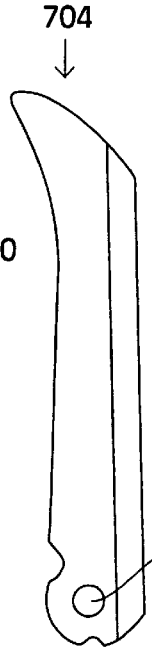
FIG. 37 is a side view of another pivotal blade as according to this invention.
Figure 38:
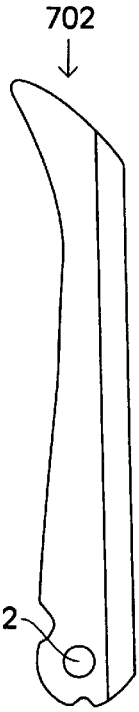
FIG. 38 is a side view of the pivotal blade of FIG. 20.
Figure 36:
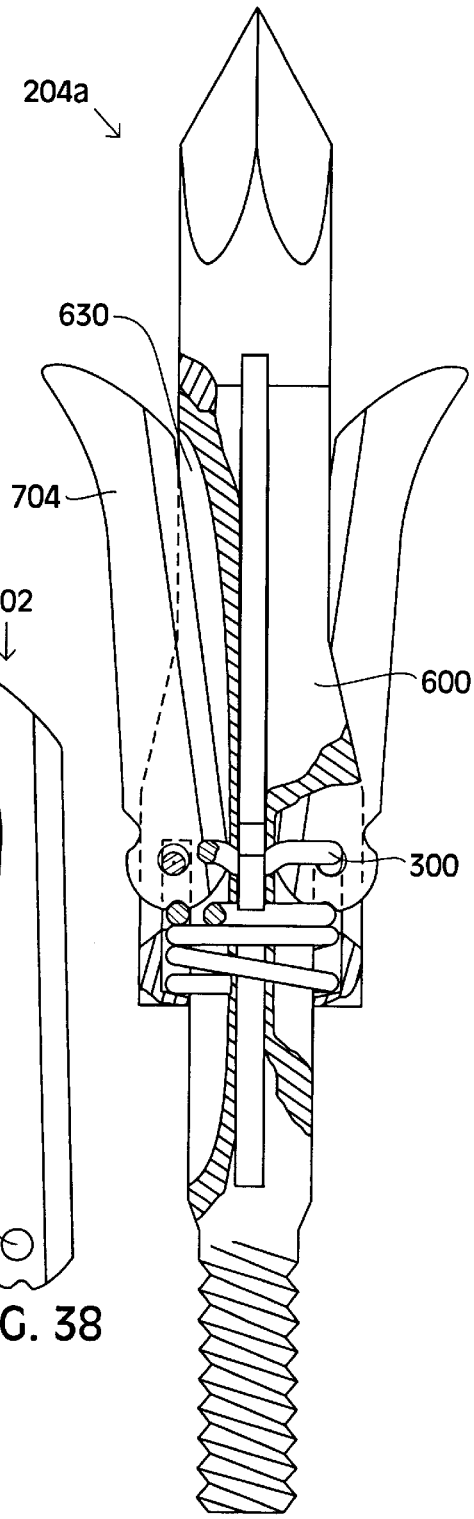
FIG. 36 is a partial sectioned side view of another arrowhead as according to this invention.
Figures 39, 40, 41, 42, 43, 44:
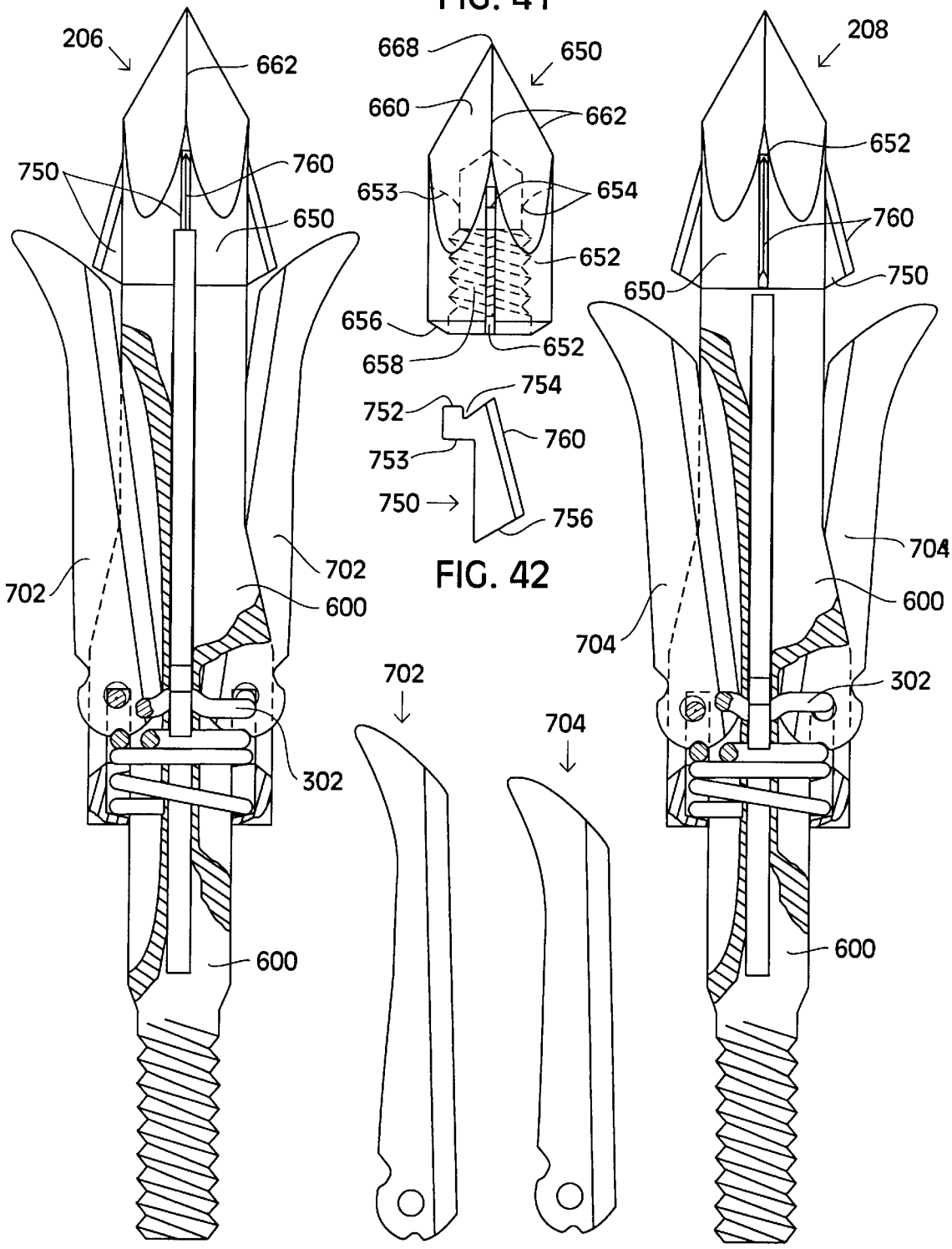
FIG. 39 is a partial sectioned side view of another arrowhead as according to this invention.
FIG. 40 is a side view of the pivotal blade of FIG. 37.
FIG. 41 is a side view of the arrowhead tip of the arrowheads of FIGS. 39 & 43.
FIG. 42 is a side view of a tip blade of the arrowheads of FIGS. 39 & 43.
FIG. 43 is a partial sectioned side view of another arrowhead as according to this invention.
FIG. 44 is a side view of the pivotal blade of FIG. 19.

FIGS. 35 & 36 illustrate a blade-opening arrowhead 204*a* and a blade-opening arrowhead 204*b* which are identical to arrowheads 200*a* & 200*b* heretofore disclosed except that arrowheads 204*a* & 204*b* utilize a plurality of pivotal blades 704. Each pivotal blade 704 as illustrated in FIG. 37 is of a different three-dimensional shape than each pivotal blade 700 and than each pivotal blade 702. Particularly, pivotal blades 704 have a shorter elongate length than both pivotal blades 700 & 702. When arrowhead 204*a* is in a penetrating configuration pivotal blades 704 define a cutting diameter that is different than the cutting diameter definable by arrowhead 204*b* when in a penetrating configuration, as is according to the desired results of this invention. The cutting diameters defined by arrowheads 204*a* & 204*b* are substantially different than the cutting diameters defined by arrowheads 200*a* & 200*b*. It is envisioned that an arrowhead body such as arrowhead body 600 with a blade stop washer such as blade stop washer 800 and a blade bump ring such as blade ring 300 could be used in combination with blades 702 and blades 704 to produce penetrating configurations that define a plurality of at least four different cutting diameters. Particularly, blades 702 could define cutting diameters of 1½ inches and 1⅜ inches, while blades 704 could define cutting diameters of 1¼ inches and 1⅛ inches for example.

It is apparent that the distance which the bumps or equivalents of the blade rings or hinge means as according to this invention, such as bumps 360 of blade ring 300, protrude from horizontal sections or equivalents thereof such as horizontal sections 366 of blade ring 300, may be any plausible distance or may be a variety of different distances. For example, a blade ring may have a plurality of bumps that each protrude 0.016 inches therefrom, or a blade ring may have a plurality of bumps that each protrude 0.024 inches therefrom, or a blade ring may have a plurality of bumps that each protrude 0.005 inches therefrom wherein each such different blade ring enables a single blade to define at least two different cutting diameters when correspondingly attaching the blade to the same arrowhead body or to a plurality of same shaped arrowhead bodies (all other factors being equal—but not limited thereto).

Preferably, the bumps or equivalents of the blade rings or hinge means as according to this invention will protrude away from the main body or portion of a corresponding blade ring (such as horizontal sections 366 of blade ring 300) or a main body portion of a corresponding hinge means sufficiently so as to enable a plurality of substantially same shaped pivotal blades (or a single pivotal blade) to define different cutting diameters which differ in cutting diameter from each other by substantially at least 1 1/16 of an inch (but not limited thereto).

It is also apparent that the bumps or equivalents of the blade rings or hinge means as according to this invention may protrude away from the main body or portion of a corresponding hinge means sufficiently so as to enable a plurality of same shaped pivotal blades (or a single pivotal blade) to define different cutting diameters that differ in cutting diameter from each other by substantially ⅛ of an inch, ¼ of an inch, or more, such as by ½ an inch.

It is apparent that a blade ring having bumps or equivalents formed therewith may have a bump that protrudes a different distance out from horizontal sections 366 or equivalents thereof than other bumps of the same blade ring so as to enable same shaped pivotal blades to simultaneously define differing cutting diameters while attached to the same arrowhead body and blade ring and while accordingly the arrowhead is in a penetrating configuration.

It is apparent that the cutting diameter selection means as according to this invention preferably may enable a plurality of same shaped pivotal blades (or a single pivotal blade) to define different cutting diameters that differ in cutting diameter from each other by substantially any measurable difference which preferably is at least 1/16 of an inch (but not limited thereto).

FIGS. 39–44 illustrate an arrowhead 206 and an arrowhead 208. Arrowheads 206 & 208 are similar to arrowheads heretofore disclosed except arrowheads 206 & 208 utilize a removably attachable slotted tip 650 and a plurality of three tip blades 750 that removably attach therewith as is taught in my U.S. patent application Ser. No. 09/082,636 filed May 21, 1998 which has been previously incorporated herein by specific reference. Tip 650 has a forward leading end 668, a plurality of three tip blade slots 652 that communicate with a female threaded bore 658 so as to create a plurality of three catch lips 654 at the junctures of an upper wall 653 of each slot 652 with bore 658. Each tip blade 750 has a notch 754, a protrusion 752, a stud abutting surface 753, a cutting edge 760 and a beveled rear end 756. Beveled rear end 756 of each tip blade 750 fits substantially flush with a beveled locking flank 656 of tip 650 so as to substantially abut with or against beveled locking flank 638 of arrowhead body 600 (best illustrated in FIG. 13) when assembled into an arrowhead such as arrowhead 206 or arrowhead 208. When tip blades 750 are mounted or received in corresponding slots 652 of tip 650 and tip 650 is attached to arrowhead body 600 catch lips 654 are received into notches 754 and beveled rear ends 756 abut against beveled locking flank 638 of arrowhead body 600 so as to secure each tip blade 750 to an accompanying arrowhead.

FIGS. 45–51 illustrate another example of cutting diameter selection means as according to this invention and an example of blade abutting surface change means as according to this invention. FIG. 46 illustrates blade-stop washer 800 of arrowheads 200–208 as heretofore disclosed. Blade abutting surface 400 of blade-stop washer 800 has a particular slope or inclination relative to accompanying arrowhead central longitudinal axis 900 when attached to a corresponding arrowhead body such as arrowhead body 600. FIG. 47 illustrates blade-stop washer 802 with a blade abutting surface 402 that has a different slope than blade abutting surface 400. FIG. 48 illustrates blade-stop washer 804 with a blade abutting surface 404 that has a different slope than blade abutting surfaces 400 & 402. FIG. 45 illustrates arrowhead body 600 of arrowheads 200–208 as heretofore disclosed. When blade-stop washers 800, 802 & 804 are individually removably attached to arrowhead body 600 (or a plurality of arrowhead bodies 600) as is illustrated in FIGS. 49–51 arrowheads 210*a,* 210*b* & 210*c* are created. Arrowheads 210*a,* 210*b* & 210*c* accordingly have different sloped blade abutting surfaces therewith. Thus, when a pivotal blade such as a blade 702 abuts against each blade abutting surface 400, 402 & 404 of corresponding arrowheads when in corresponding penetrating configurations, the corresponding blade(s) 702 will define a different cutting diameter (all other factors being equal—but not limited thereto) when abutting against each different sloped blade abutting surface as is according to at least some of the desired results of this invention. Although arrowheads 210*a,* 210*b* & 210*c* are referenced herein by different reference numerals it is to be noted that in general arrowheads 210*a–c* are substantially the same arrowhead (but not limited thereto) other than the attachment of a different sloped blade-stop washer therewith so as to obtain different cutting diameter penetration configurations.

Referring again to FIGS. 45–51 and arrowheads 210*a–c,* it is apparent that if the hinge means such as blade ring 300 where kept in the same spatial orientation or position relative to arrowhead body 600 (such as bumps 360 protruding up) when blade-stop washers 800, 802, & 804 are individually removably attached therewith a pivotal blade such as a blade 702 would define a plurality of different cutting diameters when in corresponding penetrating configurations.

It is also apparent that arrowheads 210*a–c* and other arrowheads as according to this invention could define yet a more numerous plurality of different cutting diameters by utilizing concomitantly in combination the hinge means relocation means and blade abutting surface change means as according to this invention. For example, arrowhead 200*a*/200*b* by utilizing blade-stop washers 800 and 802 in combination with the feature of inverting blade ring 300 so as to protrude bumps 360 axially up and down could define a plurality of at least four different cutting diameters with blades 700.

Figure 52:
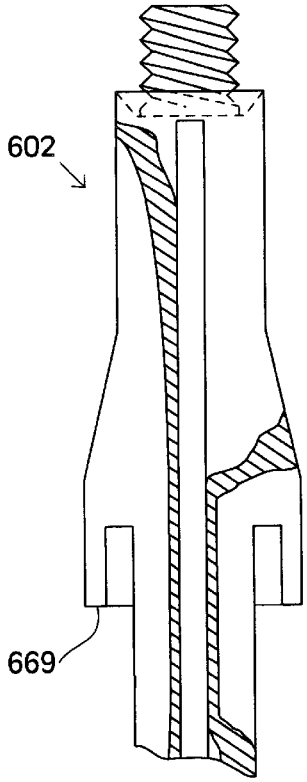
FIG. 52 is a partial length partial sectioned side view of an arrowhead body of this invention.
Figure 53:
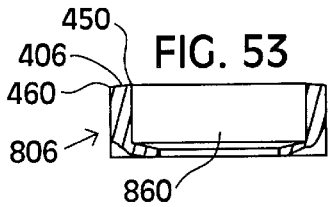
FIGS. 53–57 are partial sectioned side views of blade-stops washers of this invention.
Figure 54:
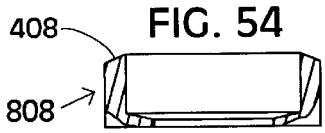
Figure 55:
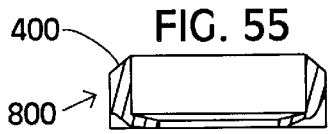
Figure 56:
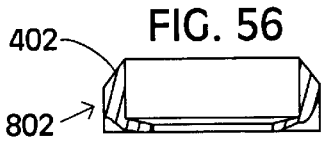
Figure 57:
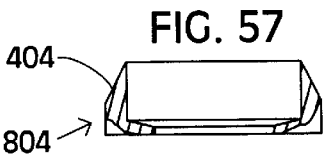
Figure 58:
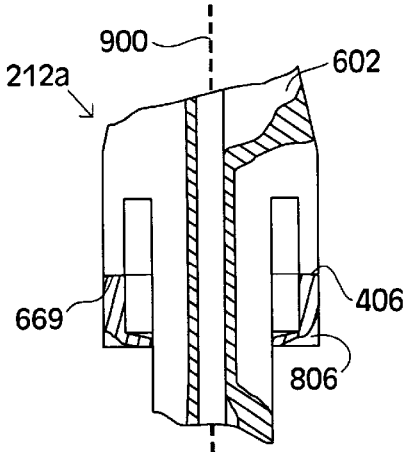
FIGS. 58–62 illustrate the blade-stop washers of FIGS. 53–57 individually removably attached to the arrowhead body of FIG. 52.
Figure 59:
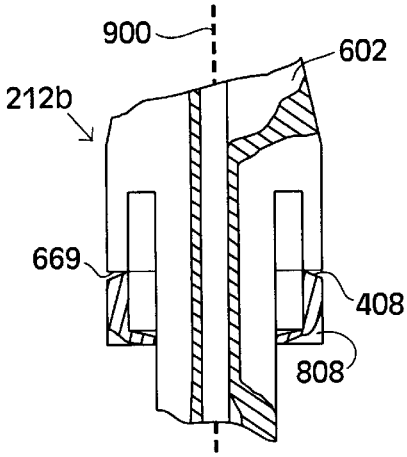
Figure 62:
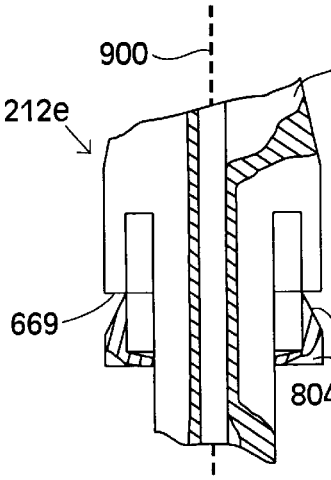
Figure 61:
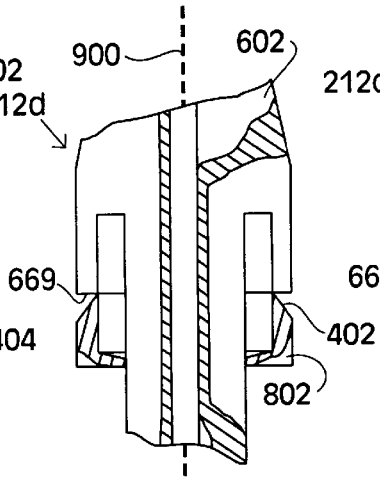
Figure 60:
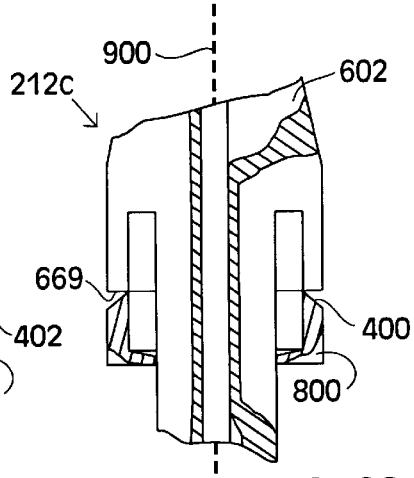

FIGS. 52–62 illustrate another example of cutting diameter selection means as according to this invention and another example of blade abutting surface change means as according to this invention. FIG. 52 illustrates an arrowhead body 602 which is similar to arrowhead body 600 except arrowhead body 602 has a flat skirt 669 that is substantially perpendicularly oriented with central longitudinal axis 900 of arrowhead body 602 as compared to the inclination of beveled skirt 667 of arrowhead body 600. FIGS. 53–57 illustrate blade-stop washers 800, 802 & 804 which have heretofore been disclosed, as well as a blade-stop washer 806 and a blade-stop washer 808. Blade abutting surfaces 400, 402, 404, 406 & 408 of blade-stop washers 800–808 all have different slopes than each other. Forward terminuses 450 of blade abutting surfaces 400–408 each communicate with internal recess 860 of corresponding blade-stop washers. As illustrated in FIGS. 58–62 when blade-stop washers 800–808 are individually removably attached to arrowhead body 602 arrowheads 212*a–e* are created. Arrowheads 212*a–e* accordingly have different sloped blade abutting surfaces therewith. Thus, when a pivotal blade such as a blade 702 abuts against each different sloped blade abutting surface 400–408 of corresponding arrowheads when in a penetrating configuration, the corresponding blade(s) 702 will define a different cutting diameter (all other factors being equal—but not limited thereto) when abutting against each different sloped blade abutting surface as is according to at least some of the desired results of this invention.

Figures 63, 64, 65, 66, 67, 68, 69, 70, 71, 72, 73, 74:
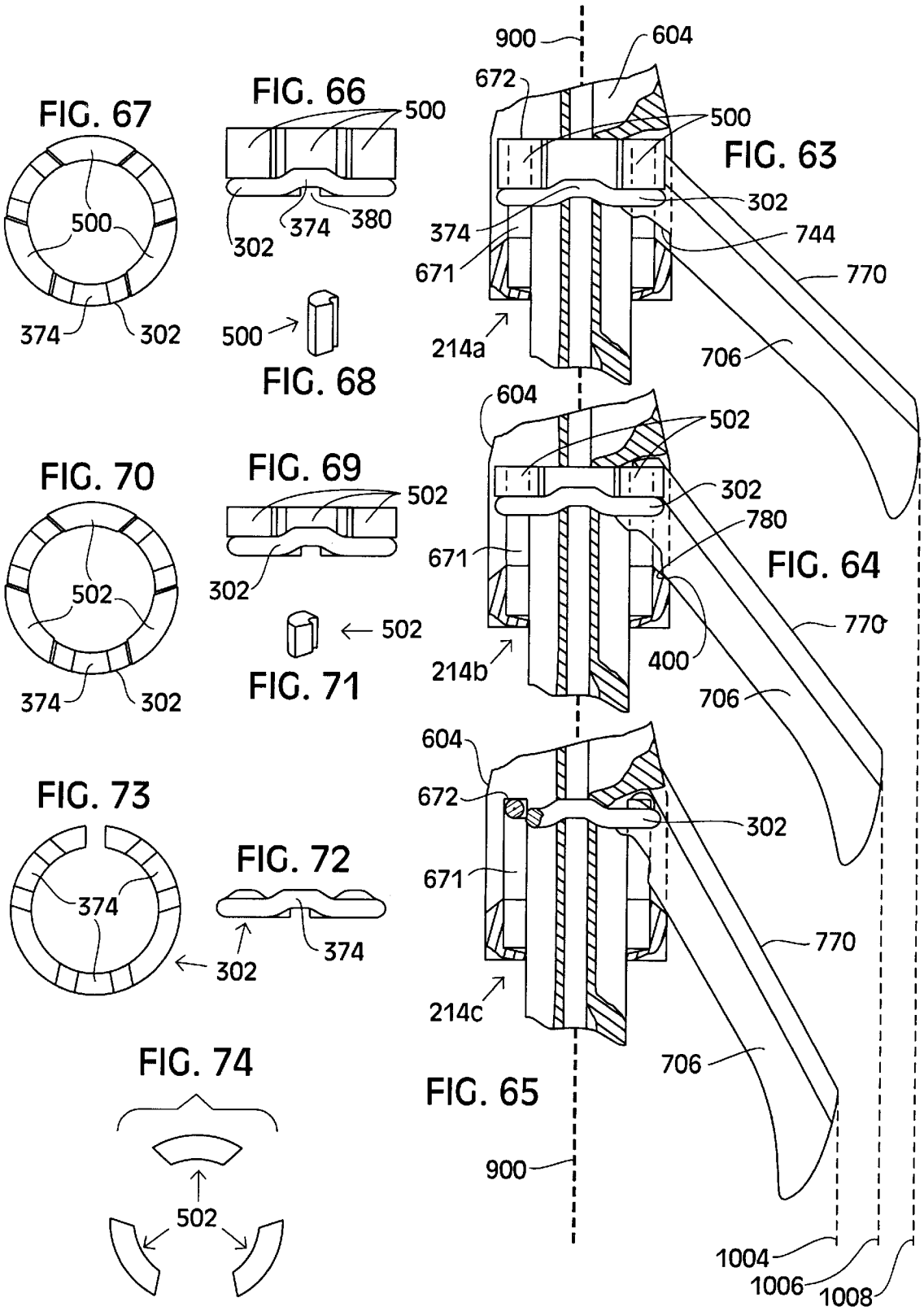
FIG. 63 is a partial length partial sectioned side view of another arrowhead of this invention.
FIG. 64 is a partial length partial sectioned side view of another arrowhead of this invention.
FIG. 65 is a partial length partial sectioned side view of another arrowhead of this invention.
FIG. 66 is a side view of the blade ring of FIG. 5 with three filler elements seated thereon as illustrated also in FIG. 63.
FIG. 67 is a top view of the blade ring and filler elements of FIG. 66.
FIG. 68 is a perspective view of a filler element as of FIGS. 63, 66 & 67.
FIG. 69 is a side view of the blade ring of FIG. 66 with three filler elements seated thereon as illustrated also in FIG. 64.
FIG. 70 is a top view of the blade ring and filler elements of FIG. 69.
FIG. 71 is a perspective view of a filler element as of FIGS. 64, 69 & 70.
FIGS. 72 & 73 are a top view and a side view of the blade ring of FIGS. 63–69.
FIG. 74 is a top view of the filler elements as illustrated in FIG. 70.

FIGS. 63–74 illustrate another example of cutting diameter selection means as according to this invention and another example of hinge means relocation means as according to this invention. FIGS. 63–65 illustrate an arrowhead 214*a,* an arrowhead 214*b* and an arrowhead 214*c* each utilizing a pivotal blade 706, and an arrowhead body 604 that has a recessed annular groove 671 for receiving a blade hinge ring such as blade ring 302 therein. It is apparent that arrowheads 214*a–c* may each utilize a plurality of three pivotal blades 706 (or more or less) despite only one blade 706 being depicted in each of FIGS. 63–65. Each pivotal blade 706 has a second notch 744 that is larger than second notches 742 of other pivotal blades heretofore disclosed so as to provide ample room for annular spring 970 (not illustrated) or an equivalent to urge annular notch ring 960 (not illustrated) or an equivalent into engagement therewith. A filler element 502 as illustrated in FIG. 71 is configured such so as to be removably slidably mounted or received within recessed annular groove 671 of arrowhead body 604 so as to abut or seat against annular shelf 672 thereof as illustrated in FIG. 64. A plurality of three filler elements 502 (as seen in a top view as in FIG. 74) when seated upon annular blade ring 302 as illustrated in FIGS. 69 & 70 creates arrowhead 214*b* (FIG. 64) which has a cutting diameter 1006. A filler element 500 having a substantially longer axial length (as illustrated in FIG. 68) than filler element 502 is configured such so as to also be removably slidably mounted or received within recessed annular groove 671 of arrowhead body 604 and to thereby abut or seat against annular shelf 672 thereof. A plurality of three filler elements 500 when seated upon annular ring 302 as illustrated in FIGS. 66 & 67 creates arrowhead 214*a* (FIG. 63) which has a cutting diameter 1008. Cutting diameter 1004 is defined by arrowhead 214*c* (FIG. 65) when blade ring 302 seats directly against annular shelf 672. Hinge means (blade ring 302) as illustrated in FIGS. 63–74 is enabled to be positioned at a plurality of different locations relative to arrowhead body 604 such that pivotal blade 706 is enabled to define a plurality of different cutting diameters (1004, 1006, & 1008) when in penetrating configurations 214*a–c* as is according to this invention.

It is apparent that the filler elements or equivalents as according to this invention may be fabricated of metal wire, molded organic polymers such as injection molded plastics or of other suitable materials.

FIGS. 75–83 illustrate another example of cutting diameter selection means as according to this invention and another example of blade abutting surface change means as according to this invention. FIG. 75 illustrates a blade-opening arrowhead 216 which is similar to arrowheads heretofore disclosed except arrowhead 216 utilizes an arrowhead body 606, a blade-stop washer 810 having a blade abutting surface 410, a substantially flat and circular or non-bumped blade ring 312 as illustrated in FIG. 76, a spacer element 990, a plurality of pivotal blades 708 and a conventional rubber O-ring 980 for selectively holding or retaining blades 708 in the closed or in-flight position. It is apparent that the method of selectively retaining a pivotal blade of a blade-opening arrowhead in a closed or in-flight retracted position is of relatively minor significance or importance to this invention. Spacer element 990 as illustrated in FIG. 78 seats in externally exposed annular groove 688 of arrowhead body 606 and serves to prevent the sharp cutting edge 770 of each pivotal blade 708 from being dulled by contacting arrowhead body 606 when in the closed or in-flight position, such as is taught in my U.S. patent application Ser. No. 09/303,762 filed May 3, 1999 which is also incorporated herein by specific reference. FIGS. 79–83 illustrate blade-stop washers 810, 812, 814, 816 & 818 each having corresponding different sloped blade abutting surfaces 410, 412, 414, 416 & 418 respectively. Each blade-stop washer 810–818 has substantially the same axial thickness as one another. Forward terminuses 450 of blade abutting surfaces 410–418 do not communicate with internal recess 850 of corresponding blade-stop washers but extend thereon so that forward terminuses 450 substantially line-up or communicate with external wall 674 of recessed annular groove 670 as illustrated for example with washer 810 in FIG. 75. When blade-stop washers 810–818 are individually removably attached to arrowhead body 606, a pivotal blade such as a blade 708 will define a different cutting diameter (all other factors being equal—but not limited thereto) when in abutment against each different sloped blade abutting surface 410–418 as is according to at least some of the desired results of this invention.

It is apparent that blade ring 312 as illustrated for example in FIGS. 75 & 76, and the other blade rings as according to this invention could either be expanded or compressed to larger or narrower circular diameters or neither expanded nor compressed when being attached within corresponding annular recessed grooves or equivalents so as to be in an in-flight and/or penetrating arrowhead configuration.

It is apparent that the arrowheads as according to this invention may have varying types of blade-stop structures such as blade-stop washers as have been illustrated herein: such blade-stop structures which serve to provide the functions of limiting the rotation of corresponding pivotal blades by abutting thereagainst, lessening the impact forces delivered to the hinge pin(s) or equivalent and preventing undesirable damage to accompanying arrowshafts and/or other arrowhead structures. For example, the pivotal blades as according to this invention may abut against integrally attached or formed sections of corresponding arrowhead bodies, recessed blade-stop washers like unto blade-stop washer 800 or non-recessed blade-stop washers having blade abutting surfaces thereon such as does blade-stop washer 810. Preferably the blade-stop washers or equivalents as according to this invention are hardened sufficiently such as by caborizing, case hardening or other heat treating or hardening techniques so as to not substantially be damaged by the impacting blades during target penetration, such as when the blades collide with heavy bone of a large game animal.

Figure 84:
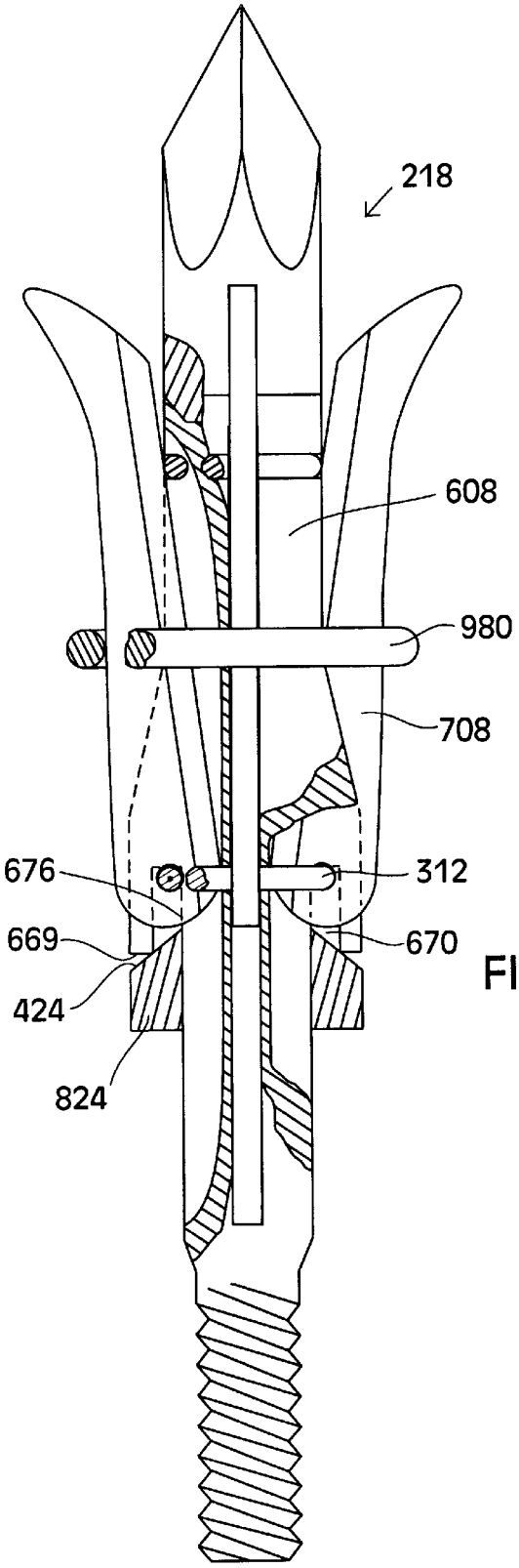
FIG. 84 is a partial sectioned side view of another arrowhead as according to this invention.
Figure 85:
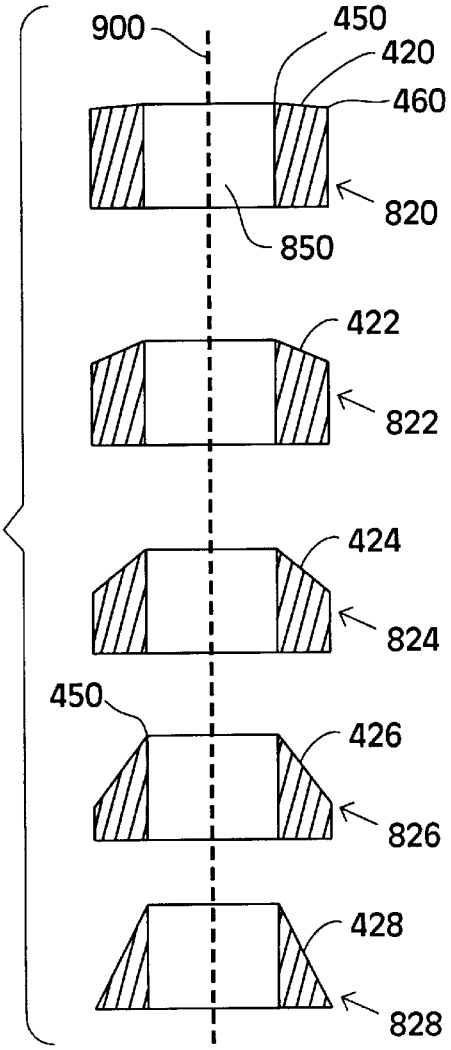
FIG. 85 shows cross-sectioned side views of blade-stops washers of this invention.

FIGS. 84 & 85 illustrate another example of cutting diameter selection means as according to this invention and another example of blade abutting surface change means as according to this invention. FIG. 84 illustrates a blade-opening arrowhead 218 which is similar to arrowhead 216 except arrowhead 218 utilizes an arrowhead body 608 having flat skirt 669, and a plurality of blade-stop washers 820, 822, 824, 826 & 828 each having corresponding different sloped blade abutting surfaces 420, 422, 424, 426 & 428 so as to enable arrowhead 218 to define a plurality of different cutting diameters. Each blade-stop washer 820–828 has substantially the same axial thickness as one another, which is notably thicker than the axial thickness of blade-stop washers 810–818 of FIGS. 79–83. Forward terminuses 450 of blade abutting surfaces 420–428 communicate with internal recess 850 of corresponding blade-stop washers and extend thereon so that forward terminuses 450 substantially line-up or communicate with internal wall 676 of recessed annular groove 670. When blade-stop washers 820–828 are individually removably attached to arrowhead body 608 a pivotal blade such as a blade 708 will define a different cutting diameter (all other factors being equal—but not limited thereto) when abutting against each different sloped blade abutting surface 420–428 as is according to this invention.

FIGS. 86–90 illustrate yet another example of cutting diameter selection means as according to this invention and yet another example of blade abutting surface change means as according to this invention. FIG. 86 illustrates a blade-opening arrowhead 220 which is similar to arrowhead 216 as illustrated in FIGS. 75–83 except arrowhead 220 utilizes an arrowhead body 610 having an externally exposed recessed annular groove 680 for removably receiving a blade retention annular resilient member 982 which may be a rubber O-ring. Annular resilient member 982 urges itself into engagement with the outer and rearward section of the peripheral edge of each blade 708 so as to selectively retain or hold blades 708 in the closed in-flight position until acted upon by an opening force. FIG. 90 illustrates a plurality of blade-stop washers 830, 832, 834, 836 & 838 each having corresponding different sloped blade abutting surfaces 430, 432, 434, 436 & 438 so as to enable arrowhead 220 to define a plurality of different cutting diameters. Each blade-stop washer 830–838 does not have the same axial thickness as one another. When blade-stop washers 830–838 are individually removably attached to arrowhead body 610 a pivotal blade such as a blade 708 will define a different cutting diameter (all other factors being equal—but not limited thereto) when abutting against each different sloped blade abutting surface 430–438 as is according to this invention. FIG. 89 illustrates blade-stop washers 810–818 which have heretofore been disclosed, and which also are removably attachable with arrowhead body 610 so as to enable arrowhead 220 to define a plurality of yet further different cutting diameters.

It is apparent that differing sets of blade-stop washers as for example which have been disclosed herein, may be removably attachable with and amongst various different arrowhead bodies and arrowheads of this invention so as to provide an arrowhead and/or arrowheads capable of enabling a plurality of same shaped blades to obtain different penetrating characteristics, different cutting diameters and different tissue volume cutting capacities.

Figures 91, 92, 93, 94, 95, 96, 97:
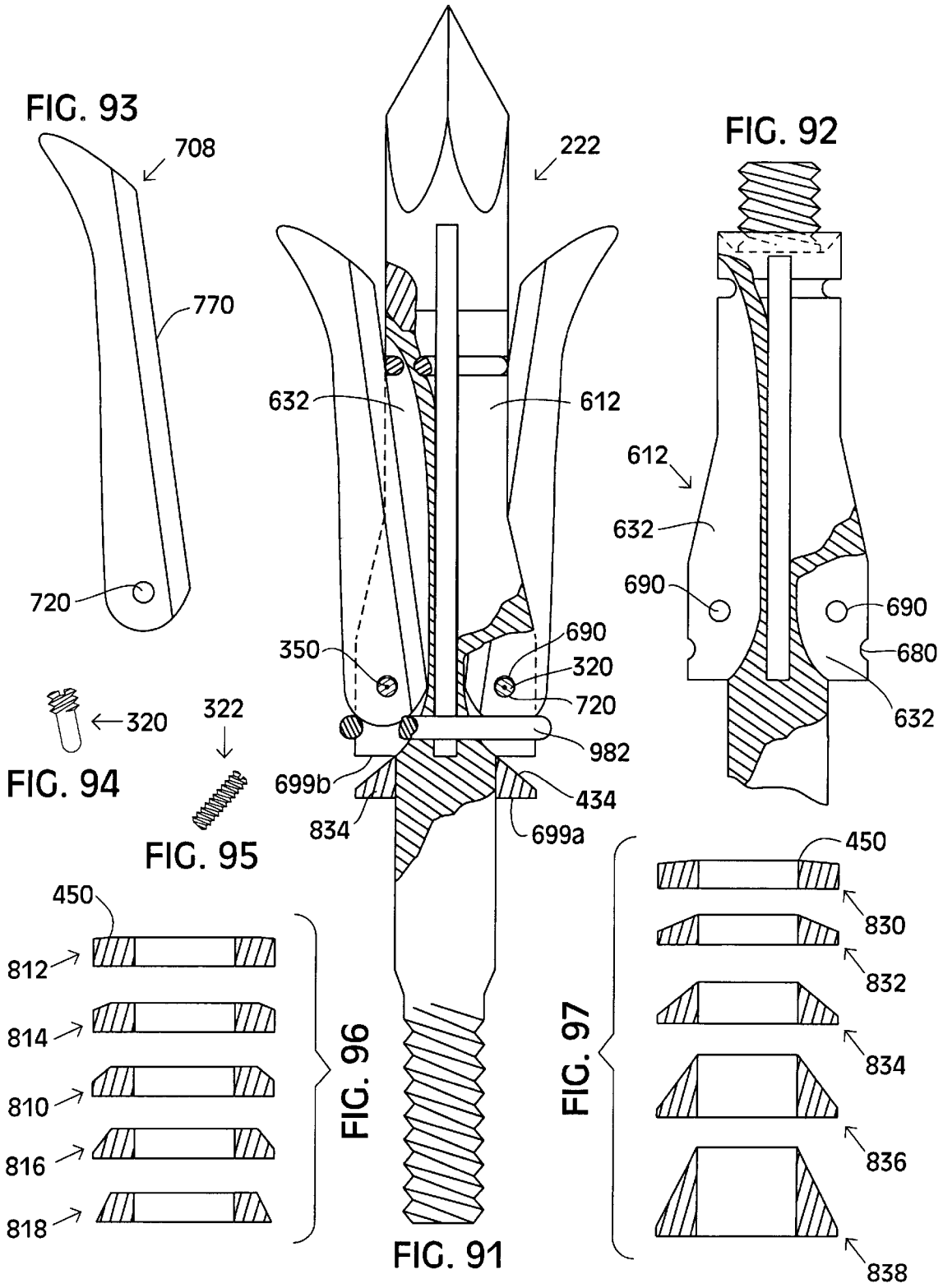
FIG. 91 is a partial sectioned side view of another arrowhead as according to this invention.
FIG. 92 is a partial length partial sectioned side view of an arrowhead body of this invention.
FIG. 93 is a side view of the pivotal blade of FIG. 77.
FIG. 94 is a side view of a partially threaded set screw of this invention.
FIG. 95 is a side view of a fully threaded set screw of this invention.
FIG. 96 depicts cross-sectioned side views of blade-stops washers of this invention of FIGS. 79–83.
FIG. 97 depicts cross-sectioned side views of blade-stops washers of this invention of FIG. 90.

FIGS. 91–97 illustrate another example of cutting diameter selection means as according to this invention and another example of blade abutting surface change means as according to this invention. FIG. 91 illustrates a blade-opening arrowhead 222 which is similar to arrowhead 220 as illustrated in FIGS. 86–90 except arrowhead 222 utilizes straight hinge pins such as a partially threaded set screw 320 (FIG. 94) and/or a fully threaded set screw 322 (FIG. 95) for hinge means, an arrowhead body 612 having a plurality of blade slots 632 and a hinge pin through hole 690 for each blade 708. Through holes 690 are threaded so as to threadably receive a corresponding number of set screws 320 or set screws 322 therein when pivotally connecting blades 708 to arrowhead body 612. When blade-stop washers 830–838 and/or blade-stop washers 810–818 are individually removably attached to arrowhead body 612 a pivotal blade such as a blade 708 will define a different cutting diameter when abutting against each different corresponding sloped blade abutting surface. It is apparent that arrowhead preferred embodiments as according to this invention such as arrowhead 222 may be attached to an arrowshaft without a blade-stop washer mounted thereon such that a rear section 699*b* or equivalent of arrowhead body 612, or other arrowheads as according to this invention, contacts the corresponding arrowshaft or arrowshaft insert directly and thereby acts as the arrowshaft contacting surface of the arrowhead.

Figure 98:
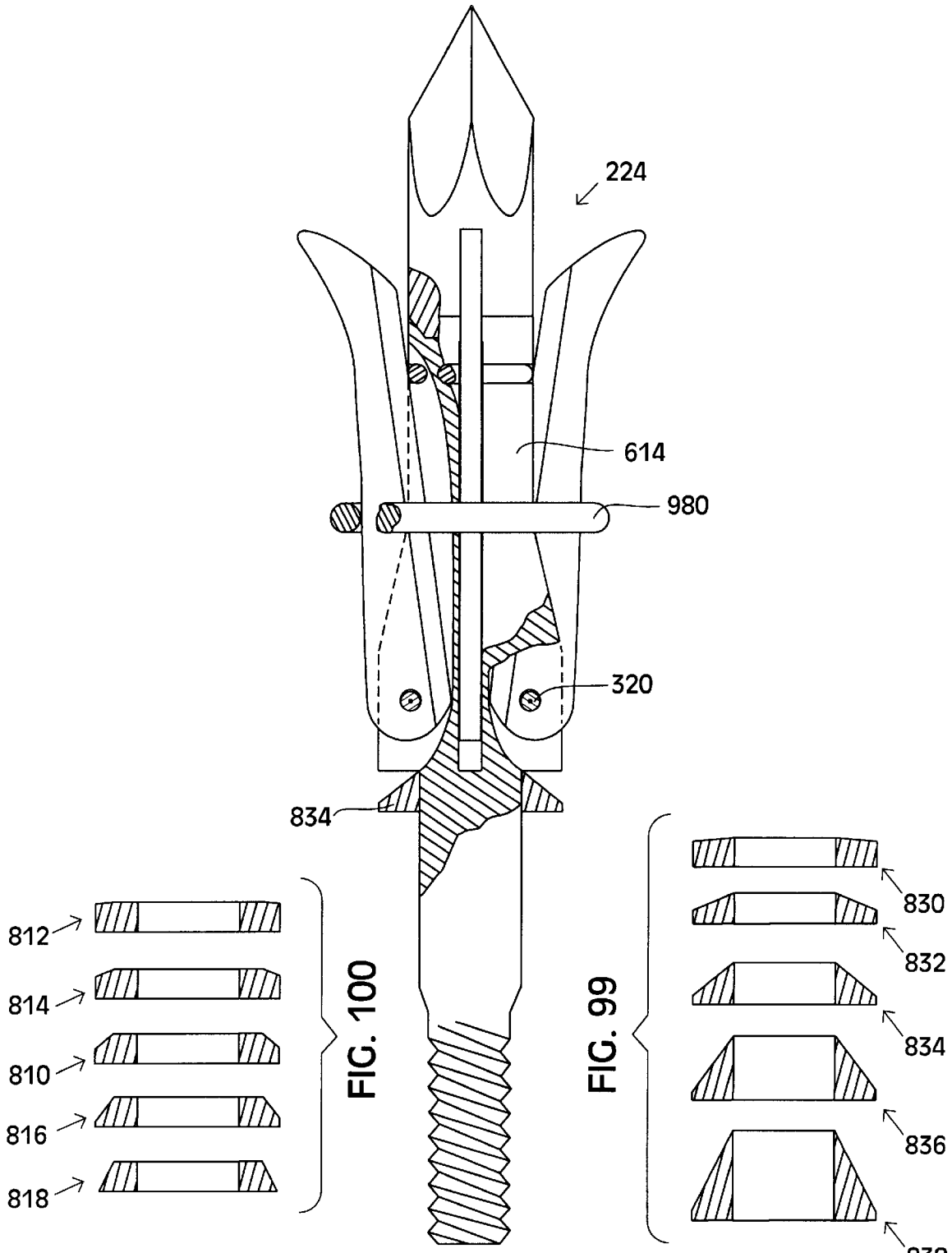
FIG. 98 is a partial sectioned side view of another arrowhead as according to this invention.

FIGS. 98–100 illustrate a blade-opening arrowhead 224 which is similar to arrowhead 222 except arrowhead 224 utilizes an arrowhead body 614, set screws 320 for hinge means and a conventional O-ring for blade retention like unto arrowhead 218 as illustrated in FIG. 84.

Figures 101, 102, 103, 104, 105, 106, 107:
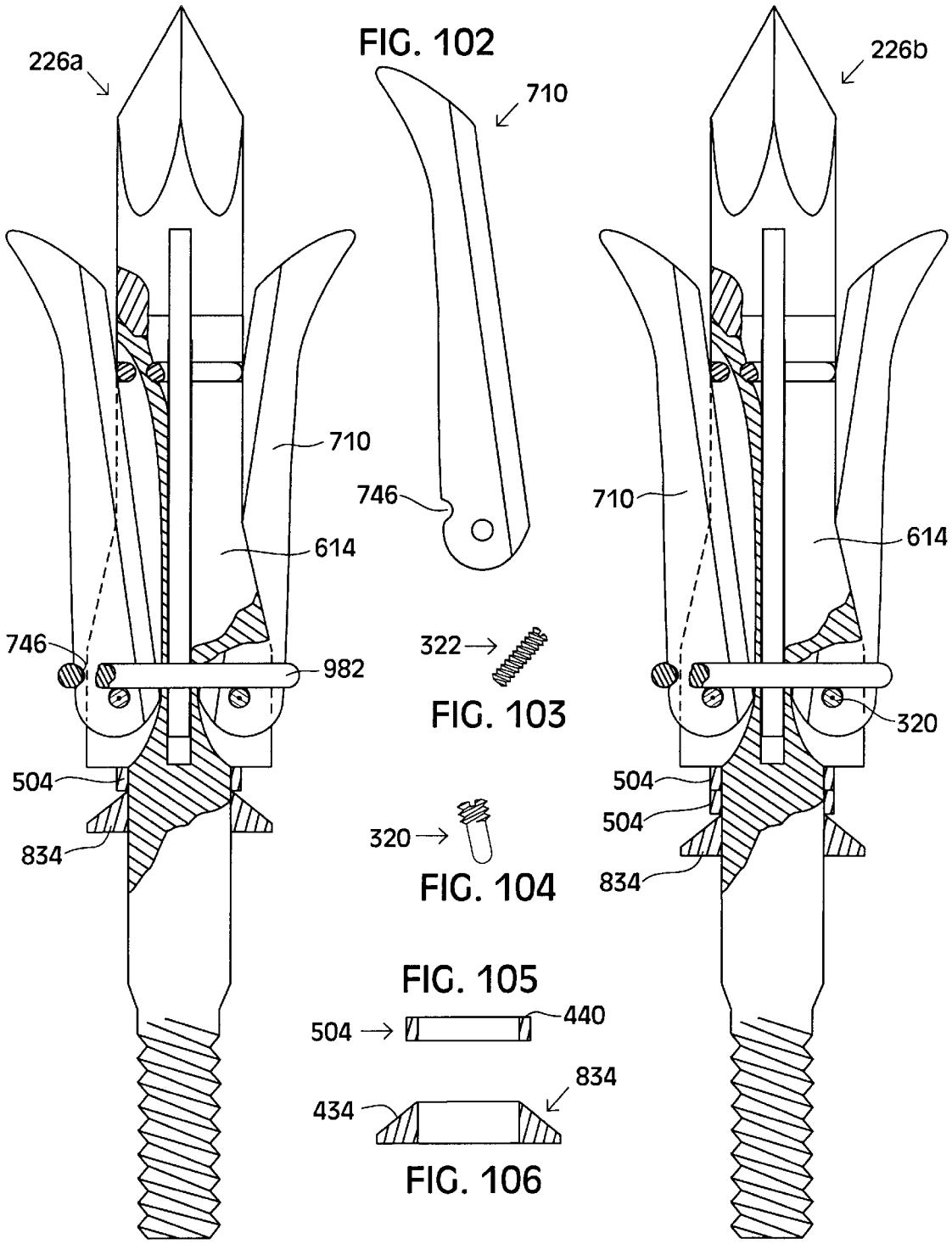
FIG. 101 is a partial sectioned side view of another arrowhead as according to this invention.
FIG. 102 is a side view of another pivotal blade as according to this invention.
FIG. 103 is a side view of a fully threaded set screw of this invention.
FIG. 104 is a side view of a partially threaded set screw of this invention.
FIG. 105 is a cross-sectional side view of a displacer element of this invention.
FIG. 106 is a cross-sectional side view of a blade-stop washer of this invention.
FIG. 107 is a partial sectioned side view of another arrowhead as according to this invention.

FIGS. 101–107 illustrate yet still another example of cutting diameter selection means as according to this invention and yet still another example of blade abutting surface change means as according to this invention. FIG. 101 illustrates a blade-opening arrowhead 226*a* and FIG. 107 illustrates a blade-opening arrowhead 226*b* which are similar to arrowhead 224 as illustrated in FIG. 98 except arrowheads 226*a*/226*b* utilize a plurality of blades 710 each having a notch 746 for removably receiving an annular resilient member 982 such as a conventional rubber O-ring for blade retention. Arrowhead 226*a* yet further differs from arrowhead 224 in that arrowhead 226*a* utilizes an extender element 504 for displacing blade-stop washer 834 and accompanying blade abutting surface 434 to a different spatial location relative to arrowhead body 614 than the location blade-stop washer 434 would of been located at without extender element 504 attached therewith. Particularly, arrowhead 226*a* as illustrated in FIG. 101 will define a narrower cutting diameter when in a penetrating configuration than would the arrowhead when extender element 504 is removed and blades 710 are in abutment with blade stop-washer 834. Arrowhead 226*b* yet further differs from arrowhead 224 and arrowhead 226*a* in that arrowhead 226*b* utilizes two extender elements 504 for displacing blade stop washer 834 and accompanying blade abutting surface 434 to yet a different spatial location relative to arrowhead body 614 than the location blade-stop washer 434 would of been located at with one extender element 504 or without any extender elements 504 therewith. Particularly, arrowhead 226*b* as illustrated in FIG. 107 will define a narrower cutting diameter than will arrowhead 226*a* because blade abutting surface 834 is located further from hinge means 320 of arrowhead 226*b* than of arrowhead 226*a*. Extender element 504 as illustrated in FIG. 105 has a blade abutting surface 440, that in the absence of a blade-stop washer such as blade-stop washer 834 could limit the rotation of corresponding pivotal blades 710 when rotating to the open position so as to define yet a different cutting diameter of the arrowhead. Although arrowheads 226*a* & 226*b* are referenced herein by different reference numerals it is to be noted that in general arrowheads 226*a* & 226*b* are substantially the same arrowhead (but not limited thereto) other than the attachment of different numbers of extender elements 504 therewith as has been heretofore discussed.

Figures 113, 114, 115, 116, 117:
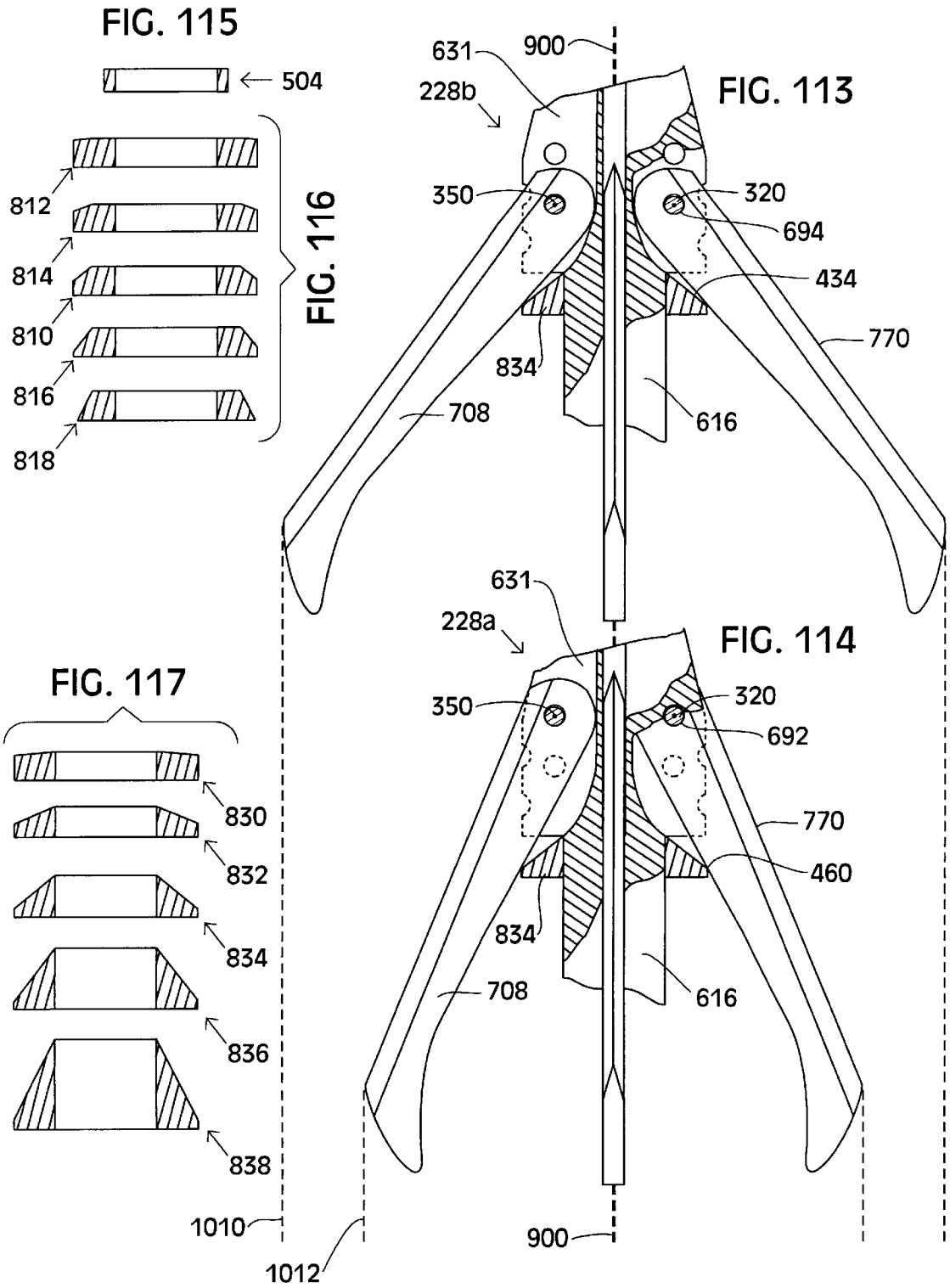
FIG. 113 is a partial sectioned partial length side view of an arrowhead similar to the arrowhead as illustrated in FIG. 108 in a penetrating configuration.
FIG. 114 is a partial sectioned partial length side view of the arrowhead of FIG. 108 in a penetrating configuration.
FIG. 115 is a cross-sectional side view of the displacer element of FIG. 105.
FIG. 116 shows cross-sectioned side views of blade-stops washers of this invention of FIGS. 79–83.
FIG. 117 depicts cross-sectioned side views of blade-stops washers of this invention of FIG. 90.

FIGS. 108–117 illustrate yet still another example of cutting diameter selection means as according to this invention and yet still another example of hinge means relocation means as according to this invention. FIG. 108 illustrates a blade-opening arrowhead 228*a* which is similar to arrowhead 222 as illustrated in FIG. 91 except arrowhead 228*a* has an arrowhead body 616 which has a pair of axially spaced apart hinge pin through holes 692 & 694 for each pivotal blade 708 to be selectively removably attached in a corresponding blade slot 631 respectively, and a pair of axially spaced apart externally exposed annular grooves 682 & 684 for removably receiving annular retention member 982 therein for blade retention. Hinge pin through holes 692 and 694 are substantially equidistantly displaced from central longitudinal axis 900 of arrowhead body 616. Partially threaded set screws 320 removably attach blades 708 to arrowhead body 616 by being received in hinge pin through holes 692 of slots 631 of arrowhead 228*a* as illustrated in FIGS. 108 & 114, whereas partially threaded set screws 320 removably attach blades 708 to arrowhead body 616 by being received in hinge pin through holes 694 of slots 631 of arrowhead 228*b* as illustrated in FIG. 113. As specifically illustrated in FIGS. 113 & 114 arrowhead 228*b* defines a cutting diameter 1010 and arrowhead 228*a* defines a different cutting diameter 1012 as is according to the hinge means relocation means and cutting diameter selection means of this invention. As is apparent from FIGS. 115–117 by use of extender elements or equivalents such as extender element 504 and/or a plurality of different sloped blade abutting surface blade-stop washers as has been taught herein, arrowheads 228*a* & 228*b* could yet further define other different cutting diameters than cutting diameters 1010 & 1012. Although arrowheads 228*a* & 228*b* are referenced herein by different reference numerals it is to be noted that in general arrowheads 228*a* & 228*b* are substantially the same arrowhead (but not limited thereto) other than the attachment of the hinge means in different locations upon arrowhead body 616 as has been heretofore discussed.

It is apparent that arrowheads 228*a* & 228*b* and other arrowheads as according to this invention could have a plurality of hinge pin through holes that communicate with one blade slot wherein the plurality of hinge pin through holes comprises at least three such hinge pin through holes or more, so as to enable a pivotal blade to be rotatably connected or hinged to a corresponding arrowhead body at more than two different spatial locations within the blade's corresponding blade slot.

Figure 118:
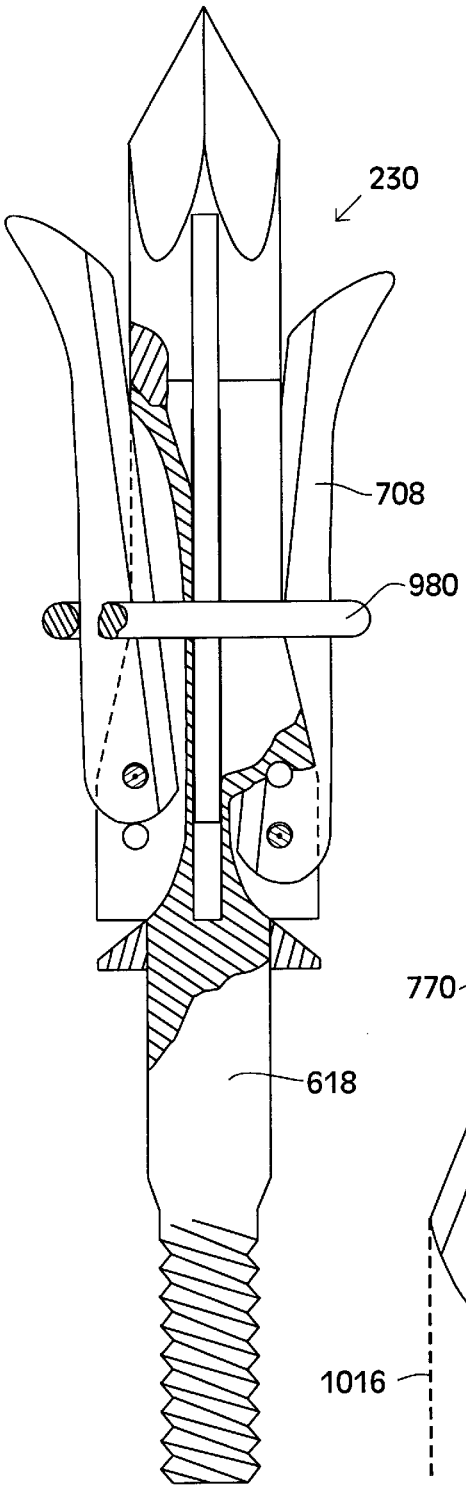
FIG. 118 is a partial sectioned side view of another arrowhead as according to this invention.
Figure 119:
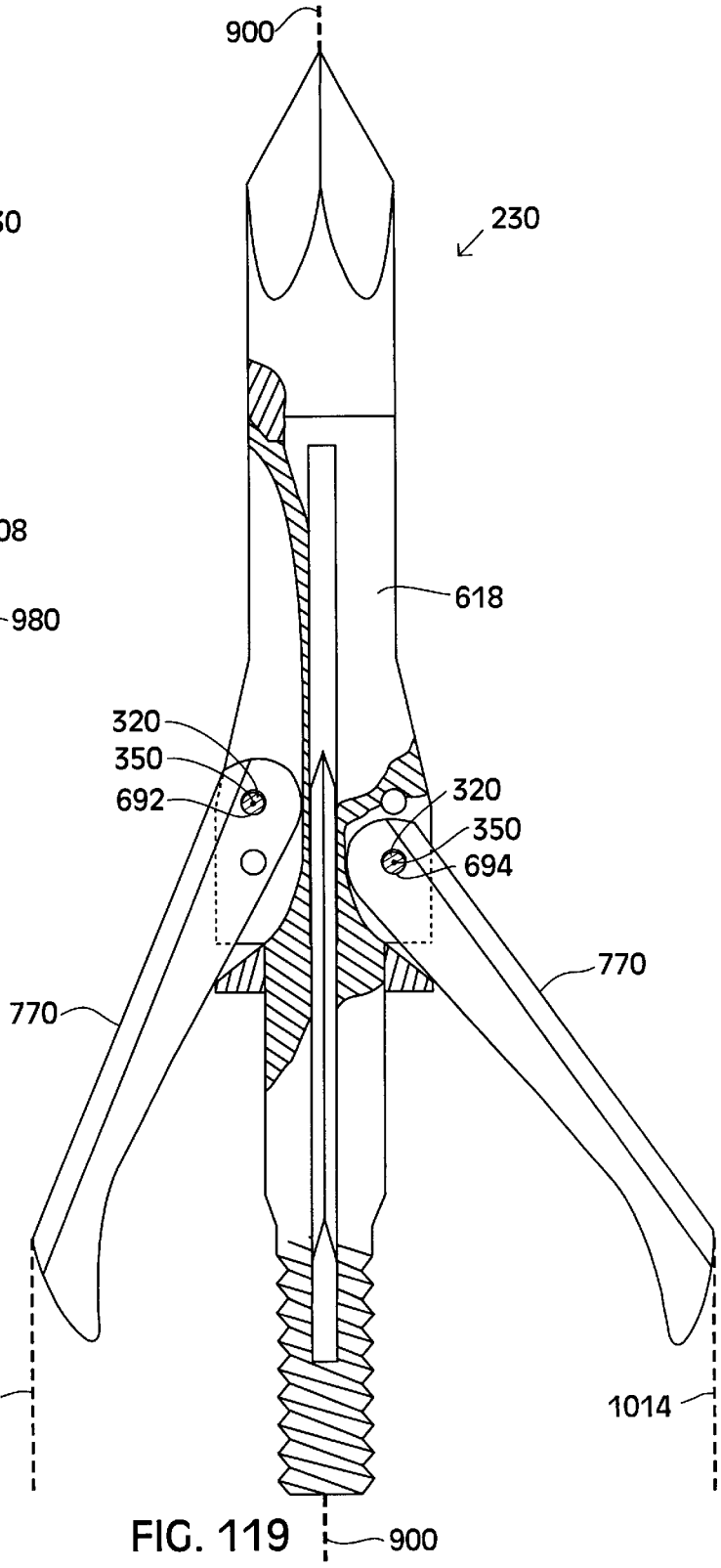
FIG. 119 is a partial sectioned side view of the arrowhead of FIG. 118 in a penetrating configuration.

FIGS. 118 & 119 illustrate a blade-opening arrowhead 230 which is similar to arrowheads 228*a*/228*b* except arrowhead 230 utilizes conventional O-ring 980 stretched around the outside of blades 708 for blade retention. Arrowhead 230 as illustrated in FIG. 119 has a blade 708 pivotally attached or connected to an arrowhead body 618 thereof at a hinge pin through hole 694 so as to define a cutting diameter 1014, while concomitantly having at least one other blade 708 pivotally connected to a hinge pin through hole 692 so as to define a different cutting diameter 1016.

Figure 120:
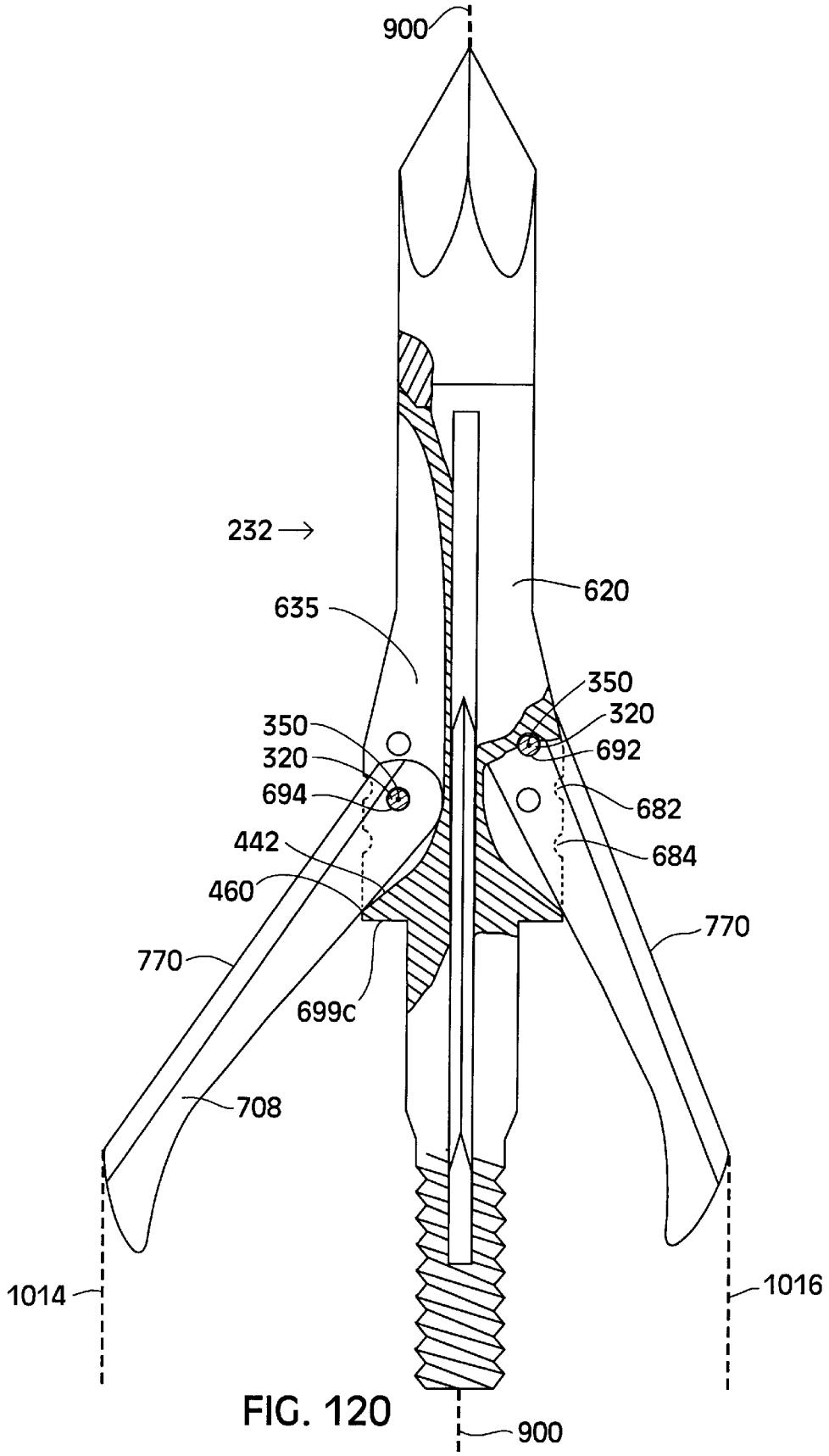
FIG. 120 is a partial sectioned side view of another arrowhead as according to this invention.

FIG. 120 illustrates a blade-opening arrowhead 232 which is similar to arrowheads 228*a* & 228*b* except arrowhead 232 has an arrowhead body 620 that has an integral blade abutting surface 442 for each blade 708 to abut thereagainst when the arrowhead is in a penetrating configuration. Each integral blade abutting surface 442 is substantially a section of a blade slot 635 of arrowhead body 620. Arrowhead 232 has an integral arrowshaft abutting surface 699*c* that is integral with arrowhead body 620. Arrowhead 232 is also capable of having at least two same shaped pivotal blades attached therewith at the same time so as to each define a different cutting diameter.

Figure 121:
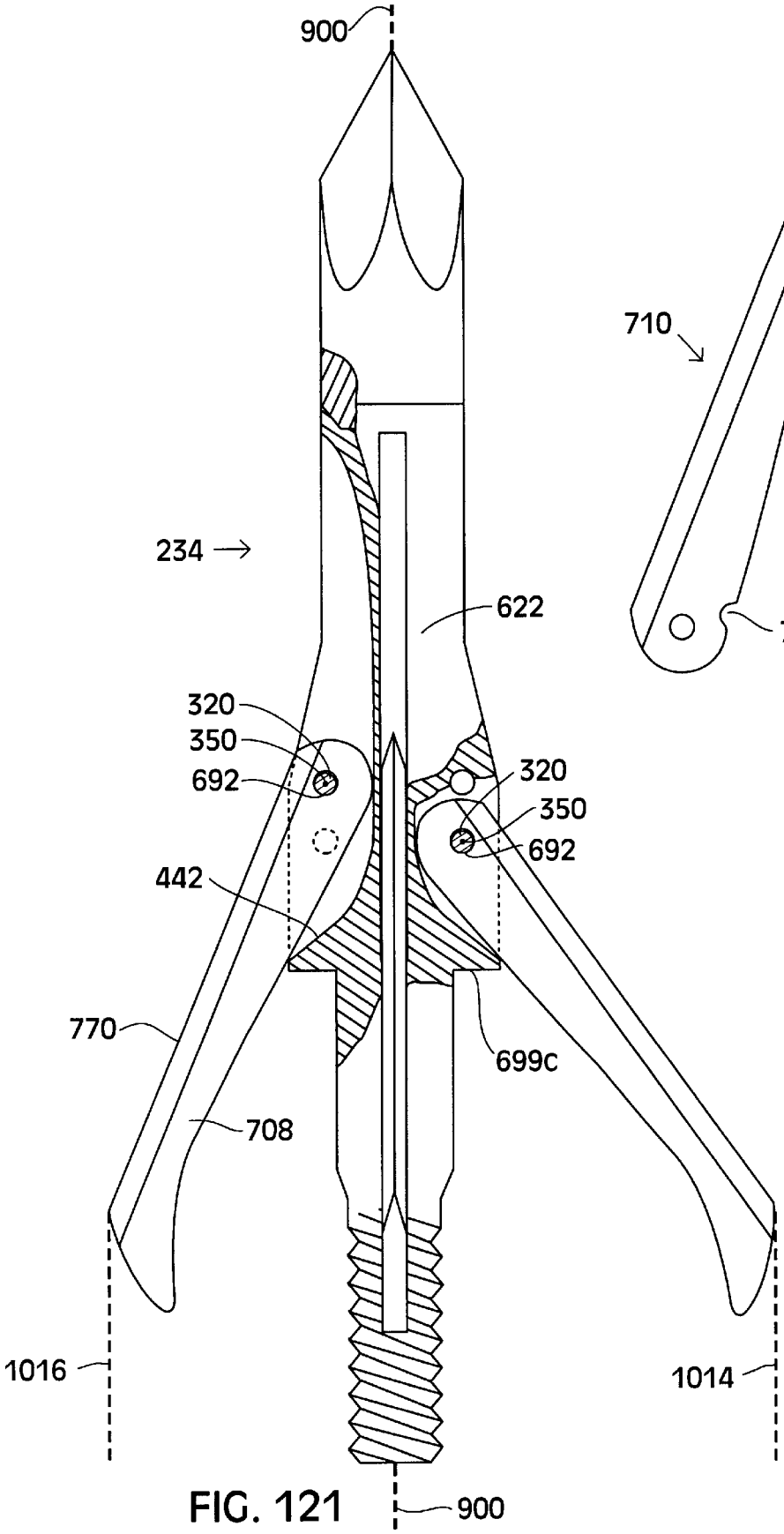
FIG. 121 is a partial sectioned side view of another arrowhead as according to this invention.
Figure 122:
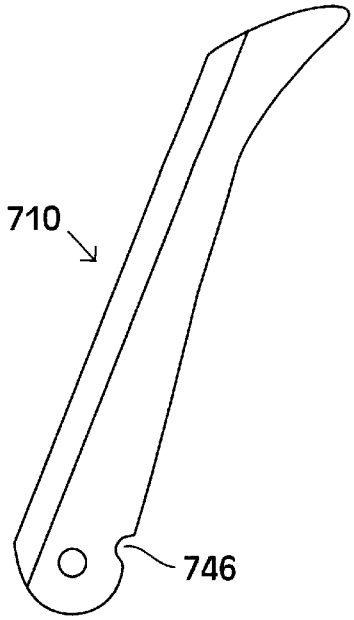
FIG. 122 is a side view of the pivotal blade of FIG. 102.
Figure 125:
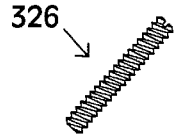
FIG. 125 is a side view of a fully threaded set screw of this invention.
Figure 126:
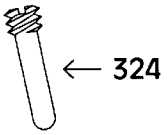
FIG. 126 is a side view of a partially threaded set screw of this invention.
Figure 127:
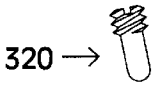
FIG. 127 is a side view of a partially threaded set screw of this invention.
Figure 128:
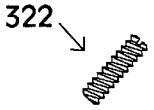
FIG. 128 is a side view of a fully threaded set screw of this invention.

FIG. 121 illustrates a blade-opening arrowhead 234 which is similar to arrowhead 232 except arrowhead 234 has an arrowhead body 622 and utilizes a conventional O-ring which is stretched around the outside of blades 708 when blades 708 are in the closed position, as for example as is illustrated in FIG. 98 with arrowhead 224 as is according to this invention. FIG. 122 illustrates that a plurality of blades 710 each having a notch 746 may be used with an arrowhead body 622 so as to provide a blade-opening arrowhead having an annular resilient member for blade retention such as annular resilient member 982 is particularly depicted in FIGS. 101 & 107 with arrowheads 226*a* & 226*b* respectively. It is apparent that annular resilient member 982 while received in notches 746 of blades 710 when an accompanying arrowhead is in a closed in-flight position could also be received at least in part simultaneously in an externally exposed annular groove fabricated upon an accompanying arrowhead body.

Figure 123:
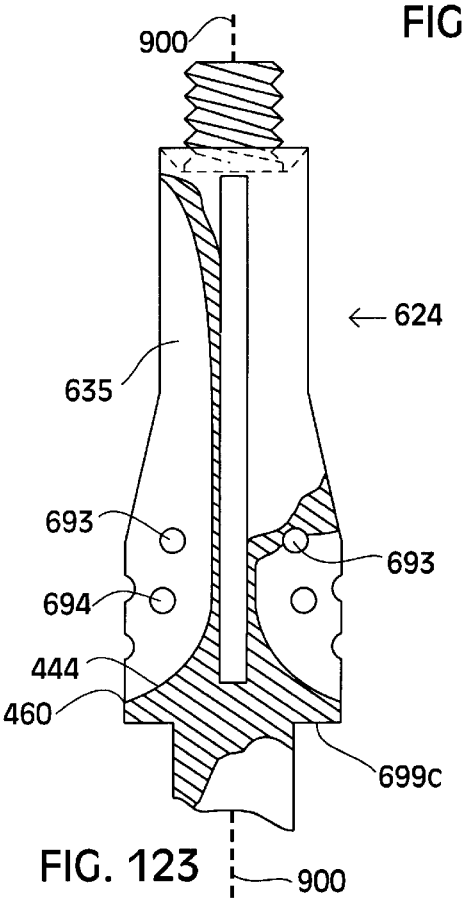
FIG. 123 is a partial length partial sectioned side view of an arrowhead body of this invention.

FIG. 123 illustrates an arrowhead body 624 capable of producing an arrowhead or arrowheads that define a plurality of different cutting diameters with a single blade or a plurality of same shaped blades as is according to at least some of the preferred embodiments of this invention. Arrowhead body 624 is similar to arrowhead body 620 of arrowhead 232 except arrowhead body 624 has a plurality of hinge pin through holes 693 that are displaced closer to central longitudinal axis 900 than are hinge pin through holes 694 located therebelow (as compared to the spatial arrangement of through holes 692 & 694 of arrowhead 232). Each hinge pin through hole 693 is located substantially an equal shortest distance from central longitudinal axis 900 as each other hinge pin through hole 693. Each hinge pin through hole 694 is located substantially an equal shortest distance from central longitudinal axis 900 as each other hinge pin through hole 694. And each hinge pin through hole 692, as has been illustrated with previous arrowhead embodiments of this invention, is located substantially an equal shortest distance from central longitudinal axis 900 as each other hinge pin through hole 692.

Figure 124:
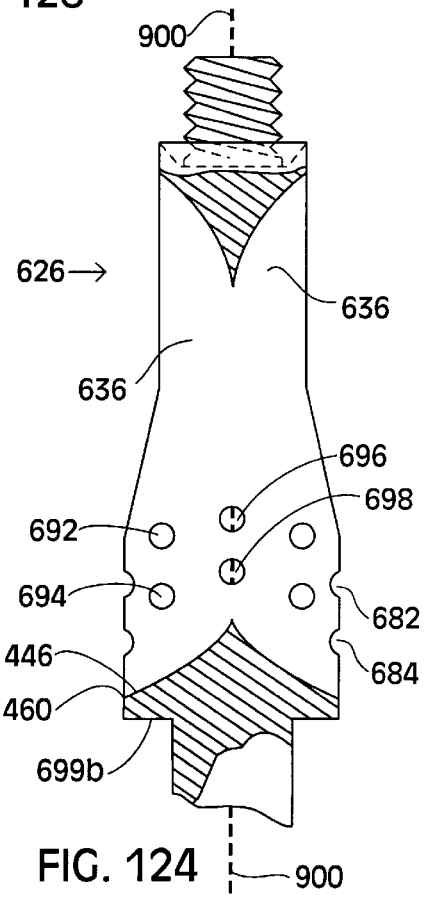
FIG. 124 is a partial length partial sectioned side view of an arrowhead body of this invention.
Figure 130:
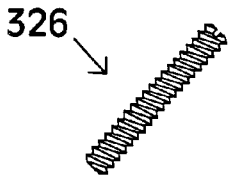
FIG. 130 is a side view of a fully threaded set screw of this invention.
Figure 131:
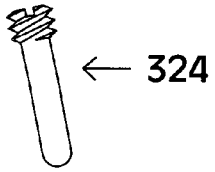
FIG. 131 is a side view of a partially threaded set screw of this invention.

FIG. 124 illustrates an arrowhead body 626 capable of producing an arrowhead or arrowheads which can define a plurality of different cutting diameters as is according to this invention. Arrowhead body 626 has a hinge pin through hole 696 and a hinge pin through hole 698 that substantially intersect with central longitudinal axis 900. The pivotal blades used with arrowhead body 626 may be selectively retained or held in the closed in-flight position by an annular resilient member being seated in either externally exposed annular grooves 682 & 684 and/or stretched around the outside of the blades thereupon. As illustrated in FIGS. 125–128 it is apparent that the hinge pin through holes 692, 694, 696 & 698 of arrowhead body 626 are capable of receiving various length hinge pins, such as a longer partially threaded set screw 324 and/or a longer fully threaded set screw 326 in addition to set screws 320 & 322 which have heretofore been illustrated. Arrowhead body 626 has a plurality of two blade slots 636 that communicate with each other wherein each blade slot is preferably substantially the thickness of at least two corresponding blades so that two corresponding pivotal blades may be hingedly connected to arrowhead body 626 at each hinge pin through hole within slots 636. Arrowheads as according to this invention having an arrowhead body similar to arrowhead body 626 except having at least one additional blade slot that is substantially the thickness of only one corresponding blade so as to pivotally house only one blade at a time therein are envisioned to be within the scope of this invention as well.

Figure 129:
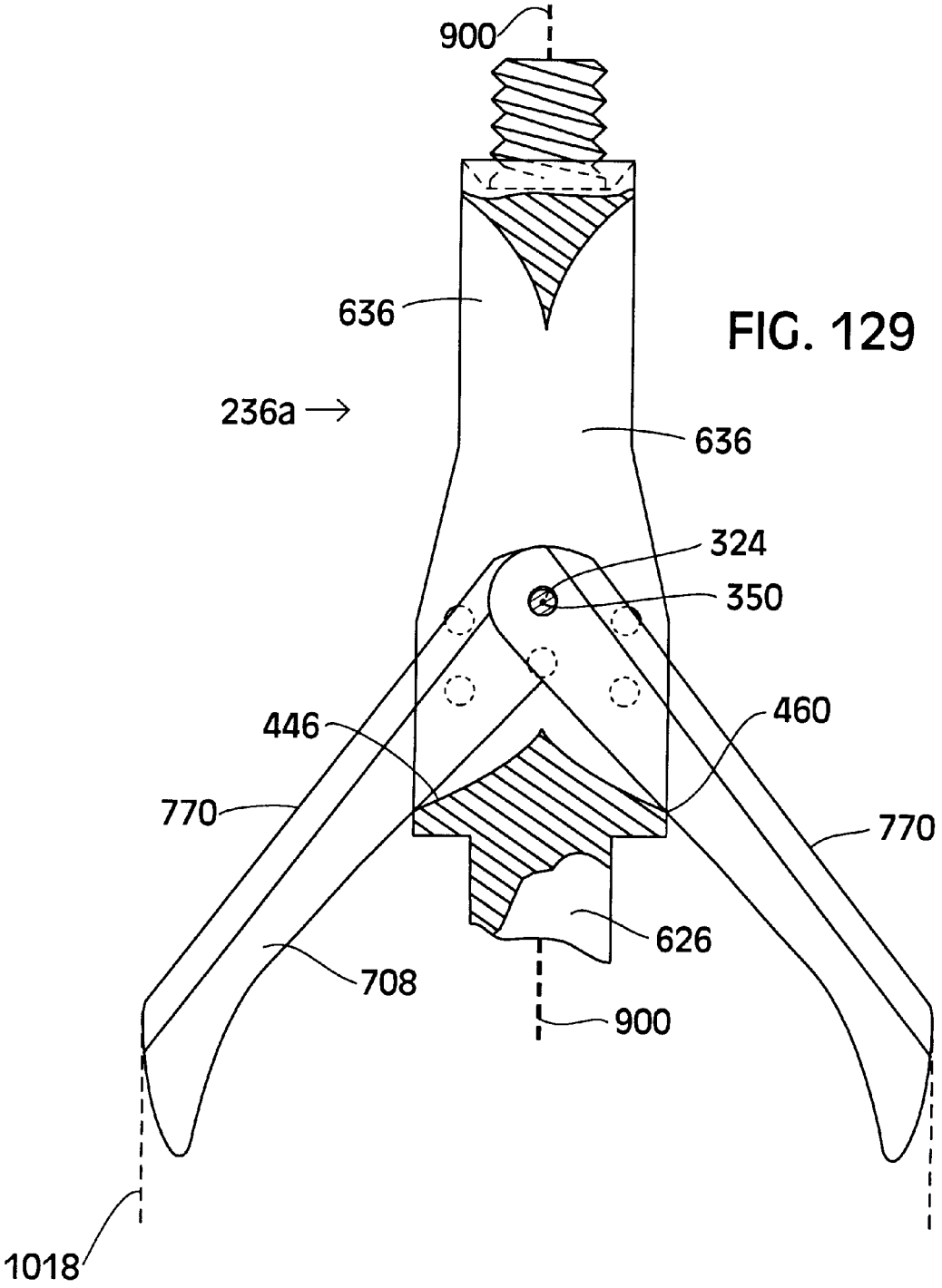
FIG. 129 is a partial sectioned side view of another arrowhead as according to this invention.
Figure 133:
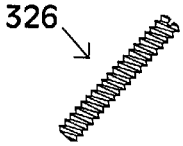
FIG. 133 is a side view of a fully threaded set screw of this invention.
Figure 134:
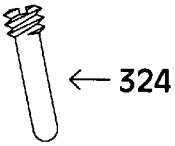
FIG. 134 is a side view of a partially threaded set screw of this invention.
Figure 135:
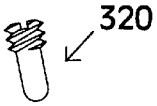
FIG. 135 is a side view of a partially threaded set screw of this invention.
Figure 136:
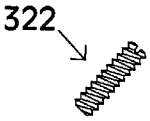
FIG. 136 is a side view of a fully threaded set screw of this invention.

As is illustrated in FIG. 129 an arrowhead 236*a* defines a cutting diameter 1018 utilizing a plurality of two pivotal blades 708 hingedly or pivotally attached to arrowhead body 626. Arrowhead 236*a* utilizes a conventional rubber O-ring that is stretched around the outside of blades 708 for blade retention, and blades 708 when in the open penetrating configuration as illustrated in FIG. 129 abut against integral blade abutting surface 446.

Figure 137:
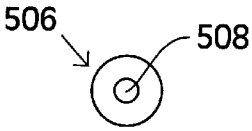
Figure 132:
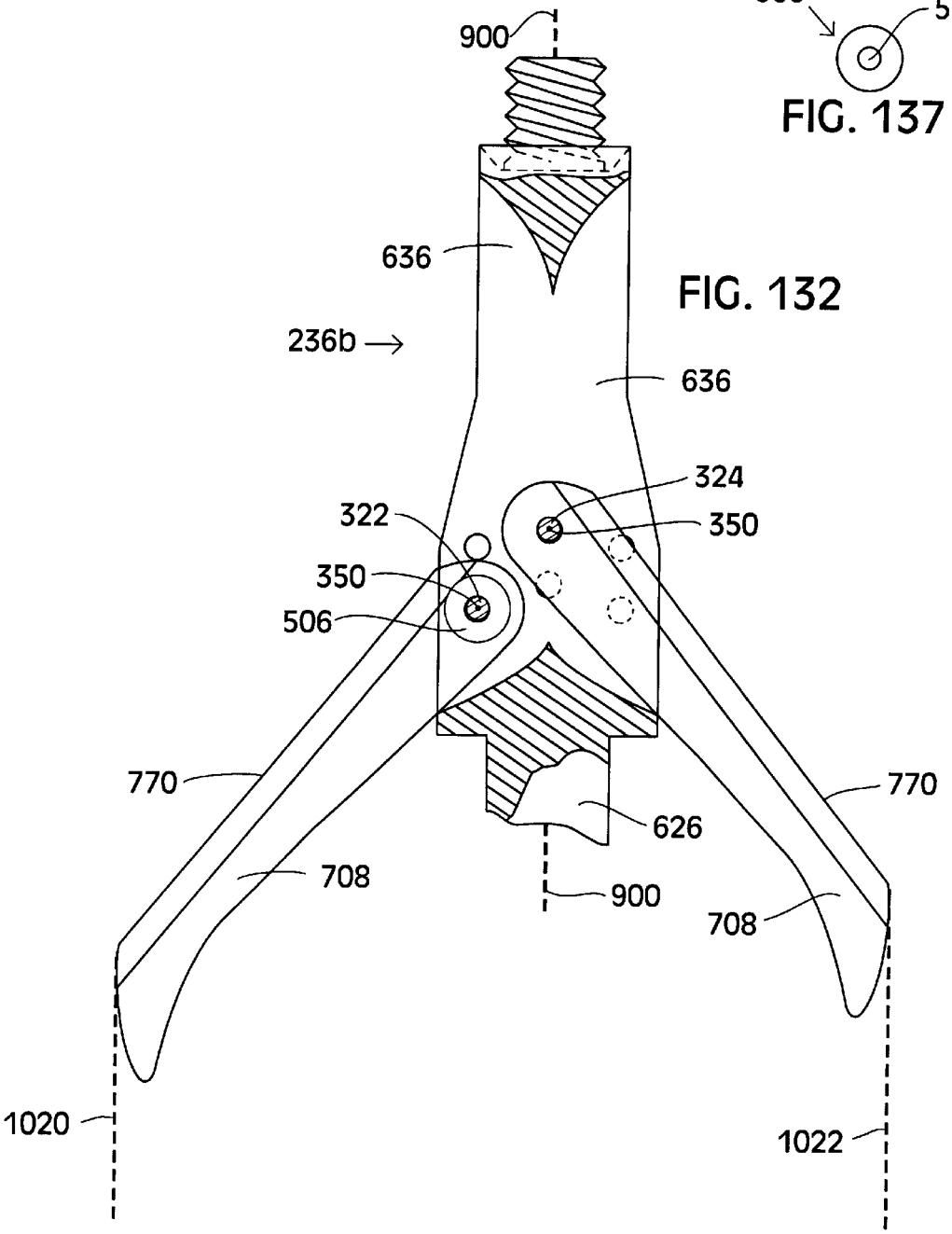
FIG. 132 is a partial sectioned side view of another arrowhead as according to this invention.

As is illustrated in FIG. 132 an arrowhead 236*b* defines a cutting diameter 1020 and a cutting diameter 1022 simultaneously with arrowhead body 626 and a plurality of two pivotal blades 708. Arrowhead 236*b* is identical to arrowhead 236*a* of FIG. 129 except for the relocation of corresponding hinge means (set screws) and therefore the different spatial orientation of blades 708 therewith. FIG. 137 depicts a slot washer 506 that is substantially the thickness of a pivotal blade which when attached to a hinge pin and housed within an arrowhead body blade slot adjacent to a pivotal blade, slot washer 506 ensures a snug and wobble free fit of the pivotal blade in slot 636 as is illustrated in FIG. 132. Slot washer 506 has a hinge pin aperture 508 for receiving a set screw therethrough.

FIGS. 138–150 illustrate yet still further other preferred arrowhead embodiments as according to this invention. As is illustrated in FIG. 138 an arrowhead body 628 has recessed annular groove 670 for receiving annular blade rings and/or filler elements (such as is illustrated in FIGS. 141–144). Arrowhead body 628 also has a plurality of two hinge pin through holes 692 & 694 formed in each corresponding blade slot thereof for receiving a set screw or straight hinge means. Arrowhead body 628 is capable of utilizing a variety of different blade retention methods for selectively retaining corresponding pivotal blades in the closed in-flight position, such as conventional O-rings, other annular resilient members and compression spring 970 with accompanying notch ring 960 and blade stop washer 800 as is illustrated in FIG. 145. Arrowhead body 628 when producing arrowheads that achieve at least some of the desired results as according to this invention is enabled to utilize a variety of different pivotal blades therewith, such for example as is illustrated in FIGS. 146–148. FIG. 147 illustrates a blade 712 which has a notch 748 located a substantial distance away from a hinge pin aperture 723 thereof for removably receiving an annular resilient blade retention member such as a conventional O-ring when the arrowhead is in a corresponding closed in-flight position. FIGS. 149 & 150 yet illustrate that different sloped blade abutting surfaces when associated with arrowhead body 628 in the various different possible combinations thereof will produce an arrowhead or arrowheads capable of defdefining yet even a greater number of different cutting diameters with a singe blade (but not limited thereto) as is according to this invention.

The arrowheads as according to this invention overcome deficiencies inherent in prior art arrowheads in that the ability to produce more than one cutting diameter with the use of a single blade, or a plurality of same shaped blades is provided so that a single arrowhead is capable of obtaining deeper penetration with narrower cutting diameters as well as increased tissue volume cutting with wider cutting diameters thereof.

Although the preferred embodiments of this invention have been depicted as having a plurality of two, three or four blades each, it is apparent that the arrowheads according to this invention may have any number of pivotal blades. Although the preferred embodiments of this invention have been depicted as having pivotal blades and accompanying blade slots substantially in radial alignment with the central longitudinal axis of corresponding arrowhead bodies it is apparent that the arrowheads as according to this invention may have non-radially aligned pivotal cutting blades and corresponding blade slots which also may be non-radially aligned therewith. It is apparent that the arrowheads as according to this invention may have blade slots and/or blades that are oriented in a plane inclined relative to their corresponding arrowhead body central longitudinal axises such as is taught in my U.S. patent application Ser. No. 08/858,096 filed May 21, 1997, which is incorporated herein by specific reference. It is apparent that the arrowheads as according to this invention may have fixed blades attached therewith.

The arrowheads according to this invention having pivotal blades may be blade-opening arrowheads which are commonly known in the industry as mechanical broadheads, or may be non blade-opening arrowheads.

Although the arrowheads of this invention have been depicted with having removably attachable arrowhead tips, it is apparent that substantially non-removably attached arrowhead tips, and other types of removably attachable arrowhead tips, and integrally fabricated arrowhead tips (such as arrowheads where the major portion of each arrowhead body and arrowhead tip are fabricated from a single piece of stock) are applicable to the scope of this invention.

It is apparent that the different and various elements of this invention may be made of light weight and strong materials, such as composites, organic polymers, resilient materials, aluminum alloys, titanium alloys, stainless steels, steels and other metals and materials. It is also apparent that the arrowhead bodies of the arrowheads of this invention may be fastened to the forward end of an arrow shaft or equivalent by any method, such as threading into an insert, or glueing thereon.

It is apparent that the different parts and elements and their equivalents of the arrowheads of this invention, as discussed above and according to other preferred embodiments of this invention, can be changed, or interchanged, or eliminated, or duplicated, or made of different materials, and connected to or associated with adjacent elements in different manners, other than suggested herein, without deterring from the desired results of the arrowheads of this invention. For example, arrowheads having at least in part features as disclosed in this specification may be combined with features of the embodiments and spirit of the arrowheads and cutting tips incorporated herein by specific reference.

It is to be understood that the present invention is not limited to the sole embodiments described above, as will be apparent to those skilled in the art, but encompasses the essence of all embodiments, and their legal equivalents, within the scope of the following claims.

I claim:

1. An arrowhead comprising:

(a) an arrowhead body having a central longitudinal axis; and (b) a pivotal cutting blade rotatably mounted to said arrowhead body such that when the arrowhead is penetrating an object said blade abuts against a blade-stop surface so that a furthest cutting section of said blade from said central longitudinal axis is disposed a first shortest distance from said central longitudinal axis, said arrowhead being enabled to have said furthest cutting section of said blade disposed at a second different shortest distance from said central longitudinal axis when said blade is rotatably mounted to said arrowhead body and is abutting against a blade-stop surface when the arrowhead is penetrating an object.

2. An arrowhead as recited in claim 1 wherein when said furthest cutting section of said blade is disposed at said first shortest distance said blade is oriented at a substantially different angle with respect to said central longitudinal axis than the angle said blade is oriented at with respect to said central longitudinal axis when said furthest cutting section of said blade is disposed at said second shortest distance.

3. An arrowhead as recited in claim 1 wherein said arrowhead is a blade-opening arrowhead.

4. An arrowhead as recited in claim 3 wherein said pivotal blade rotates in a rearward direction when rotating from a closed in-flight configuration to an open penetrating configuration.

5. An arrowhead as recited in claim 1 wherein the difference between said first shortest distance and said second shortest distance enables the arrowhead to define cutting diameters that differ from each other by at least 1/64th of an inch.

6. An arrowhead as recited in claim 1 further comprising a blade slot having a first hinge pin receiving hole and a second hinge pin receiving hole communicating therewith.

7. An arrowhead as recited in claim 1 wherein said blade is rotatably mounted to said arrowhead body by an annular ring having at least one bump formed thereon.

8. An arrowhead as recited in claim 7 further comprising a plurality of different shaped blade-stop washers, each said blade-stop washer having a different sloped blade abutting surface, and each said blade-stop washer being individually removably attachable with said arrowhead body.

9. An arrowhead as recited in claim 8 wherein each said different shaped blade-stop washer when individually attached to said arrowhead body enables said pivotal blade, when rotatably mounted to said arrowhead body, to define at least two cutting diameters.

10. An arrowhead as recited in claim 1 further comprising a plurality of said blades.

11. An arrowhead as recited in claim 9 further comprising a plurality of said blades, said annular ring having the same number of bumps formed thereon as the number of blades in said plurality of blades.

12. An arrowhead comprising:

(a) an arrowhead body having a central longitudinal axis;

(b) a pivotal blade having a cutting edge, said pivotal blade being exposed from only one side of said arrowhead body when the arrowhead is in an in-flight configuration and when the arrowhead is in a penetrating configuration;

(c) hinge means for pivotally connecting said blade to said arrowhead body so as to enable said blade to rotate relative to said arrowhead body; and (d) cutting diameter selection means for enabling said pivotal blade to define a plurality of different cutting diameters.

13. An arrowhead as recited in claim 12 wherein said hinge means comprises an aperture in said blade and a hinge pin extending through said aperture.

14. An arrowhead as recited in claim 13 wherein said hinge means comprises a blade ring.

15. An arrowhead as recited in claim 13 wherein said hinge means comprises a set screw.

16. An arrowhead as recited in claim 13 further comprising a plurality of said blades.

17. An arrowhead as recited in claim 12 wherein said cutting diameter selection means comprises hinge means relocation means for enabling said hinge means to be positioned at a plurality of different spatial locations relative to said arrowhead body.

18. An arrowhead as recited in claim 12 wherein said cutting diameter selection means comprises abutting surface change means for changing the spatial orientation of an abutting surface, relative to the arrowhead, that said blade abuts against when defining a cutting diameter.

19. An arrowhead as recited in claim 13 wherein said arrowhead further comprises a second blade having a different three dimensional shape than said pivotal blade and having a cutting edge such that when said second blade is pivotally connected to said arrowhead body said second blade is enabled to define at least one cutting diameter that is different than said plurality of cutting diameters definable by said pivotal blade.

20. An arrowhead comprising:

(a) an arrowhead body having a central longitudinal axis;

(b) a pivotal blade having a cutting edge;

(c) hinge means for pivotally connecting said blade to said arrowhead body so as to enable said blade to rotate relative to said arrowhead body, said hinge means being mounted to said arrowhead body such so as to not intersect said central longitudinal axis; and (d) cutting diameter selection means for enabling said pivotal blade to define a plurality of different cutting diameters.

21. An arrowhead as recited in claim 20 wherein said arrowhead is a blade-opening arrowhead.

22. An arrowhead as recited in claim 21 wherein said pivotal blade rotates in a rearward direction when rotating from a closed in-flight configuration to an open penetrating configuration.

23. An arrowhead as recited in claim 22 wherein said hinge means comprises an aperture in said blade and a hinge pin extending through said aperture.

24. An arrowhead as recited in claim 20 further comprising a plurality of said blades.

25. An arrowhead as recited in claim 24 wherein said plurality of pivotal blades comprises two said pivotal blades.

26. An arrowhead as recited in claim 24 wherein said plurality of pivotal blades comprises three said pivotal blades.

27. An arrowhead as recited in claim 24 wherein said plurality of pivotal blades comprises four said pivotal blades.

28. An arrowhead as recited in claim 20 wherein said cutting diameter selection means comprises hinge means relocation means for enabling said hinge means to be positioned at a plurality of different spatial locations relative to said arrowhead body.

29. An arrowhead as recited in claim 20 wherein said cutting diameter selection means comprises abutting surface change means for changing the spatial orientation of an abutting surface, relative to the arrowhead, that said blade abuts against when defining a cutting diameter.

30. An arrowhead comprising:

(a) an arrowhead body having a central longitudinal axis;

(b) a plurality of pivotal blades each having a cutting edge;

(c) hinge means for pivotally connecting each said blade to said arrowhead body so as to enable said blades to rotate relative to said arrowhead body, said arrowhead being configured such that a first line, perpendicular to the cutting edge of a first said blade, that intersects a cross-sectional center of the hinge means pivotally connecting said first blade to said arrowhead body is not collinear with a second line, said second line being perpendicular to the cutting edge of a second said blade and intersecting a cross-sectional center of the hinge means pivotally connecting said second blade to said arrowhead body; and (d) cutting diameter selection means for enabling said pivotal blades to define a plurality of different cutting diameters.

31. An arrowhead as recited in claim 30 wherein said plurality of pivotal blades comprises two said pivotal blades.

32. An arrowhead as recited in claim 31 wherein said arrowhead is a blade-opening arrowhead.

33. An arrowhead as recited in claim 30 wherein said plurality of pivotal blades comprises three said pivotal blades.

34. An arrowhead as recited in claim 30 wherein said plurality of pivotal blades comprises four said pivotal blades.

35. An arrowhead as recited in claim 30 wherein each said pivotal blade defines the same cutting diameter as one another when the arrowhead is in at least one penetrating configuration.

36. An arrowhead as recited in claim 30 wherein the hinge means pivotally connecting each said blade to said arrowhead body are separate structural entities.

37. An arrowhead as recited in claim 30 wherein the hinge means pivotally connecting each said blade to said arrowhead body is an annular ring.

38. An arrowhead as recited in claim 30 wherein said cutting diameter selection means comprises hinge means relocation means for enabling said hinge means to be positioned at a plurality of different spatial locations relative to said arrowhead body.

39. An arrowhead as recited in claim 30 wherein said cutting diameter selection means comprises abutting surface change means for changing the spatial orientation of an abutting surface, relative to the arrowhead, that said blades abuts against when defining a cutting diameter.

40. A blade-opening arrowhead comprising:

(a) an arrowhead body having a central longitudinal axis;

(b) a pivotal blade having a cutting edge;

(c) hinge means for pivotally connecting said blade to said arrowhead body so as to enable said blade to rotate relative to said arrowhead body, said hinge means being configured such upon said arrowhead so as to not intersect said central longitudinal axis; and (d) cutting diameter selection means for enabling said pivotal blade to define a plurality of different cutting diameters.

41. A blade-opening arrowhead as recited in claim 40 wherein said cutting diameter selection means comprises hinge means relocation means for enabling said hinge means to be positioned at a plurality of different spatial locations relative to said arrowhead body.

42. A blade-opening arrowhead as recited in claim 40 wherein said cutting diameter selection means comprises abutting surface change means for changing the spatial orientation of an abutting surface, relative to the arrowhead, that said blade abuts against when defining a cutting diameter.

43. A blade-opening arrowhead as recited in claim 40 further comprising a plurality of said blades.

44. An arrowhead comprising:

(a) an arrowhead body having a central longitudinal axis;

(b) a pivotal blade having a cutting edge;

(c) hinge means for pivotally connecting said blade to said arrowhead body so as to enable said blade to rotate relative to said arrowhead body; and (d) hinge means relocation means for enabling said hinge means to be positioned at a plurality of different spatial locations relative to said arrowhead body.

45. An arrowhead as recited in claim 44 wherein when said hinge means is positioned at a first spatial location relative to said arrowhead body and at a second different spatial location relative to said arrowhead body, said blade is enabled to define at least two different cutting diameters.

46. An arrowhead as recited in claim 44 wherein said hinge means comprises an aperture in said blade and a hinge pin extending through said aperture.

47. An arrowhead as recited in claim 46 wherein said hinge means comprises a blade ring.

48. An arrowhead as recited in claim 46 wherein said hinge means comprises a set screw.

49. An arrowhead as recited in claim 46 wherein when said hinge means is positioned at a first spatial location a first plane perpendicular to said central longitudinal axis of said arrowhead body that intersects a cross-sectional center of said hinge means is not coplanar with a second plane also perpendicular to said central longitudinal axis that intersects the cross-sectional center of said hinge means when said hinge means is positioned at a second different spatial location.

50. An arrowhead as recited in claim 49 wherein the hinge means positioned at said first location has at least a section thereof that is substantially straight.

51. An arrowhead as recited in claim 49 wherein the hinge means positionable in both said different spatial locations is a single structural entity.

52. An arrowhead as recited in claim 51 wherein said hinge means comprises a bump of a blade ring.

53. An arrowhead as recited in claim 46 wherein when said hinge means is positioned at a first spatial location the shortest distance from a reference point that intersects said central longitudinal axis of said arrowhead body to a cross-sectional center of said hinge means is a different length than the shortest distance from said reference point to the cross-sectional center of said hinge means when said hinge means is positioned at a second different spatial location.

54. An arrowhead as recited in claim 53 wherein the hinge means positioned at said first location is a different structural entity than the hinge means positioned at said second location.

55. An arrowhead as recited in claim 53 wherein the hinge means positioned at said first location and the hinge means positioned at said second location is a set screw.

56. An arrowhead as recited in claim 44 further comprising abutting surface change means for changing the spatial orientation of an abutting surface, relative to the arrowhead, that said blade abuts against when defining a cutting diameter.

57. An arrowhead as recited in claim 56 wherein said arrowhead is a blade-opening arrowhead.

58. An arrowhead as recited in claim 57 wherein said pivotal blade rotates in a rearward direction when rotating from a closed in-flight configuration to an open penetrating configuration.

59. An arrowhead as recited in claim 57 further comprising a plurality of said blades.

60. An arrowhead comprising:

(a) an arrowhead body having a central longitudinal axis;

(b) a pivotal blade having a cutting edge;

(c) hinge means for pivotally connecting said blade to said arrowhead body so as to enable said blade to rotate relative to said arrowhead body; and (d) abutting surface change means for changing the spatial orientation of an abutting surface, relative to the arrowhead, that said blade abuts against when defining a cutting diameter.

61. An arrowhead as recited in claim 60 wherein said abutting surface change means comprises changing the angle of said abutting surface, relative to said central longitudinal axis, that said blade abuts against when in a penetrating configuration.

62. An arrowhead as recited in claim 61 further comprising a plurality of removably attachable blade-stop washers each having a different sloped blade abutting surface.

63. An arrowhead as recited in claim 62 wherein when each said blade-stop washer is individually mounted to said arrowhead body a forward end of each said blade-stop washer is displaced substantially the same distance from a cross-sectional center of said hinge means as is the forward end of each of the other said blade-stop washers.

64. An arrowhead as recited in claim 62 wherein when each said blade-stop washer is individually mounted to said arrowhead body a rearward end of each said blade-stop washer is not displaced substantially the same distance from a cross-sectional center of said hinge means as is the rearward end of each of the other said blade-stop washers.

65. An arrowhead as recited in claim 60 wherein said abutting surface change means comprises changing the distance said abutting surface is displaced from a cross-sectional center of said hinge means.

66. An arrowhead as recited in claim 65 comprising a plurality of removably attachable blade-stop washers each having a different sloped abutting surface.

67. An arrowhead as recited in claim 66 wherein a forward end of at least one said blade-stop washer when individually mounted to said arrowhead body is not displaced substantially the same distance from a cross-sectional center of said hinge means as is a forward end of at least one other said blade-stop washer when individually mounted to said arrowhead body.

68. An arrowhead as recited in claim 67 further comprising an extender element.

69. An arrowhead as recited in claim 66 wherein a single structural entity having at least one said abutting surface thereon enables said pivotal blade to define more than one different cutting diameter.

70. An arrowhead as recited in claim 60 further comprising hinge means relocation means for enabling said hinge means to be positioned at a plurality of different spatial locations relative to said arrowhead body.

71. An arrowhead as recited in claim 70 wherein said arrowhead is a blade-opening arrowhead.

72. An arrowhead as recited in claim 71 wherein said pivotal blade rotates in a rearward direction when rotating from a closed in-flight configuration to an open penetrating configuration.

73. An arrowhead as recited in claim 60 further comprising a plurality of said blades.

74. A blade-opening arrowhead comprising:

(a) an arrowhead body having a central longitudinal axis and a recessed annular groove;

(b) a plurality of blade-stop washers each having a different sloped blade abutting surface than one another, each said blade-stop washer being individually removably attachable with said arrowhead body;

(c) a pivotal blade having a cutting edge and an apeture; and (d) an annular blade ring having at least one bump formed thereon, said blade ring pivotally connecting said blade to said arrowhead body when extended through said blade apeture and when received within said recessed annular groove, wherein said blade, when pivotally connected to said arrowhead body so as to be seated on said bump and when rotated to an open position so as to be in abutment against a first sloped blade abutting surface of a first said blade-stop washer that is individually attached to said arrowhead body, defines a different cutting diameter than the cutting diameter defined by said blade when pivotally connected to said arrowhead body and when rotated to an open position so as to be in abutment against a second different sloped blade abutting surface of a second said blade-stop washer that is individually attached to said arrowhead body.

75. A blade-opening arrowhead as recited in claim 74 wherein said blade is seated on said bump when in abutment against said second different sloped blade abutting surface.

76. A blade-opening arrowhead as recited in claim 74 wherein said blade ring has a plurality of said bumps formed thereon.

77. A blade-opening arrowhead as recited in claim 76 further comprising a plurality of said blades, wherein one said blade is seated on each said bump when said blades are pivotally connected to said arrowhead body.

78. A blade-opening arrowhead as recited in claim 74 wherein said blade ring has a plurality of at least three said bumps formed thereon.

79. A blade-opening arrowhead as recited in claim 74 wherein said pivotal blade rotates in a rearward direction when rotating from a closed in-flight configuration to an open penetrating configuration.

80. A blade-opening arrowhead as recited in claim 74 further comprising a tip having a facet formed thereon.

* * * * *

UNITED STATES PATENT AND TRADEMARK OFFICE

CERTIFICATE OF CORRECTION

PATENT NO. : 6,165,086
DATED : December 26, 2000
INVENTOR(S) : Victor Jay Liechty II It is certified that error appears in the above-identified patent and that said Letters Patent is hereby corrected as shown below:

Column 20,
Line 61, replace -- 1 1/16 -- with "1/16".

Signed and Sealed this

Fourth Day of December, 2001

*Attest:*

Nicholas P. Godici

NICHOLAS P. GODICI
*Acting Director of the United States Patent and Trademark Office*

*Attesting Officer*